United States Patent [19]

Gravel

[11] Patent Number: 5,014,438

[45] Date of Patent: May 14, 1991

[54] LAYOUT RULER

[76] Inventor: Jean-Pierre Gravel, 607 Jean Avenue, Pembroke, Ontario, Canada, K8A 5H7

[21] Appl. No.: 527,143

[22] Filed: May 22, 1990

Related U.S. Application Data

[63] Continuation of Ser. No. 360,222, Jun. 1, 1989, abandoned.

[30] Foreign Application Priority Data

Feb. 3, 1989 [CA] Canada ..... 591045

[51] Int. Cl.[5] ..... B43L 7/00

[52] U.S. Cl. ..... 33/494

[58] Field of Search ..... 33/494, 483, 1 G

[56] References Cited

U.S. PATENT DOCUMENTS 1,279,261 9/1918 Clardy ..... 33/494

*Primary Examiner*—Harry N. Haroian

*Attorney, Agent, or Firm*—Louis Weinstein

[57] ABSTRACT

A novel layout ruler is provided to perform flat layout patterns directly on sheet metal stock, i.e. to mark the total length, or the shear cut size, of the sheet metal stock and to mark the sight line for bending the sheet metal stock. The ruler includes a body member having a scale ocmponent drawn along its central longitudinal axis and a scale blade component provided with a plurality of spaced-apart transverse lines extending from at lesat one side edge of the body member. The scale blade component includes: (i) one pair of spaced-apart lines representative of the inside bend radius (R); (ii) at least one pair of spaced-apart lines representative of the set back (SB); (iii) one pair of spaced-apart lines representative of the bend allowance (BA); and (iv) at least one pair of spaced-apart lines representative of the material deduction (MD). Upon use of such ruler, as described herein, the total length of the sheet metal stock can be determined, and the sight line can be marked directly thereon.

10 Claims, 29 Drawing Sheets

LAYOUT RULER

This is a continuation of application Ser. No. 360,222, filed June 1, 1989, now abandoned.

BACKGROUND OF THE INVENTION (i) Field of the Invention

The present invention relates to an instrument to enable a metal worker to perform flat layout patterns by marking the relevant lines directly on sheet metal stock, i.e. to mark the total length of the sheet metal stock and to mark the sight line for bending the sheet metal stock, very accurately and quickly. The invention is especially useful for, but is not limited to, 90° bends.

(ii) Description of the Prior Art

Analogous art includes many patents for scales or charts to provide a short cut for calculation. For example, Canadian Patent 75,600 patented Apr. 12, 1902 by J. M. Daly provided a scale-chart for graphically computing the tonnage resistance of trains of cars, including a chart arranged with devices or signs in successive order for indicating tonnage and a supplemental scale for indicating tonnage hauled.

Canadian Patent 133,733 patented June 13, 1911 by D. H. Layne provided a computing yard-measure provided with graduations, along one of its longitudinal edges, and transverse columns of figures arranged in pairs.

Canadian Patent 165,067 patented Sept. 21, 1915 by W. Zurich provided a framing tool comprising a rectangular plate having its face laid off to form reversely disposed squares, a table or scale columns disposed between the squares and having scale indicia, and markings within the area of the squares indicative of pitches.

Canadian Patent 212,135 patented May 31, 1921 by L. Smith provided a packet formed with a base plate fashioned with upturned ends and inwardly extending retaining flanges, a series of data cards pivoted on a common centre in one flange with their opposite ends under the inwardly extending flanges, and an upturned end on the flange at the opposite end of the base plate to guide the free ends of the cards.

Canadian Patent 383,933 patented Sept. 12, 1939 by J. Palmer provided bulk band gauges for a horizontal layout, including an elongated gauge body, graduators extending transversely of the gauge body, and scale indicia associated with the graduations and occupying at least two parallel zones extending longitudinally of the gauge for reading successively therealong.

U.S. Pat. No. 2,656,099 patented Oct. 20, 1953 by H. J. Selling provided charts for determining the proportions of three additively primary reacting colour dye stuffs required to produce a given colour. The charts each showed a series of constant concentration curves for one dye with respect to the concentrations of the other two dyes, for different preselected X,Y and Z stimuli of the eye.

U.S. Pat. No. 3,134,540 patented May 26, 1964 by E. M. Shiepe provided a nomographic computory device including a first panel having associated with the surface thereof a plurality of mathematically correlated reference line coordinates each related to a variable and each having indicia associated therewith setting off a fixed scale. A second panel was provided upon which the first panel was superimposed, the second panel having a plurality of groups of moduli scale quantities with the scale quantities in each group arranged in vertical and horizontal rows and mathematically related to a particular line coordinate on the first panel. A plurality of windows were provided on the first panel, each for revealing a scale quantity and each correlated in position to a particular line coordinate and its corresponding group of moduli scale quantities on the second panel.

U.S. Pat. No. 3,269,649 patented Aug. 30, 1966 by L. Abel provided numerographical apparatus for the systematic determination of the relationship between a plurality of co-related variables comprising a fixed table having a plurality of fixed parallel graduated logarithmic scales of the same modulus, a light permeable screen disposed over the table and a plurality of reading windows on the screen.

U.S. Pat. No. 3,559,881 patented Feb. 2, 1971 by R. L. Maison provided a nomographic instrument for solving mathematical problems. It included nomograms that enabled the manipulation of a straight line to read off the value of a dependent variable when the value of an independent variable was given, thereby computing, by means of graphic representation, systematic solutions to the problems capable of numerical calculation. The scales were immovable and the calculating line was moved by manipulations to intersect the scales at read-off points where memory indicators are positioned for reference. A plurality of calculating lines and a multiplicity of memory indicators operable at each and/or both sides of the instrument.

U.S. Pat. No. 4,122,994 patented Oct. 31, 1978 by M. B. McReynolds et al provided a computerized aid for determining the optimum cycle lengths for use in a vehicular traffic control system wherein inbound and outbound traffic flow are equally favored. The aid was a nomograph which provided a clear visual indication of candidate optimum cycle lengths for a particular group of intersections which required only prior knowledge of intersection relative locations. The graphical computational aid provided, in addition to the candidate optimum cycle length information, a visual indication of the quality of the candidate solution obtained for each of the controlled intersections of the group.

U.S. Pat. No. 4,203,542 patented May 20, 1980 by C. F. Corbett provided a calculating apparatus including a first body member having a first linear scale. The first body member had both a horizontally-elongated opening and a vertically-elongated opening. A second slidably member was provided having a second scale thereon and a third logarithmic scale. All the scales interacted to simplify the calculation of the required feeder head parameters, e.g. size, amount of antipiping compound, in casting metals. Only the size of the casting section being fed and the normalized inscribed circle relating thereto needle to be measured.

SUMMARY OF THE INVENTION (i) Aims of the Invention

It is readily apparent from the typical examples of patents described above that the art has not addressed itself to the provision of a scale or ruler to enable a metal worker to perform flat layout patterns directly on sheet metal stock, i.e. to mark the total length, or the shear cut size, of the sheet metal stock and to mark the sight line for bending directly on the sheet metal stock.

Before discussing the present invention, some general discussion of terminology used by a sheet metal worker will be provided. The "radius of bend" (R) of a sheet of material is the radius of the bend as measured on the inside of the curved material. The "minimum radius of bend" of a sheet of material is the sharpest curve, or bend, to which the sheet can be bent without critically weakening the part at the bend. If the radius of bend is too small for the temper of the sheet stock, stresses and strains will weaken the metal and may result in cracking.

When making a bend or fold in a sheet of metal, the metal worker must calculate the bend allowance (B.A.), i.e. the length of material required for the bend. Bend allowance depends on four factors, namely: (1) the degree of bend; (2) the radius of the bend; (3) the thickness of the metal; and (4) the type of metal used.

The type of material is also important. If the material is soft, it can be bent very sharply but if it is hard, the radius of bend will be greater to avoid cracking and the bend allowance will automatically be greater.

Bending metal compresses the material on the inside of the curve and stretches the material on the outside of it. However some distance between these two extremes lies a space which is not affected by either force. This is known as the "neutral line" or "neutral axis". The neutral axis occurs at a distance approximately 0.445" of the metal thickness (0.455"×T) from the inside of the radius of bend.

When bending metal to exact dimensions, the length of the neutral axis must be determined in order that sufficient material can be allowed for the bend. When laying out a piece of sheet metal, so that it can be cut to exact dimension before bending, one must know the starting and ending points of the bend so that the length of "flat" of stock can be determined.

Two factors are important in determining the "set back" (S.B.), namely, the radius of bend (R) and the thickness of material (T). For 90° bends, the formula is (R+T) while for more or less than 90° the formula become K(R+T), where K is a determined factor. The "set back" is the distance from the "bend tangent line" to the "mold point". The mold point is the point of intersection of the lines extending from the two outside surfaces (called "mold lines"), while the bend tangent lines are the starting and end points of the bend.

The "brake" or "sight line" is the mark on a flat layout which serves as a guide while bending. The sight line is located one bend radius back from the bend tangent line which is to be inserted under the nose of the brake, i.e. the tool used for making the bend.

In the past, it was necessary to calculate the various necessary factors to enable the sheet metal worker to produce accurate work, i.e. bends, in sheet metal stock from drawings submitted by an engineer. Formulas and tables for various angles, radii of bends, material thicknesses, and other factors where therefore established to attempt to save time in the calculation of the bend allowance. For example, the bend allowance (BA) formula for a 90° bend was derived in the past as follows:

A. To the radius of bend (R), add one-half the thickness of the metal ($\frac{1}{2}$T). This gives R+$\frac{1}{2}$T, the radius of the circle at approximately (but not exactly) the neutral axis.

B. Computer the circumference of the circle by multiplying the radius of curvature of the neutral axis (R+$\frac{1}{2}$T) by $2\pi$. This gives the circumference as $2\pi$ (R+$\frac{1}{2}$T).

C. Since a 90° bend is a quarter of a circle, divide the circumference by 4.

This gives the bend allowance formula for a 90° bend as:

$$\frac{2\pi(R+\frac{1}{2}T)}{4}$$

The formula, while practically correct, is nevertheless slightly in error because the neutral axis is not exactly in the centre of the sheet being bent.

The formula for angles other than 90° is slightly different. The top part of the formula must be multiplied by the number of degrees and then divided by 360.

Since it takes time to work out bend allowance using the formulas, charts were therefore developed which show the bend allowance required for a 1° bend according to the radius of bend and thickness of metal.

In the past, to determine the bend allowance for any degree of bend by the use of the table, the bend allowance per one degree for the thickness of material and the radius of bend required is first determined, and this is then multiplied by the number of degrees of the bend.

Tables have also been developed to calculate the set back. In the past, to calculate the set-back for a 90° bend, one had to add the inside radius of the bend to the thickness of the sheet stock, i.e. SB=R+T. However, to calculate set-back for angles larger or smaller than 90°, one had to consult Set-back Tables or K-Tables for a value, called K. Then one had to substitute this value in the formula, $$SB=K(R+T).$$

The value for K varied with the number of degrees in the bend.

In the past, the following steps were followed when doing a flat layout pattern, these steps being performed for each bend:

A. Determine the set-back (SB).

B. Determine the bend allowance (BA).

C. To find the distance from the edge of the sheet to the first bend tangent line (called the flat), subtract one set-back from the given height. This enabled one to draw a first bend tangent line.

D. To find the distance from the first bend tangent line to the second bend tangent line, add one bend allowance (BA) thereto.

E. To find the distance from the second bend tangent line to the edge of the second flange, subtract one set-back (SB) from the given length. This line is then marked in.

F. Then a sight line is drawn in.

The overall length is the amount of material required to make the angle, or the shear cut size.

However, these procedures were so time consuming and the calculations were so prone to error that the procedure, recommended in the past, in order to prevent waste of material and to obtain a greater degree of accuracy in the finished part, was to make a layout, or pattern, of the part on paper, then to cut that pattern to exact size, and then to transfer those measurements to the material. To insure accuracy when doing a flat layout on metal or when transferring measurements from paper to metal, it was necessary always to work from one end (side) only.

In summary, the set back (SB), which is used for one bend or when more than one bend is required, is always used to find the position of the first bend tangent line of the bend or bends of the layout. The SB is determined in conjunction with, or in relation to, the outside given height or length dimensions.

The bend allowance (BA) is always used to find the position of the second bend tangent line of a bend or bends of the layout. It is determined in conjunction with the first established bend tangent line.

The material deduction (MD) is always used to find: the overall material or shear cut size of any flanged part; or, in a box flange, the size of the corner cut out or the notching at the corner of two perpendicular flanges; or the hole or any notched-out portion of a flanged part. Such MD is determined in conjunction with the outside given height, length or depth dimensions of a given flange and the given outside, height, length or depth, dimensions to the hole or the portion to be cut out.

It is therefore clear that there is a need for a simple device or ruler which can be used by a metal worker to enable the metal worker to mark out directly on the sheet metal stock the total length of the metal material as well as the bend allowance (BA), the set back (SB), the sight line, and the material deduction (MD) in a fast, very accurate manner.

Such device or ruler would obviate the need for charts and calculators, and would likewise obviate the need to make a paper layout or pattern and to make test pieces. Even an inexperienced sheet metal worker can start the layout immediately and the shear cut can be determined from the beginning. This can also provide for the possibility of doing the layout from either end or from both ends at the same time, at the convenience of the sheet metal worker.

(ii) Statements of Invention

This invention, now provides a layout ruler to perform flat layout patterns and to mark the total length, or the shear cut size, of a sheet metal stock and to mark the sight line for bending on the sheet metal stock comprising: a body member bearing a scale component along its central longitudinal axis, and a scale blade component provided with a plurality of spaced-apart transverse lines extending from at least one side edge of the body member, the scale blade component being provided with: (i) one pair of spaced-apart lines representative of the inside bend radius (R); (ii) at least one pair of spaced-apart lines representative of the set back (SB); (iii) one pair of spaced-apart lines representative of the bend allowance (BA); and (iv) at least one pair of spaced-apart lines representative of the material deduction (MD); whereby, upon use of the ruler, the total length of the sheet metal stock can be determined, and the sight line can be marked thereon.

This invention also provides a packet is provided to perform flat layout patterns and to mark the total length, or the shear cut size, of a sheet metal stock and to mark the sight line for bending on the sheet metal stock, the packet comprising: a plurality of layout rulers secured together at a pivot point at a round end of each such ruler, each of the layout rulers comprising: (a) a body member bearing a scale component along its central longitudinal axis, and (b) a scale blade component provided with a plurality of spaced-apart transverse lines extending from at least one side edge of the body member, the scale blade component being provided with: (i) one pair of spaced-apart lines representative of the inside bend radius (R); (ii) at least one pair of spaced-apart lines representative of the set back (SB); (iii) one pair of spaced-apart lines representative of the bend allowance (BA); and (iv) at least one pair of spaced-apart lines representative of the material deduction (MD); whereby, upon use of the ruler, the total length of the sheet metal stock can be determined, and the sight line can be marked thereon. Each ruler is designed for a preselected thickness of material (T). Each ruler in the packet has a separate scale blade component designed for a selected one of a pair of preselected bend radii.

(iii) Other Features of the Invention

Preferably, by one feature of this invention, the plurality of spaced-apart transverse lines of one such scale blade component extend from each side edge of the body member, each the scale blade component being designed to produce different R, SB, BA and MD for a selected radius of 90° bend. Each such scale blade component is designed for a selected metal thickness (T).

For each ruler, the spaced-apart lines provided may be representative, sequentially, of one R, two SB, one BA and two MD, or the spaced-apart lines provided may be representative, sequentially, of one R, one SB, two SB, one BA, one MD and two MD.

By another feature of this invention, in this packet, the plurality of spaced-apart transverse lines of such scale blade component extend from each side edge of the body member, each of the plurality of spaced-apart transverse lines of such scale blade component being designed to produce different R, SB, BA and MD for a selected radius of 90° bend.

In such a packet, and for each ruler, the spaced-apart lines provided may be representative, sequentially, of one R, two SB, one BA and two MD. Alternatively, in such packet and for each ruler, the spaced-apart lines provided may be representative, sequentially, of one R, one SB, two SB, one BA, one MD and two MD.

BRIEF DESCRIPTION OF THE DRAWINGS

In the accompanying drawings,

FIG. **5*a* is an isometric view showing two 90° bends in a piece of sheet metal; while

FIG. **6*a* is an isomeric view showing four 90° bends in a piece of sheet metal; while

FIG. **7*a* is an isometric view showing a notched box flange formed from a piece of sheet metal; while

FIG. 8*a* is an isometric view showing a 45° bend in a piece of sheet metal; while

FIG. 9*a* is an isometric view showing a 120° bend in a piece of sheet metal; while FIG. 10*a* is an isometric view showing a combination of a 120° bend and a 90° bend in a piece of sheet metal; while

Figure 1:
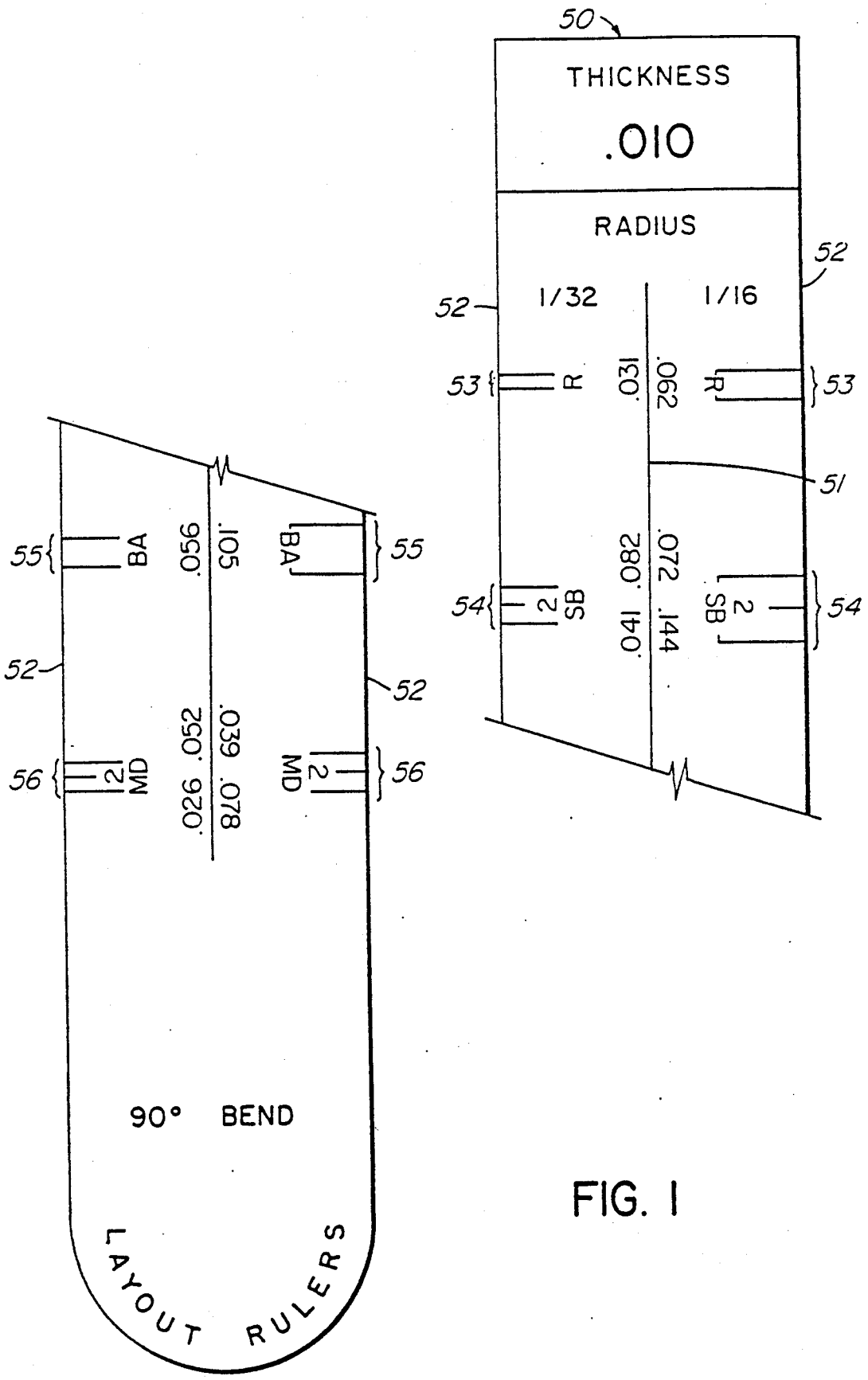
FIG. 1 shows one embodiment of the 90° bend layout ruler of the present invention with actual dimensions for thickness, radii, material deduction, bend allowance and set back indicated thereon.
Figure 2:
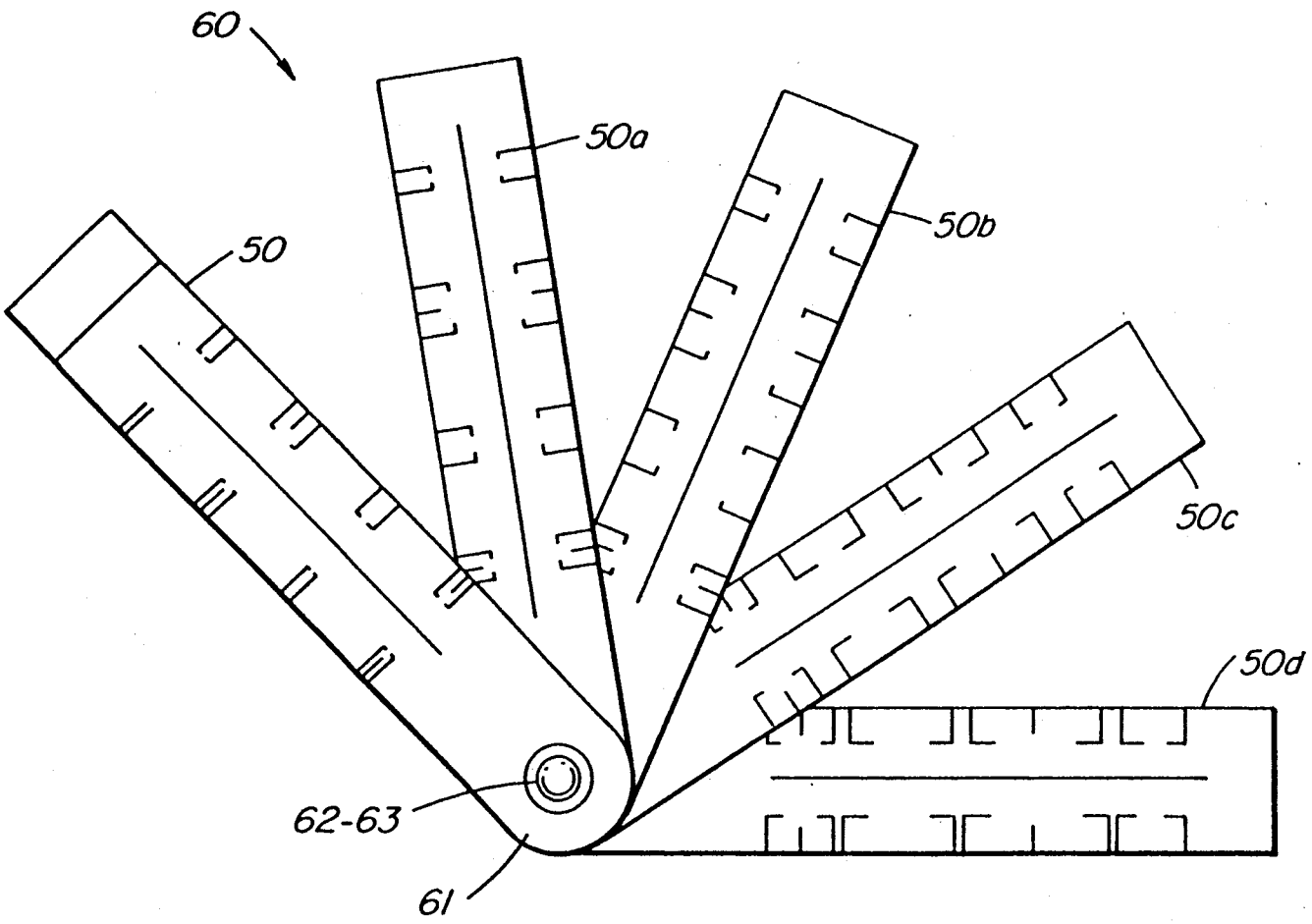
FIG. 2 shows a packet of five rulers (with actual numerical dimension omitted) according to another embodiment of this invention.

DESCRIPTION OF PREFERRED EMBODIMENTS (i) Description of FIGS. 1 and 2

As seen in FIG. 1, the ruler 50 is one of a set of five (shown assembled in FIG. 2) for a material thickness (T) of 0.010". Each ruler 50, 50*a*, 50*b*, 50*c* in FIG. 2 has a central line 51 drawn therein (as seen only in FIG. 1) with numbers spaced therealong, the numerals being indicative of the pitch, i.e. the distance between two adjacent lines. Along each lateral edge 52 is a plurality of spaced-apart transverse lines 53 for each preselected radius (R), i.e. for radii of 1/32", and 1/16", (shown in FIG. 1) and for radii of 3/32", ⅛", 5/32", 3/16", 7/32", ¼", 9/32" and 5/16" of the other four rulers of the set shown in FIG. 2 without the dimension numerals. Transverse, spaced-apart lines 53 are representative of the length required to provide the radius (R). Transverse space-apart lines 54 are representative of the length required to provide two set backs (SB). Transverse, spaced-apart lines 55 are representative of the length required to provide the bend allowance (BA). Transverse, spaced-apart lines 56 are representative of the length required to provide two material deductions (MD).

While not shown in the drawings, other embodiments of the invention provide respective sets of five rulers designed for the following characteristics:

(1) a material thickness (T) of 0.015", and radii of 1/32" and 1/16", 3/32" and ⅛", 5/32" and 3/167", 7/32" and ¼", and 9/32" and 5/16" with the spaced-apart transverse marginal lines provided for, one R, one SB, two SB's, one BA, one MD and two MD's;

(2) a material thickness (T) of 0.020" and radii of 1/32" and 1/16", 3/32" and ⅛", 5/32" and 3/16", 7/32" and ¼", and 9/32" and 5/16", with the spaced-apart transverse marginal lines provided for one R, two SB's, one BA, and two MD's.

(3) a material thickness (T) of 0.030" and radii of 1/32" and 1/16", 3/32" and ⅛", 5/32" and 3/16", 7/32" and ¼", and 9/32" and 5/16", with spaced-apart transverse marginal lines provided for one R, one SB, two SB's, one BA, one MD and two MD's;

(4) a material thickness (T) of 0.030" and radii of 1/32" and 1/16", 3/32" and ⅛", 5/32" and 3/16", 7/32" and ¼", and 9/32" and 5/16", with spaced-apart, transverse marginal lines provided for one R, two SB's, one BA, and two MD's;

(5) a material thickness (T) of 0.040" and radii of 1/16" and 3/32", ⅛" and 5/32", 3/16" and 7/32", ¼" and 9/32", and 5/16" and 11/32", with spaced-apart, transverse, marginal lines provided one R, one SB, two SB's, one BA, one MD and two MD's;

(6) a material thickness (T) of 0.040" and radii of 1/16" and 3/32", ⅛" and 5/32", 3/16" and 7/32", ¼" and 9/32", and 5/16" and 11/32" with spaced-apart, transverse, marginal lines provided for one R, two SB's, one BA, and two MD's;

(7) a material thickness (T) of 0.050" and radii of 1/16" and 3/32", ⅛" and 5/32", 3/16" and 7/32", ¼" and 9/32", and 5/16" and 11/32" with spaced-apart, transverse marginal lines provided for one R, one SB, two SB's, one BA, one MD and two MD's;

(8) a material thickness (T) of 0.050" and radii of 1/16" and 3/32", ⅛" and 5/36", 3/16" and 7/32", ¼ and 9/32", and 5/16" and 11/32" with spaced-apart, transverse, marginal lines provided for one R, two SB's, one BA, and two MD's;

(9) a material thickness (T) of 0.060" and radii of 1/16" and 3/32", ⅛" and 5/32", 3/16" and 7/32", ¼ and 9/32", and 5/16" and 11/32" with spaced-apart, transverse, marginal lines provided for one R, two SB's, one BA, and two MD's;

(10) a material thickness (T) of 0.065" and radii of 1/16" and 3/32", ⅛" and 5/32", 3/16" and 7/32", ¼ and 9/32", and 5/16" and 11/32" with spaced-apart, transverse, marginal lines provided for one R, one SB, two SB's, one BA, one MD and two MD's;

(11) a material thickness (T) of 0.065" and radii of 1/16" and 3/32", ⅛" and 5/32", 3/16" and 7/32", ¼ and 9/32", and 5/16" and 11/32" with spaced-apart, transverse, marginal lines provided for one R, two SB's, one BA, and two MD's;

(12) a material thickness (T) of 0.070" and radii of 3/32" and ⅛", 5/32" and 3/16", 7/32" and ¼, 9/32" and 5/16", and 11/32" and ⅜" with spaced-apart, transverse, marginal lines provided for one R, two SB's, one BA, and two MD's;

(13) a material thickness (T) of 0.080" and radii of 3/32" and ⅛", 5/32" and 3/16", 7/32" and ¼, 9/32" and 5/16", and 11/32" and ⅜41 , with spaced-apart, transverse, marginal lines provided for one R, two SB's, one BA, and two MD's;

(14) a material thickness (T) of 0.090" and radii of 3/32" and ⅛", 5/32" and 3/16", 7/32" and ¼, 9/32" and 5/16", and 11/32" and ⅜", with spaced-apart, transverse, marginal lines provided for one R, two SB's, one BA, and two MD's;

(15) a material thickness (T) of 0.100" and radii of ⅛" and 3/16" and 7/32", ¼" and 9/32", 5/16" and 1/32", and ⅜" and 11/32", with spaced-apart, transverse, marginal lines provided for one R, two SB's, one BA, and two MD's; and

(16) a material thickness (T) of 0.125" and radii of 5/32" and 3/16", 7/32" and ¼", 9/32" and 5/16", 11/32" and ⅜", and 13/32" and 7/16", with spaced-apart, transverse, marginal lines provided for one R, two SB's, one BA, and two MD's.

As an essential feature of embodiments of this invention, as the thickness of material increases, the minimum bend radius increases, in order to avoid cracking of the material.

(ii) Description of FIG. 2

FIG. 2 shows a packet 60 of a plurality, i.e. 5, of the layout ruler 50, 50*a*, 50*b*, 50*c* and 50*d* of FIG. 1. In this drawing, the curved ends 61 are each provided with an aperture 62 through which a suitable fastener, e.g. a rivet 63 is passed to provide a relatively movable set of rulers.

Figure 3:
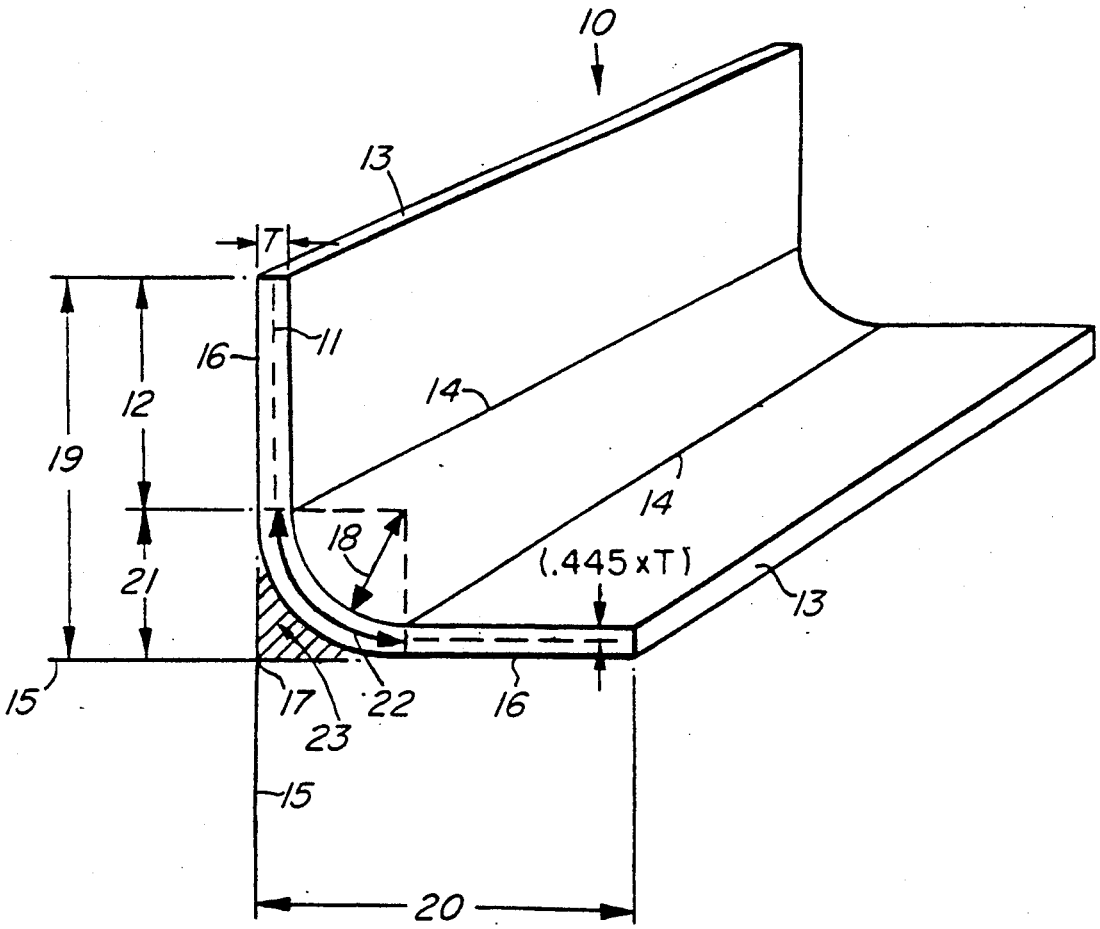
FIG. 3 is an isometric view of a bend in a piece of sheet metal defining pictorially the terms used in the present application.

(iii) Description of FIG. 3

Turning firstly to FIG. 3, it is seen that, for a bent piece of sheet metal 10, the "neutral axis" 11 is an imaginary line at 0.445" of the thickness (T) from the inside radius of the metal. The "flat" 12 is the distance from the edge 13 of the material to the "bend tangent line" 14. The "bend tangent lines" 14 are the edges of the bend. The mold lines 15 are the lines drawn along the outside edges 16 of the sheet metal 10. The "mold point" 17 is the intersection point of the two "mold lines" 15. The "inside radius" (R) 18 is the radius of curvature between the two bend tangent lines 14. The "given height" 19 is the distance between the "mold point" 17 and one edge 13 of the material, and similarly the "given length" 20 is the distance between the mold point 17 and the outer edge 13 of the material. The "set back" (SB) 21 is the distance between the mold point 17 and the bend tangent lines 14. The "bend allowance" (BA) 22 is the length of material along the material axis between the bend tangent lines 14. The material deduction (MD) 23 is the amount or area of material not being used per bend because of the outside radius. It is surrounded by the two mold lines 15 and the outside material of the curve or bend and finishes at the level of the bend tangent lines 14.

In another embodiment of this invention, it is preferred that two layout rulers be provided on each ruler blank, i.e., one on each face of the ruler blank. Then it would be desirable to provide a translucent coloured plastic protection strip to be used on one side of the layout ruler to guard against the user of the layout ruler from using the wrong side of the layout ruler should the user become distracted.

(iv) Description of FIGS. 4*a*–4*f*

Figure 4A:
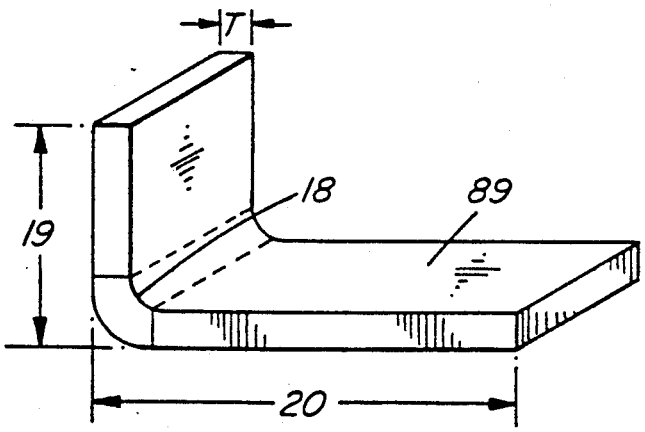
FIG. 4 is an isometric view showing one 90° bend in a piece of sheet metal; while FIGS. **4*b*–4*f* are plan views showing steps in the laying out of the lines to provide the bend in the piece of sheet shown in FIG. 4*a*, using the layout rulers of another embodiment of the present invention.
FIG. 4*g*** is a sectional view showing the aligning of the sight line with the brake.
Figure 4B:
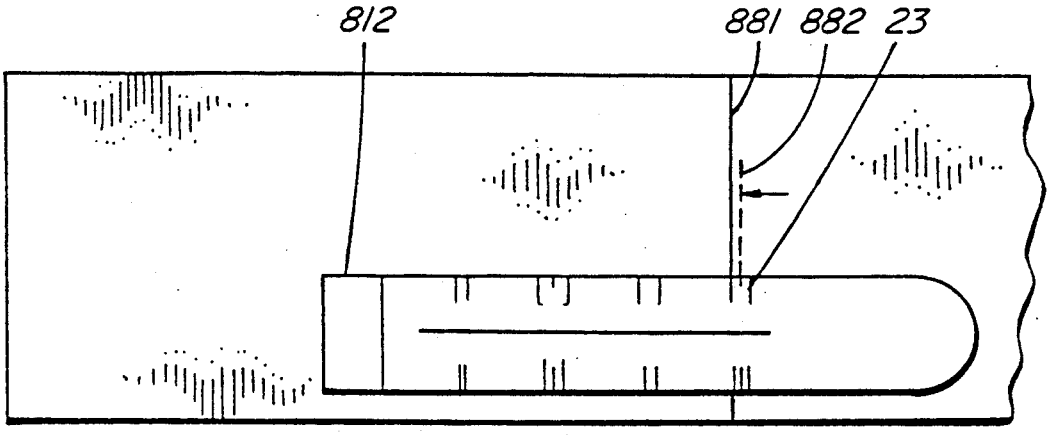
Figure 4C:
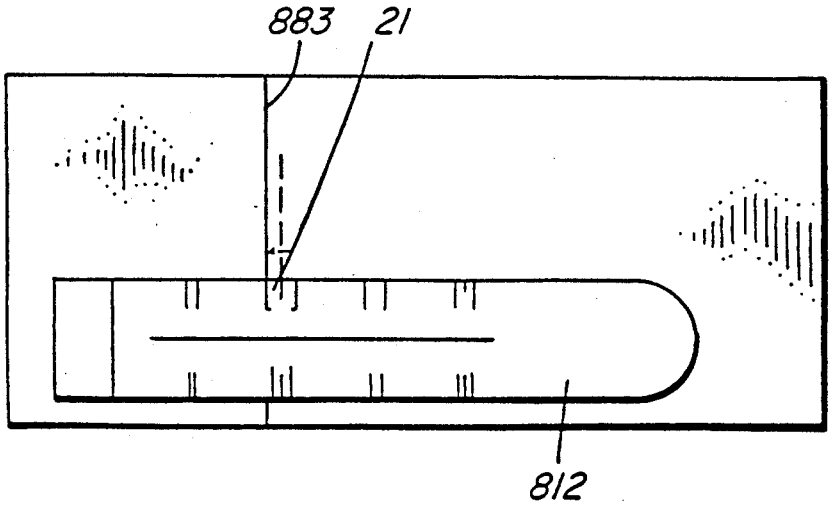
Figure 4D:
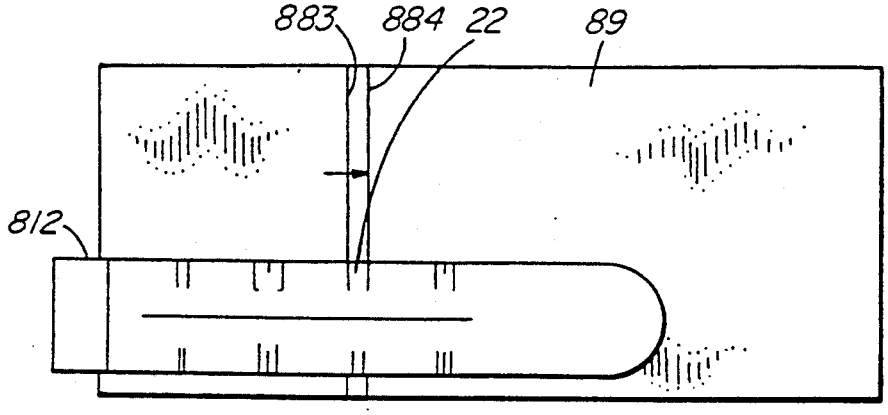
Figure 4E:
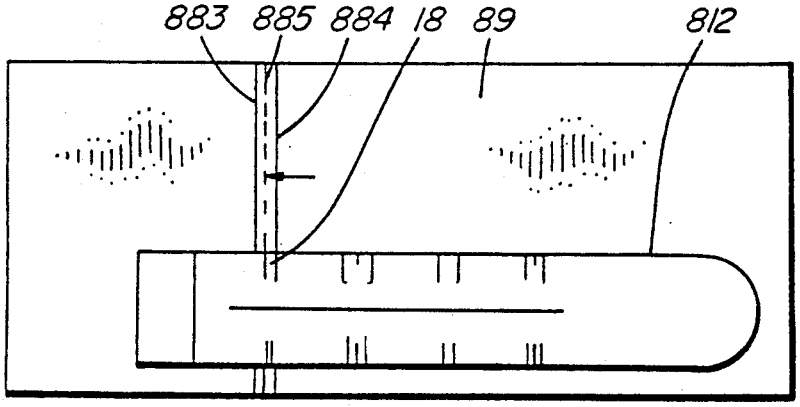

FIG. 4*a* shows the final 90° bend and FIGS. 88*b*–88*f* show the five steps used in the marking off of a 1/16" radius bend [R, (53)=1/16"] in a 0.020" thickness (T) of sheet metal, with a given height (19) of 1½" and a given length (20) of 3" of a piece of sheet metal (shown in FIG. 4*a*). The five steps are:

(1) The shear cut size 881 is determined by subtracting one MD (23) from the total length 882 of 1½"+3"=4½". This is determined in FIG. 4*b* using a 90° bend ruler 812 of this invention designed for a thickness of 0.020" and a radius of 1/16".

(2) The first bend tangent line 883 is determined by subtracting one SB (21) from the given height (19) of 1½". This is determined in FIG. 4*c*, using the same 90° bend ruler 812.

(3) The second bend tangent line 884 is determined by adding one BA (22) to the first bend tangent line 883. This is determined in FIG. 4*d*, using the same 90° bend ruler 812.

(4) The brake or sight line 885 is then drawn in. The brake or sight line is the mark on a flat layout which serves as a guide while bending. The sight line 885, which is to be inserted under the nose of the brake, is located one bend radius R, (18) back from the second bend tangent line 884. The marking-off of the brake or sight line is determined in FIG. 4*e*, using the same 90° bend layout ruler 812.

Figure 4F:
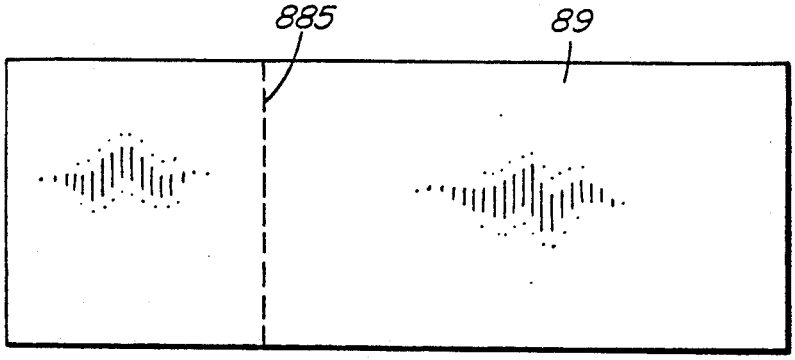

(5) The left hand side of the sheet metal is then bent upward using the drawn-in brake or sight line 885 as a guide. This drawn-in brake or sight line 885 is shown in FIG. 4*f*.

Figure 4G:
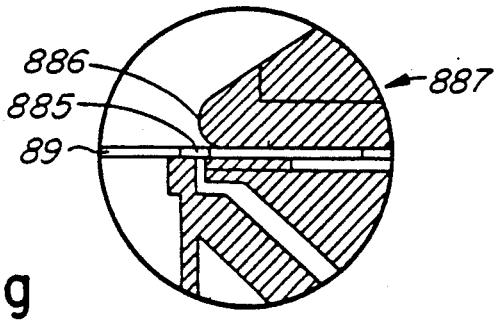

FIG. 4*g* shows the location of the brake or sight line 885 in relation to the nose 886 of the brake 887. When bending, the brake or sight line 885 is lined up to be even with the nose 886 of the brake 887.

(v) Description of FIGS. 5*a*–5*j*

Figure 5A:
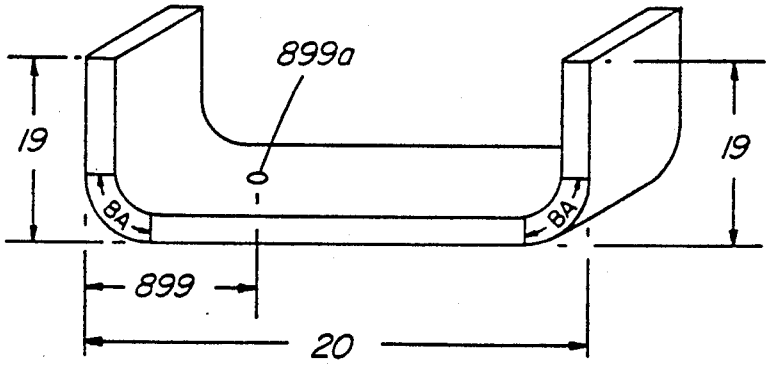
FIGS. 5*b*–5*j* are plan view showing steps in the laying out of the lines to provide the two 90° bends in the piece of sheet metal shown in FIG. 5*a***, using the layout rulers of another embodiment of this invention.
Figure 5B:
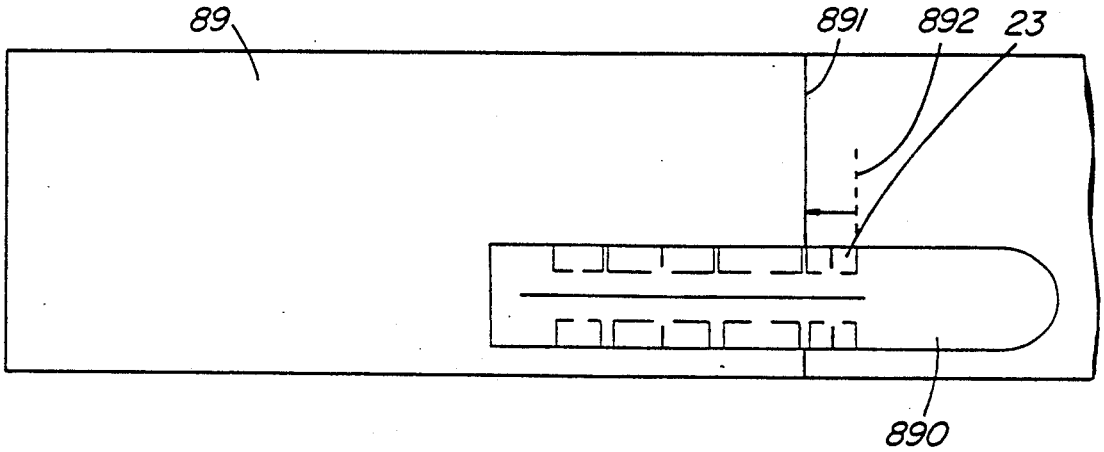
Figure 5C:
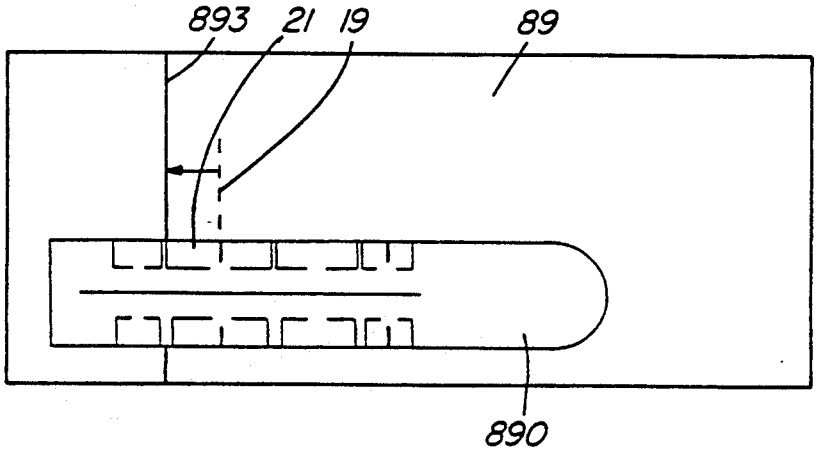
Figure 5D:
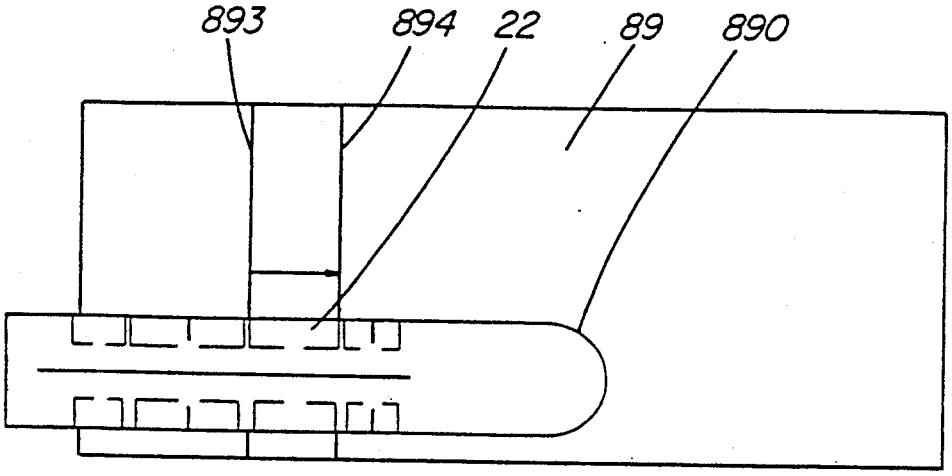
Figure 5E:
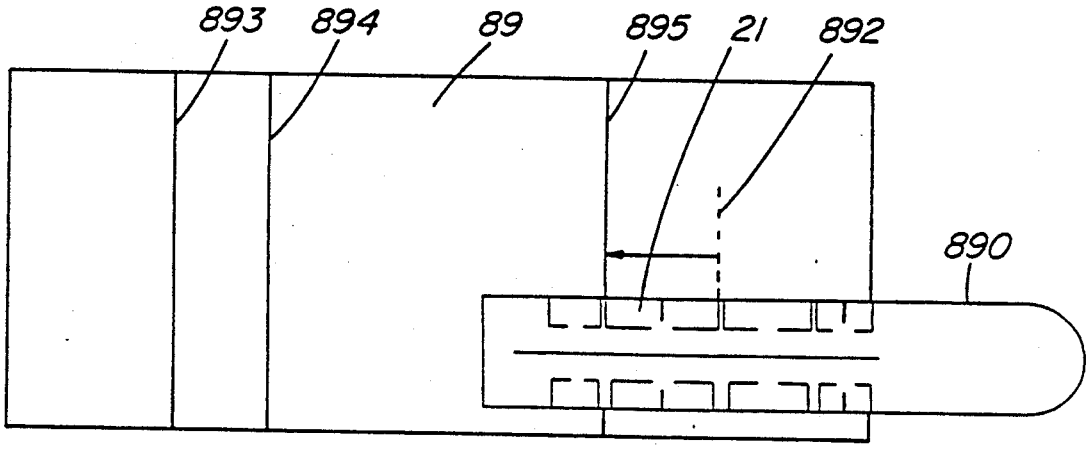
Figure 5F:
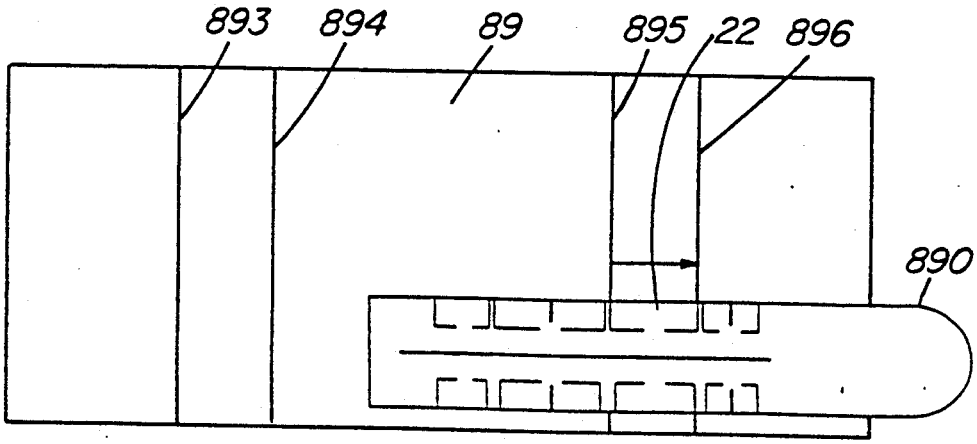

FIG. 5*a* shows the final two 90° bends, the FIGS. 5*b*–5*j* show the steps taken in the marking off of the length required to provide the two 5/16" radii bends [R,(53)=5/16"], one at each end of a 0.020" thickness (T) piece of sheet metal with a given height (19) of 1¼" and a given length (20) of 2½", and also to provide the location of a ⅛" diameter hole (899*a*) at a predetermined distance from the bend along the central longitudinal axis of the piece of sheet metal 89 (shown in FIG. 5*a*). The steps are:

(1) The shear cut size 891 is determined by subtracting two MD's (23) (i.e. one MD for each bend) from the total length 892 of 1¼"+2½"+1¼"=5". This is determined in FIG. 89*b* using 90° bend ruler 890 of this invention designed for a thickness of 0.020" and a radius of 5/16".

(2) The first bend tangent line 893 is determined by subtracting one SB (21) from the given height (19). This is determined in FIG. 5*c* using the same 90° bend ruler 890.

(3) The second bend tangent line 894 is determined by adding one BA (22) to the first bend tangent line 893. This is determined in FIG. 5*d* using the same 90° bend ruler 890.

(4) The third bend tangent line 895 is determined by subtracting two SB's (21) (i.e. one for each bend) from the total length (20) 892 from the second bend tangent line 894. This is determined in FIG. 5*e* using the same 90° bend ruler 890.

(5) The fourth bend tangent line 896 is determined by adding one BA (22) to the third bend tangent line 895. This is determined in FIG. 5*f* using the same 90° bend ruler 890.

Figure 5G:
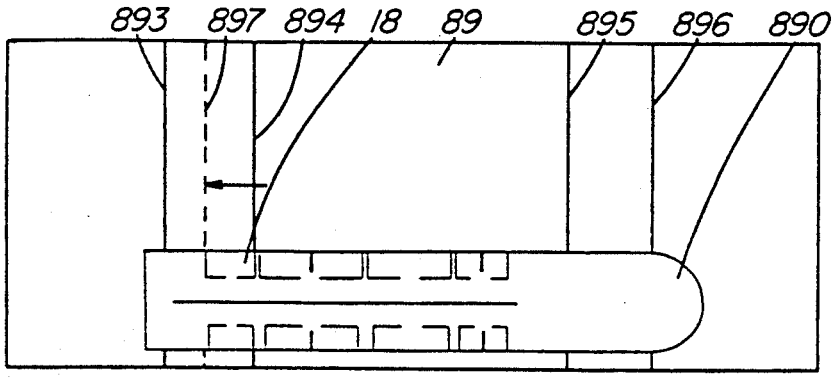

(6) The first brake or sight line 897 is then drawn in, its position being determined by subtracting one R (18) from the second bend tangent line 894. This is determined in FIG. 5*g* using the same 90° bend ruler 890. This first brake or sight line 897 is shown in FIG. 5*g*.

Figure 5H:
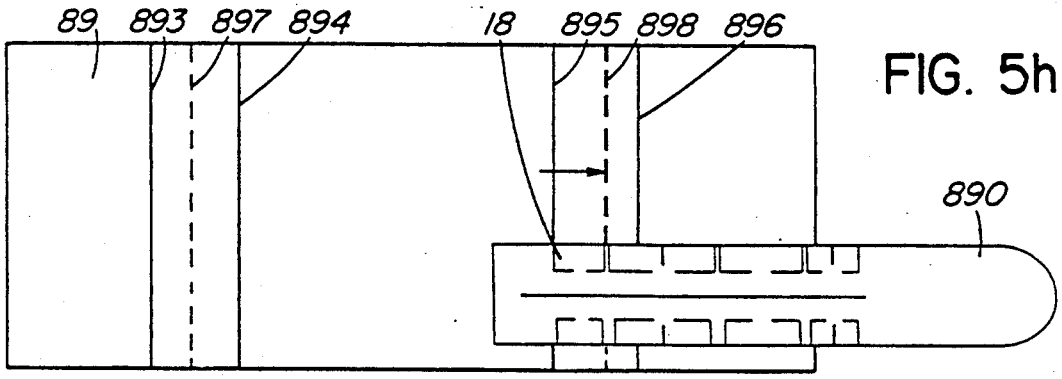
Figure 5I:
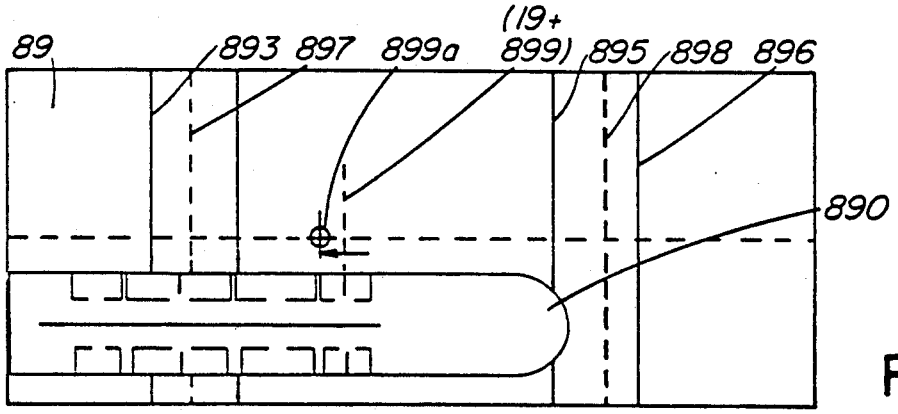

(7) The second brake or sight line 898 is then drawn in by adding one R (18) to the third bend tangent line 895. This is determined in FIG. 5*h* using the same 90° bend ruler 890. This second brake or sight line 898 is shown in FIG. 5*h*.

Figure 5J:
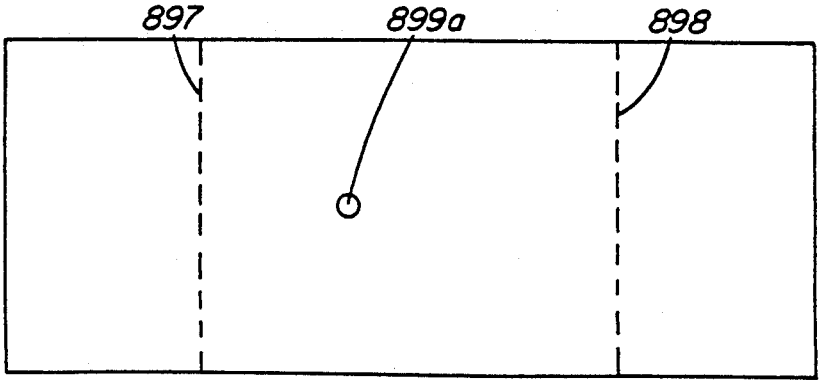

(8) The normal position of the ⅛" diameter hole 899*a* is determined by adding the given height (19) and the given length 899 to the hole, i.e. 1¼"+⅞"=2⅛". The true position of hole 899*a* is determined by subtracting one MD (23) from that distance, as determined using the same 90° bend ruler 890. The position of hole 899*a* is shown in FIG. 5*j*.

(9) The sheet metal is then bent, using the drawn-in brake or sight lines 897 and 898. These drawn-in brake or sight lines are shown in FIG. 5*j*. Similarly to the orientation shown when bending as seen in FIG. 4*g*, the brake or sight lines 897 and 898 are up and are lined up to be even with the nose 886 of the brake 887.

Figure 6A:
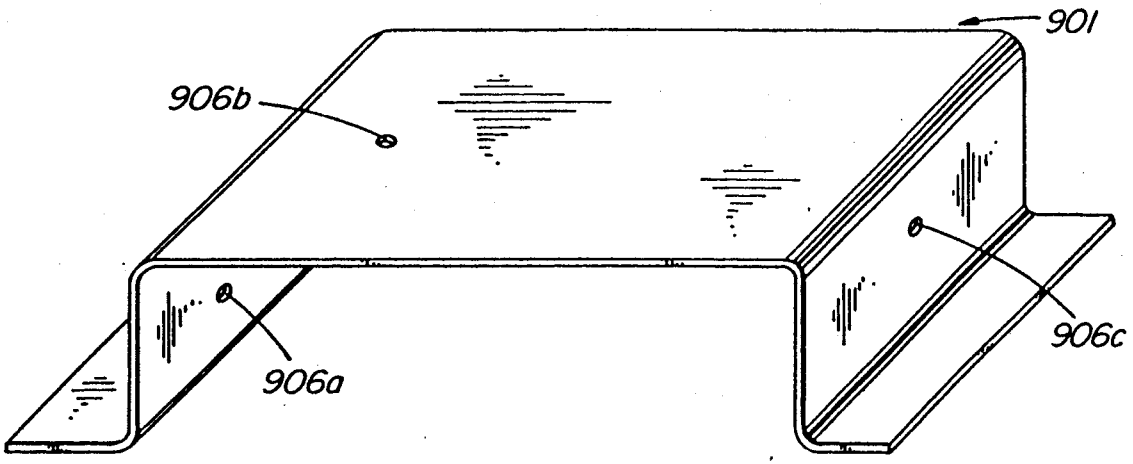
FIGS. 6*b*–6*o* are plan view showing steps in the laying out of the lines to provide the four 90° bends in the piece of sheet metal shown in FIG. 6*a***, using the layout rulers of another embodiment of the present invention.
Figure 6B:
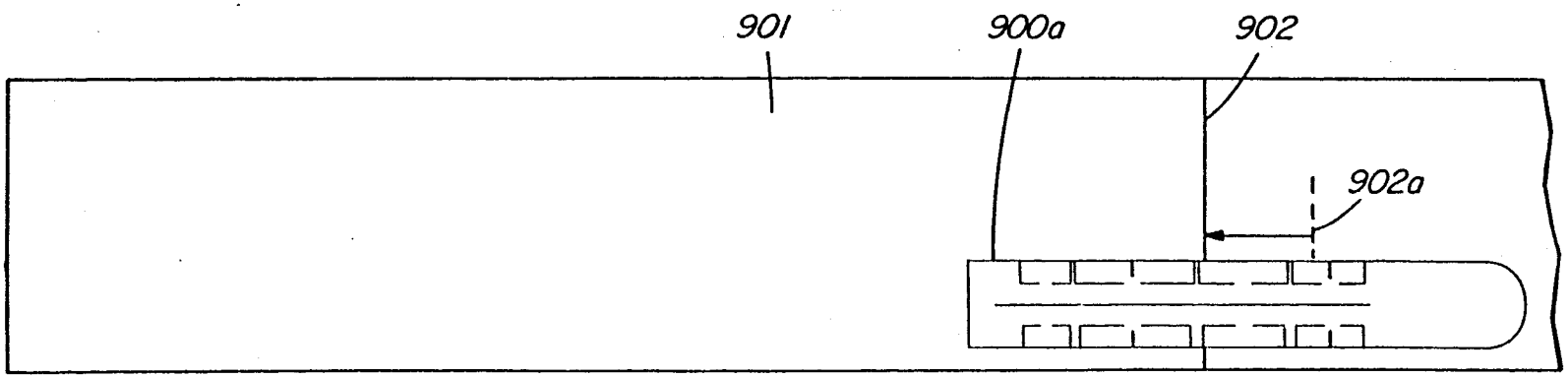
Figure 6C:
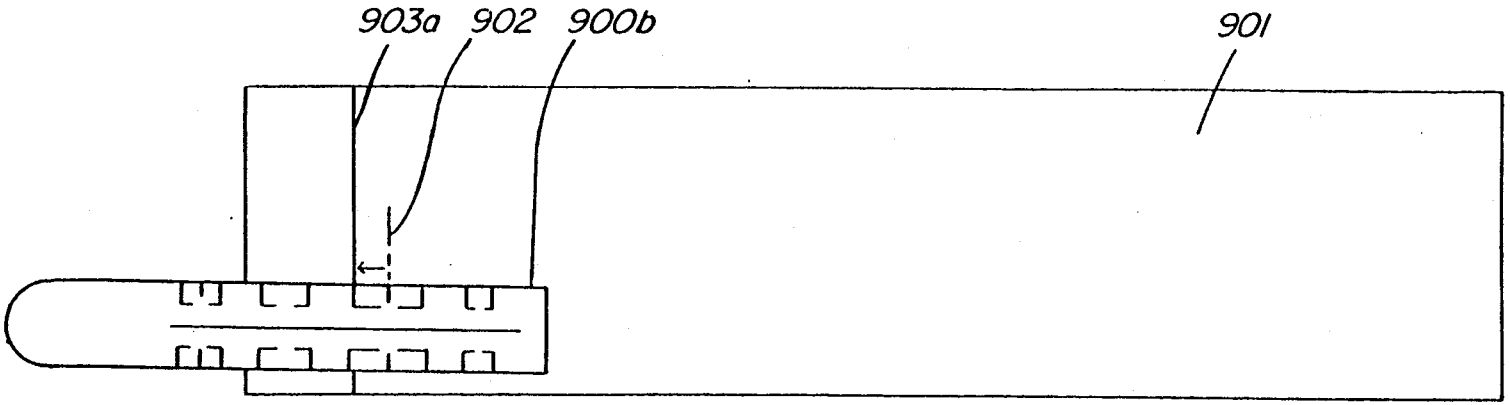
Figure 6D:
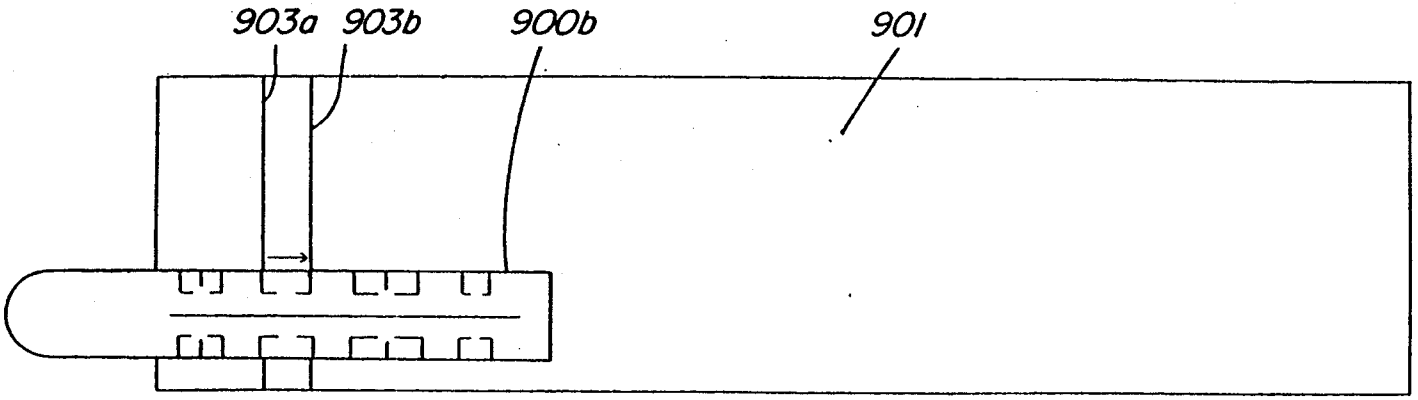
Figure 6E:
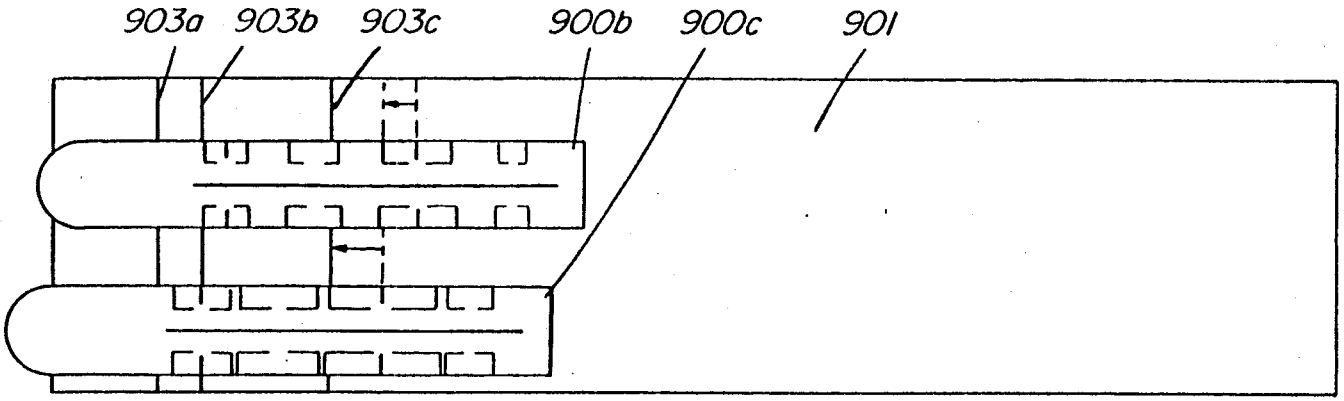
Figure 6F:
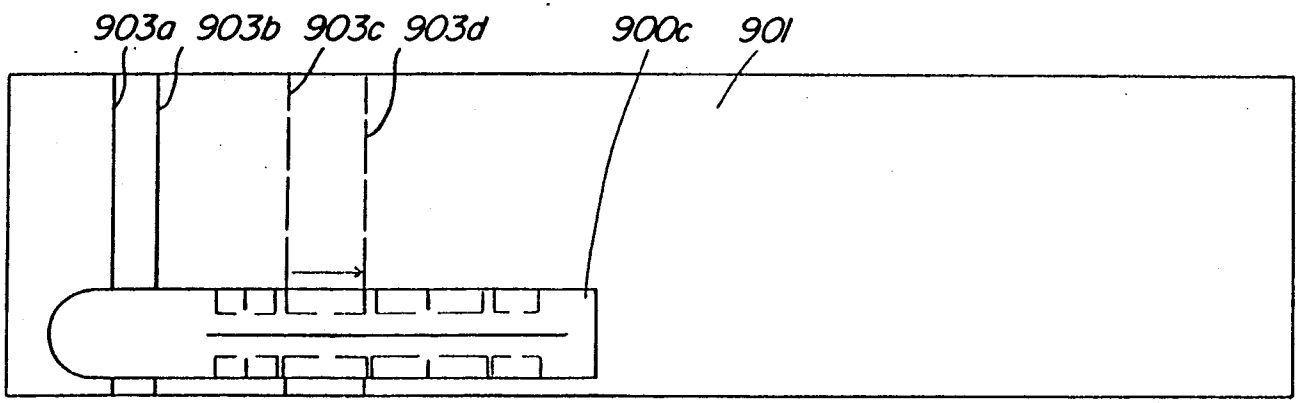
Figure 6G:
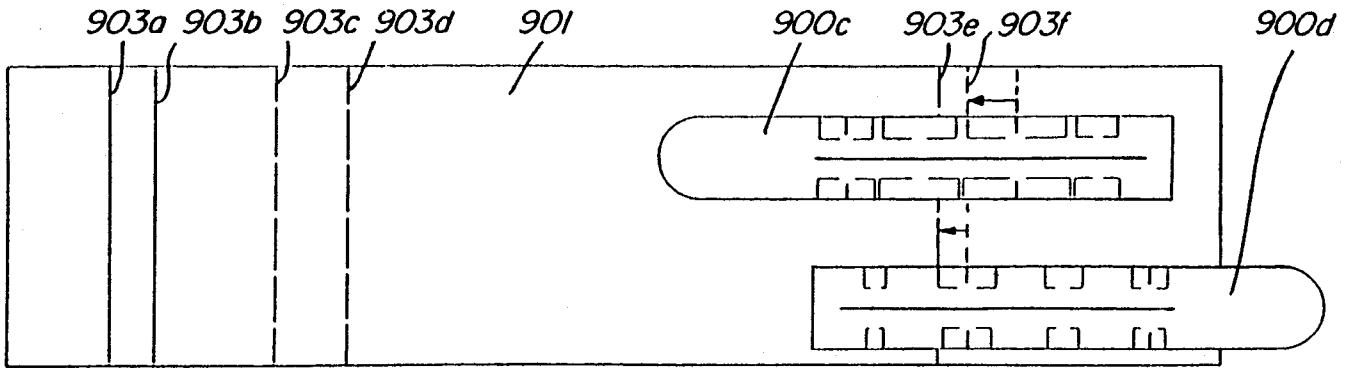
Figure 6H:
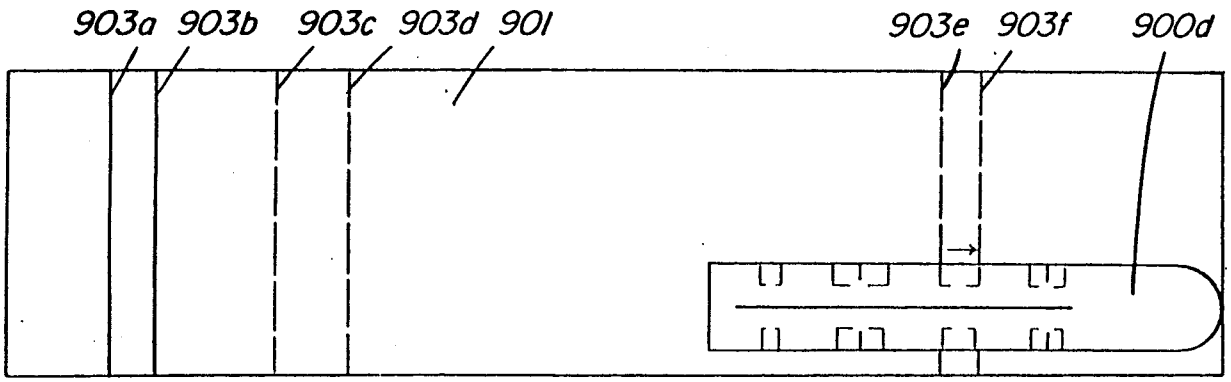
Figure 6I:
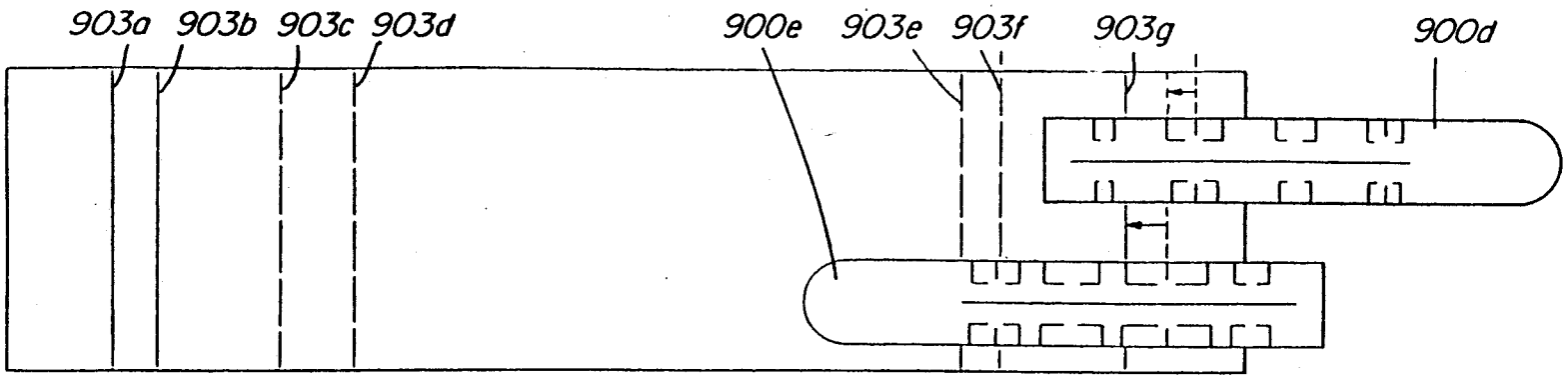
Figure 6J:
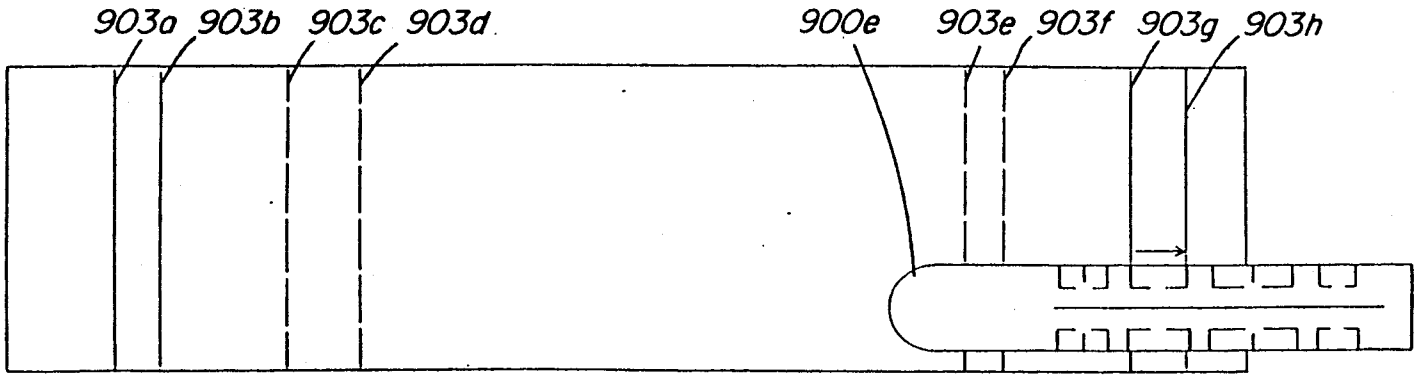
Figure 6K:
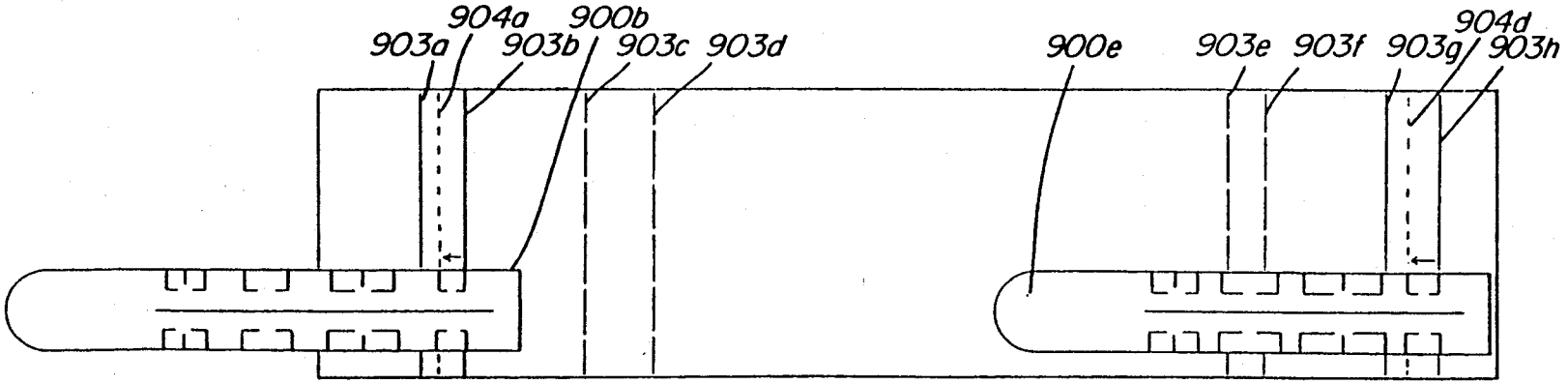
Figure 6L:
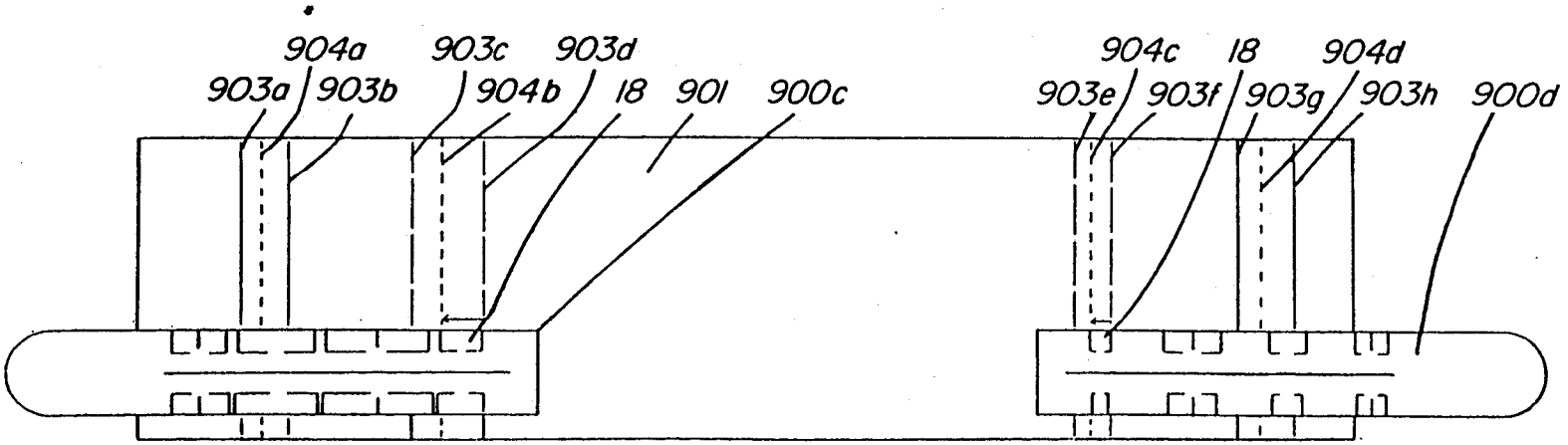
Figure 6M:
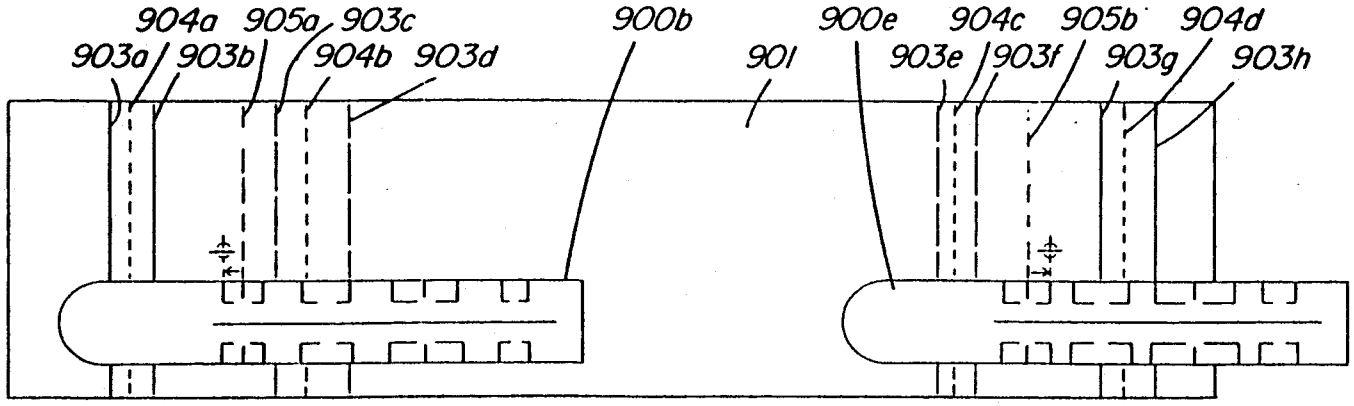
Figure 6N:
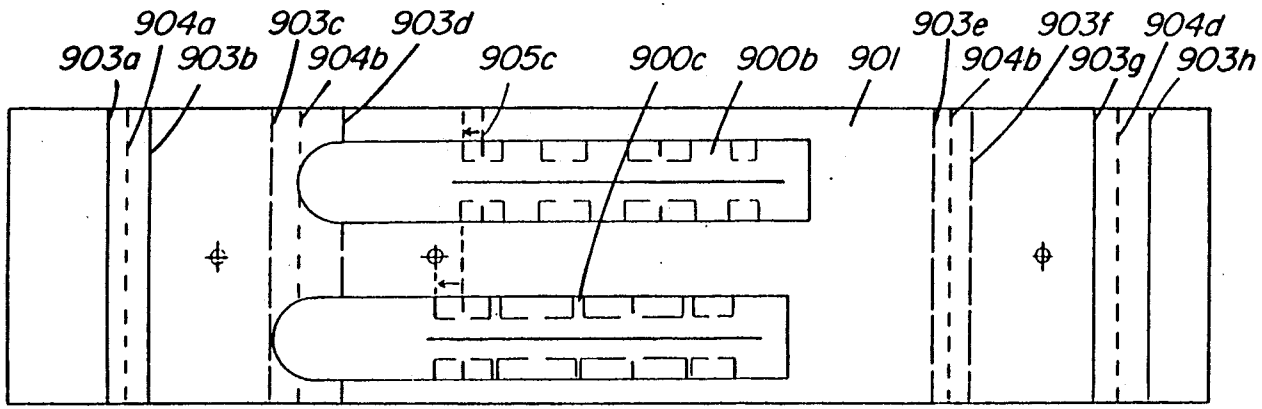
Figure 6O:
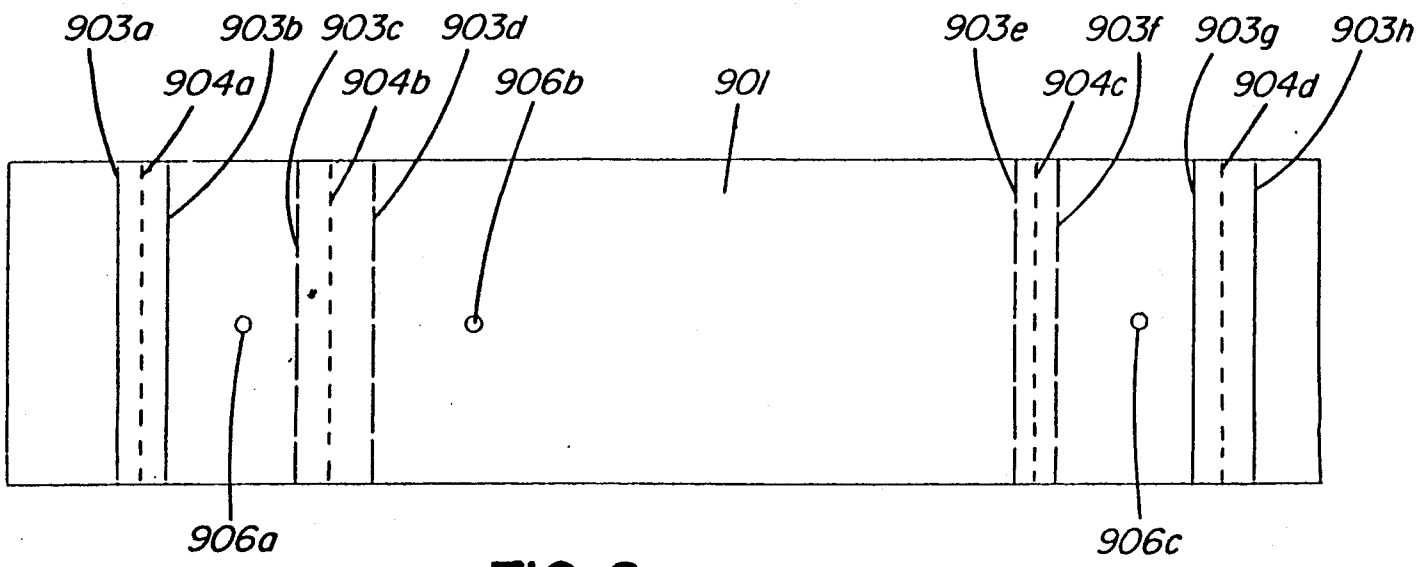

(vi) Description of FIGS. 6*a*–6*o*

FIG. 6*a* shows the "hat" flange, and FIGS. 6*b*–6*o* show the steps used in the marked off of the bends necessary to provide the "hat" flange 901 having a first 3/16— radius bend [R(53)=3/16"], a second 5/16" radius bend [R(53)=5/16"], a third 5/32" radius bend [R(53)=5/32"], a fourth ¼" radius bend [R(53)=¼"], a first ⅛" diameter hole spaced between the first and second bends at ¾" from the outside edge of the first bend, a second ⅛" diameter hole located between the second and third bends at 1 1/16" from the outside edge of the second bend, and a third ⅛" diameter hole located between the third and fourth bends at 11/16" from the outside edge of the fourth bend, all holes being along the centre line of a 2½" wide piece of sheet metal having a thickness (T) of 0.050", a given height (19) of 1½" and a given length (20) of 5". The final product is shown in FIG. 90*a*, and the steps involved are shown in FIGS. 6*b*–6*o*.

(1) The shear cut size 902 is determined by subtracting one MD (23) per bend from the total length 902*a* of 1½"+1½"+5"+¾"+1"=9¾". For sheet metal of thickness 0.050" using the selected 90° bend rulers, the MD for 3/16"R=0.145", the MD for 5/16"R=0.198", the MD for 5/32"R=0.132" and the MD for ¼"R=0.172 " for a total of 0.647". Instead of using four rulers consecutive, a ruler which had a value of approximately 0.647, i.e. a value of 0.644 was selected, such ruler 900*a* being one which was for a thickness (T) of 0.080" and a radius of ⅜", such value of 0.644" being formed under BA. This is determined in FIG. 6*b* using the 0.644" BA value of this 90° bend layout ruler 900*a* of this invention designed for a thickness of 0.080" and a radius of ⅜".

(2) The first bend tangent line 903*a* of the first bend is determined by subtracting one SB(21) from the given length (19) of 1". This is determined as shown in FIG. 6*c*, using a 90° bend layout ruler 900*b* for a thickness of 0.050" and a radius of 3/16".

(3) The second bend tangent line 903*b* of the first bend is determined by adding one BA (22) to the first bend tangent line 903*a*. This is determined as shown in FIG. 6*d*, using the same 90° bend layout ruler 900*b*.

(4) The first bend tangent line 903*c* of the second bend is determined by subtracting two SB from the given height of 1½" from the second bend tangent line 903*b* of the first bend. The SB for the 3/16" radius bend is determined as shown in FIG. 6*e* using the same 90° bend layout radius 900*b*. The SB for the 5/16" radius bend is determined also as shown in FIG. 90*e* using a 90° bend layout ruler 900*c* for a thickness (T) of 0.050" and a radius (R) of 5/16". It is to be noted that the marking should be on the reverse side, since this bend is a reverse bend. The reverse marking is shown in FIG. 6*e* as a broken line.

(5) The second bend tangent line 903*d* of the second bend is determined by adding one BA to the first bend tangent line 903*c* of the second bend. This is determined as shown in FIG. 6*f* using the same 90° bend layout ruler 900*c*. This marking, as well, is for a reverse bend, and is shown in broken lines in FIG. 6*f*.

(6) The first bend tangent line 903*e* of the third bend is determined by subtracting two SB's from the given length of 5" from the bend tangent line 903*d*. The SB for the 5/16" radius bend is determined as shown in FIG. 6*g* using the same 90° bend layout ruler 900*c*. The SB for the 5/32" radius bend is determined also as shown in FIG. 6*g* using a 90° bend layout ruler 900*d* for a thickness (T) of 0.050" and a radius (R) of 5/32". It is to be noted that this marking should be on the reverse side, since this bend is a reverse bend. This reverse marking 903*e* is shown in FIG. 90*g* in broken lines.

(7) The second bend tangent line 903*f* of the third bend is determined by adding one BA to the first bend tangent line 903*e* of the third bend. This is determined as shown in FIG. 6*h* using the same 90° bend layout ruler 900*d*. This marking, 903*f* as well, is for a reverse bend, shown in FIG. 6*h* in broken lines.

(8) The first bend tangent line 903*g* of the fourth bend is determined by subtracting two SB's from the given height of 1½" from the second bend tangent line 903*f* of the third bend. The SB for the 5/32" radius bend is determined as shown in FIG. 6*i* using the same 90° bend layout ruler 900*d*. The SB for the ¼" radius bend is determined as shown in FIG. 6*i* using a 90° bend layout ruler 900*e* for a thickness (T) of 0.050" and a radius (R) of ¼".

(9) The second bend tangent line 903*h* of the fourth bend is determined by adding one BA to the first bend tangent line 903*g* of the fourth bend. This is determined as shown in FIG. 6*j* using the same 90° bend layout ruler 900*e*.

(10) The brake or sight lines, 904*a* and 904*d*, for the first and fourth bends are then drawn in. As noted hereinbefore, the brake or sight line is the mark on a flat layout which serves as a guide while bending. Brake or sight line 904*a* of the first bend which is to be inserted under the nose of the brake is located one 3/16" bend radius R, (18) back from the second bend tangent line 903*b* of the first bend. The marking of the brake or sight line 904*a* is determined as shown in FIG. 6*k* using the same 90° bend layout ruler 900*b* previously used. The brake or sight line 904*d* of the fourth bend which is to be inserted under the nose of the brake is located one ¼" R (18) back from the second bend tangent line 903*h* of the fourth bend. The marking of this brake or sight line 904*d* is determined as shown in FIG. 6*k*, using the same 90° bend layout ruler 900*e* previously used.

(11) The reverse brake or sight lines 904*b* of the second bend and 904*c* of the third bend are then drawn in on the reverse side. The brake or sight line 904*b* which is to be inserted under the nose of the brake is located one 5/16" bend radius R(18) back from the second bend tangent line 903*d* of the second bend. The marking of the brake or sight line 904*b* is determined, as shown in FIG. 6*l*, using the same 90° bend layout ruler 900*c* used previously. The brake or sight line 904*c* which is to be inserted under the nose of the brake is located one 5/32" bend radius R(18) back from the second bend tangent line 903*f* of the third bend. The marking of the brake or sight line 904*c* is determined as shown in FIG. 6*l*, using the same 90° bend layout ruler 900*d* used previously.

(12) The position of the left hand and right hand holes, i.e. the one between the first and second bends, and the third and fourth bends are then determined. The left hand hole is positioned from two outside dimensions minus one MD, i.e. (1"+¾"=1¾") minus one 3/16" radius MD. The location of this hole is marked on the centerline by subtracting one MD from the outside dimension line. This is determined, as shown in FIG. 6*m*, using the same 90° bend layout ruler 900*b* used previously. The right hand hole is positioned from two outside dimensions minus one MD, i.e. (¾"+11/16"=13/16") minus one ¼" radius MD. The location of this hole is marked on the centerline by subtracting one MD from the outside dimensions line. This is determined, as shown in FIG. 6*m*, using the same 90° bend tangent ruler 900*e* used previously.

(b 13) The position of the hole on the top of the hat section, i.e. the hole between the second and third bends is now determined. This is determined by subtracting two MD's from the outside dimensions. The outside dimension is 1"+1½"+1 1/16"=3 9/16" and accordingly the hole is situated 3 9/16" from the left hand side minus one MD for the 3/16" radius bend and one MD for the 5/16" radius bend. This is determined, as shown in FIG. 6*n*, by subtracting one MD from the outside dimension line 905*c* using the same 90° bend layout ruler 900*b* previously used, and then further subtracting therefrom one MD using the same 90° bend layout ruler 900*c* previously used.

(14) The holes 900*a*, 906*b* and 906*c* marked as above are to be drilled or punched before bending, since it is not always possible to drill after bending. Also a large diameter hole should be punched, since the metal may be too thin for drilling. For the bending operation, the left hand side of the sheet metal is then bent four times using the drawn-in brake or sight lines 904*a*, 904*b*, 904*c* and 904*d* as a guide as previously described. The first bend upwardly is made using brake or sight line 904*a* as a guide. The sheet metal 901 is then turned over. The second bend upwardly is made using brake or sight line 904*b* as a guide. The third bend upwardly is made using brake or sight line 904*c* as a guide. The sheet metal 901 is then turned over again and the fourth bend upwardly is made using the brake or sight line 904*d* as a guide.

(vii) Description of FIGS. *7a–7j*

FIG. *7a* shows the final box-type flange having a notch cut out of one end and FIGS. *7b–7j* show the laying out and bending of the box-type flange having a notch cut out of one end. It is seen that the final product is an open ended box of sheet metal having thickness (T) of 0.040" and dimensions of 4"×2⅛" and flanges ¾" high, and a notch ¾" wide, which extends ⅜" into the floor. The walls are all bent at a 3/16" radius. In the flanges box there is a 5/32" diameter hole located at 1⅛" from the front and 1 3/16" from the outside left hand wall. The steps in its production are as follows:

(1) To determine the overall length, it is necessary to add the length of the floor plus the height of the walls, i.e., ¾"+4"+¾"=5½". The shear cut length 911*a* is determined by subtracting two MD's (23) from the total length *7b* of 5½". This is determined, as shown in FIG. 91*b*, using a 90° bend layout ruler 912*a* of this invention designed for a thickness of 0.040" and a radius of 3/16". To determine the overall width, it is necessary to add the width of the floor plus the height of the back wall, i.e. 2⅛"+¾"=2⅞". The shear cut width 911*c* is determined by subtracting one MD (23) from the total width 911*d* of 2⅞". This is determined as shown in FIG. *7b* using the same 90° bend layout ruler 912*a* of this invention designed for a thickness of 0.040" and a radius of 3/16".

(2) To determine the dimensions of the two corner notches, it is necessary to subtract one MD from the total of the given height plus the thickness (T) as a given length, i.e. ¾"+0.040". The dimension 911*e* of the corner square notch is thus determined by subtracting one MD (23) from the total dimension 901*f* of ¾"+0.040". Note that the thickness of 0.040" can best be marked off by means of using the thickness of a piece of scrap metal. This measurement is determined as shown in FIG. *7c* using the same 90° bend layout ruler 912*a* of this invention designed for a thickness of 0.04" and a radius of 3/16". Because the notch at the right hand side is identical to the notch at the left hand side, once the dimensions of the left hand notch are determined, as described above, those dimensions are merely transferred to the right hand notch.

(3) To determine the width position of the back flange notch it is necessary first to determine the "start" point. The position of the "start" point 911*g* is determined by subtracting one MD (23) from the given length 911*h* of ¾"+1⅜"=2⅛". To this start point 911*g*, is added the width of the notch, ¾", to determine, the "end" point 911*i*. This is determined as shown in FIG. 91*d*, using the same 90° bend layout ruler 912*a* of this invention designed for a thickness of 0.040" and a radius of 3/16".

(4) To determine the depth position of the back flange notch it is necessary to subtract one MD from the total of the given height plus the given depth. The position of the depth "end" point 911*j* is determined by subtracting one MD (23) from the total dimension 911*k* of ¾"+⅜"=1⅛". This is determined as shown in FIG. *7e* using the same 90° bend layout ruler 912*a* designed for a thickness of 0.040" and a radius of 3/16".

(5) It is possible to determine the position of the hole 913*a* either from the left hand side or from the right hand side. Using either, the position of the centre of the hole is determined by given height plus given length minus one MD. From the left hand side, the centre point 911*l* is determined by subtracting one MD from the total 911*m* of ¾"+1 3/16"=1 15/16". From the right hand side, the centre point 911*l* is determined by subtracting one MD from the total 911*n* of ¾"+2 13/16"=3 9/16". This is determined, as shown in FIG. *7f* using the same 90° bend layout ruler 912*a* designed for a thickness of 0.040" and a radius of 3/16". It is observed that the centre point 911*l* is coincident whether determined from the right hand side or the left hand side. This is true because of the congruency of the formula: 2SB−1BA=1 MD.

(6) The first bend tangent line 911*o* is determined by subtracting one SB(21) from the given height 901*p* of ¾". This is determined as shown in FIG. *7g*, using the same 90° bend layout ruler 912*a* designed for a thickness of 0.040" and a radius of 3/16". Because all the flanges (walls) are identical, once the first bend tangent line 911*o* is determined as described above, the first bend tangent lines 901*o* for the other two sides is merely transferred.

(7) One second bend tangent line 911*q* is determined by adding one BA (22) to the first bend tangent line 911*o*. This is demonstrated as shown in FIG. *7h*, using the same 90° bend layout ruler 912*a* designed for a thickness of 0.040" and a radius of 3/16". Because all of the flanges (sides) are identical, once one second bend tangent line 911*q* is determined as described above, the other second bend tangent lines 911*q* for the other two sides is merely transferred.

(8) The brake or sight lines 911*r* are then drawn in. The brake or sight line 911*r*, which is to be inserted under the nose of the brake, is located one 3/16" bend radius R, (18) back from the second bend tangent line 911*q*. The marking-off of the brake or sight line is shown in FIG. *7i*, using the same 90° bend layout ruler 912*a* designed for a thickness of 0.040" and a radius of 3/16".

(9) The finished flat layout is shown in FIG. *7j*. To prevent tearing or cracking of material, it is necessary to drill or punch bend relief holes 913*a*, 913*b* at the intersection of the brake or sight lines 911*r*. As a general rule, the diameter of the holes 913*a*, 913*b* is approximately 3 times the sheet metal thickness.

Figure 7A:
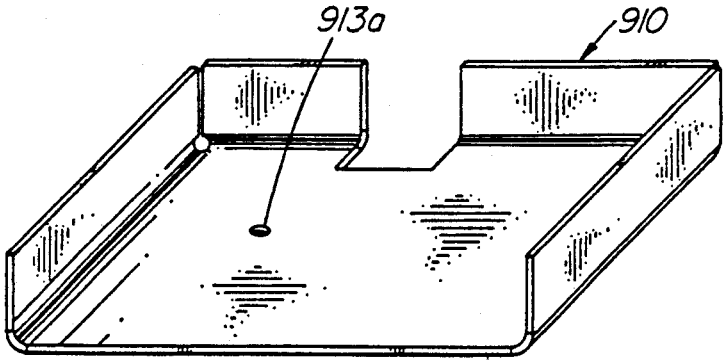
FIGS. 7*b*–7*j*** are plan views showing steps in the laying out of the lines to provide the notched box flange from a piece of sheet metal shown in FIG. 7*a*, using the layout rulers of another embodiment of the present invention.
Figure 7B:
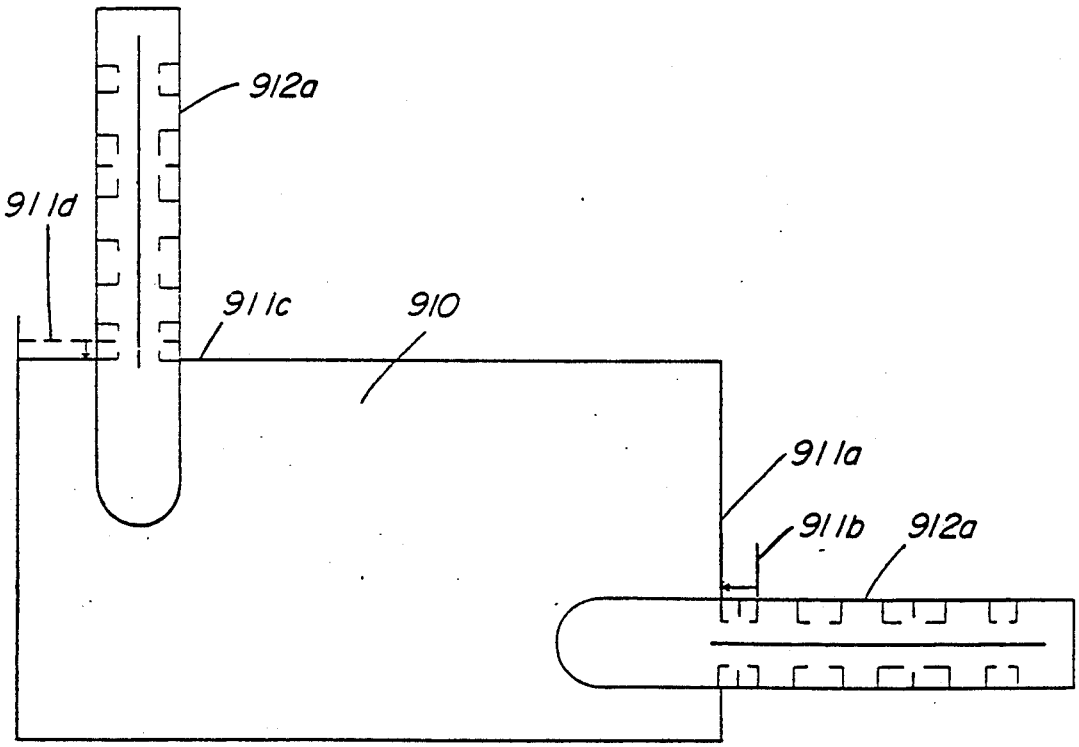
Figure 7C:
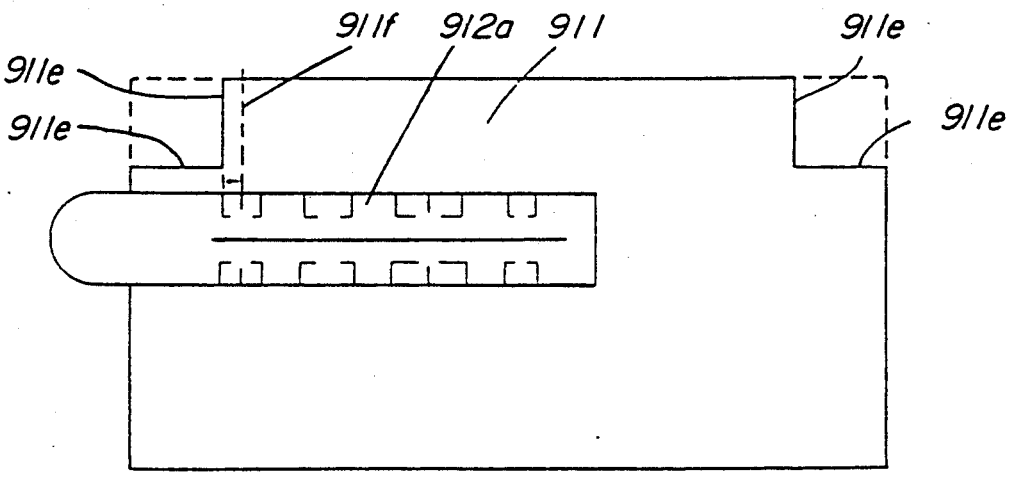
Figure 7D:
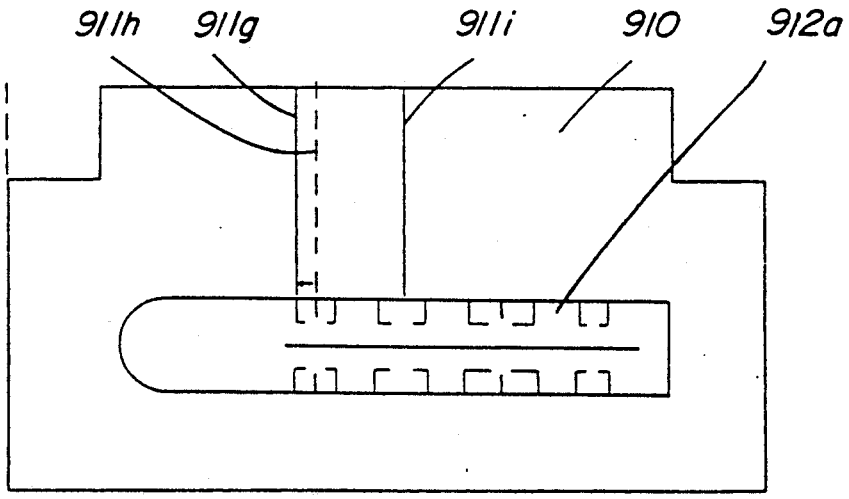
Figure 7E:
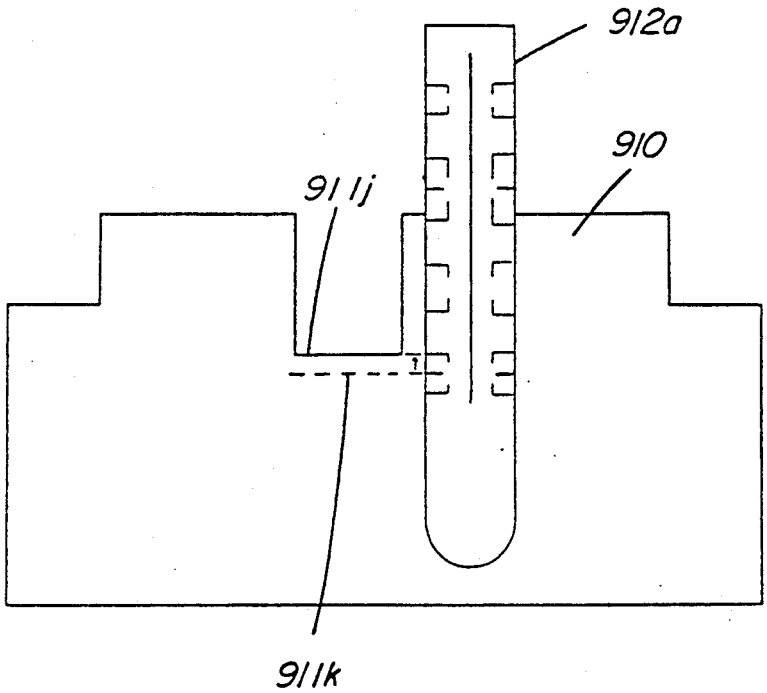
Figure 7F:
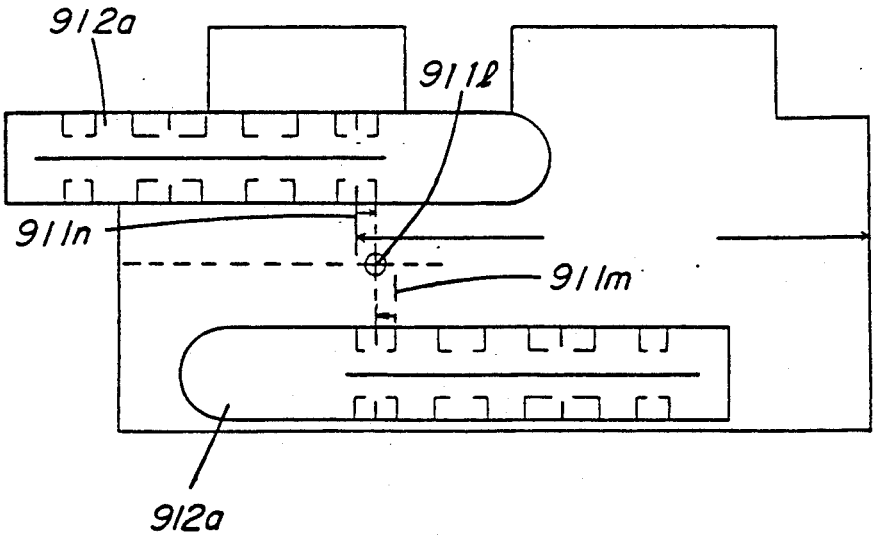
Figure 7G:
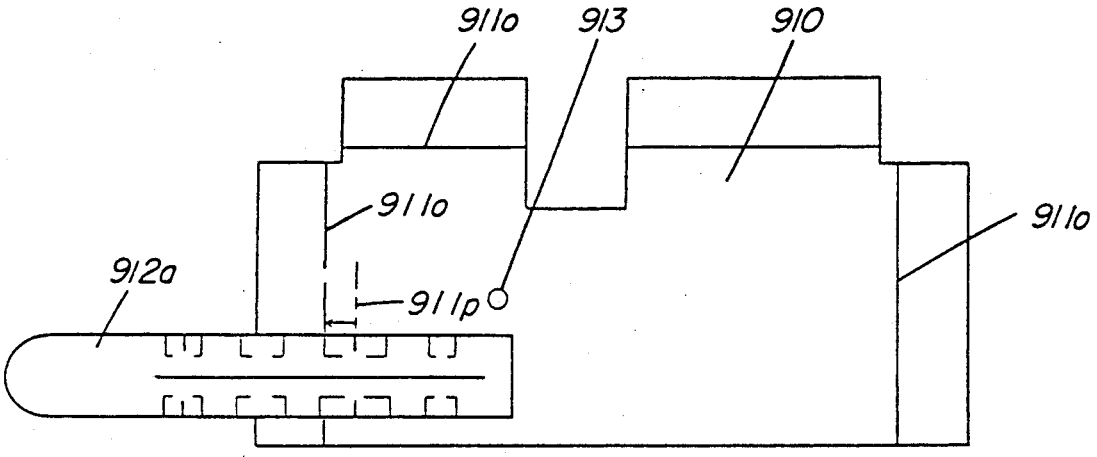
Figure 7H:
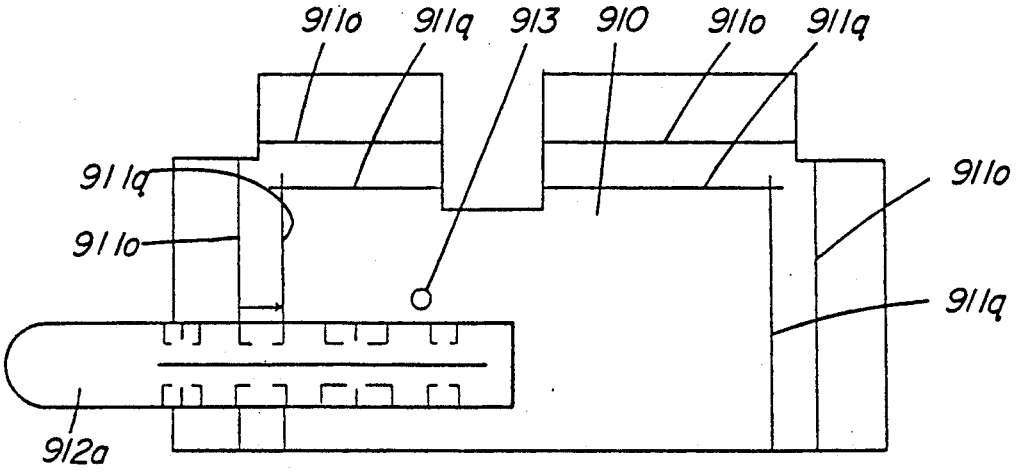
Figure 7I:
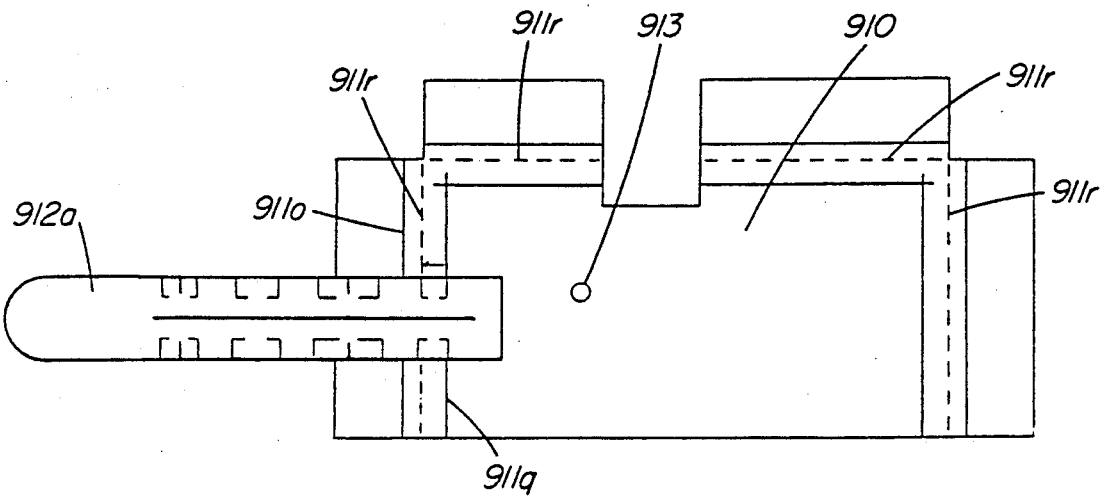
Figure 7J:
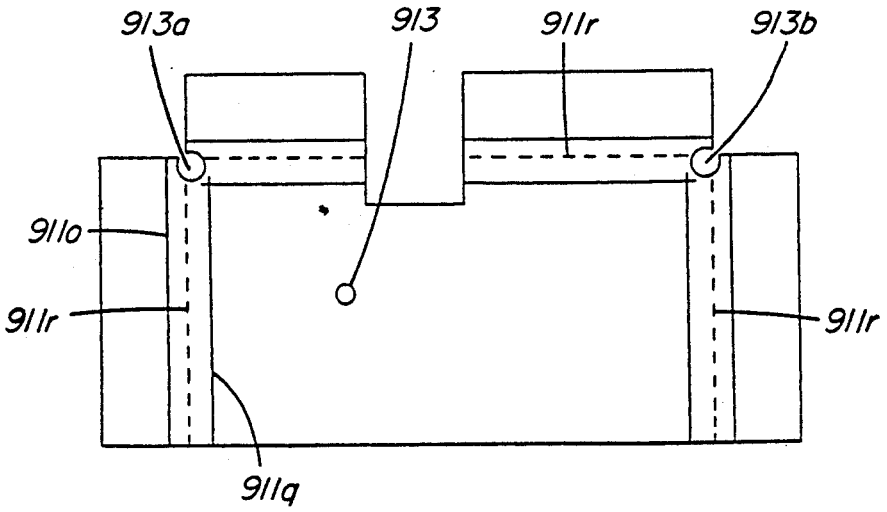

(10) The left hand side of the sheet metal as shown in FIG. 7*j*, is then bent, using the drawn-in brake or sight lines 911*r* consecutively as a guide. The bending is performed as was previously shown in FIG. 7*g*. FIG. 7*g* shows the location of the brake or sight line 885 in relation to the nose 886 of the brake 887. When bending, the brake or sight line 885 is disposed so that it is even with the nose 886 of the brake 887.

(viii) Description of the FIGS. 8–10

FIGS. 8–10 show the determination of the layout procedure for bends of more or less than 90°, and combinations of bends, all using 90° bend layout rulers of this invention. However, to use these 90° bend layout rulers of this invention for this purpose, it is necessary to use a slide rule-type calculator including instructional matter on each of the front and rear faces thereof, along with slide charts used to calculate the bend allowance for material thicknesses of 0.010"–0.250", and slide chart used to calculate the set backs and the material deducting for material thicknesses of 0.010"–0.250". This slide rule type calculator is used in conjunction with the 90° bend rulers of this invention to bends of more or less than 90°.

The front face of the envelope of the slide rule-type calculator referred to above has instructions and diagrams thereon. It includes a horizontal thickness indicating window and vertical bend allowance-indicating windows. As seen below in Table 1, the instructions which would appear on the front face of the slide rule-type calculator are as follows:

TABLE 1

METAL WORKER'S MASTER BEND CALCULATOR INSTRUCTIONS
WITH THIS RULER FOLLOW THROUGH THE STEPS BELOW USING (3/16) INSIDE RADIUS & (.080) MATERIAL THICKNESS

BA OTHER THAN 90°:

REFER TO COLUMN (A) AND MULTIPLY BY NO. OF DEGREES DESIRED
EXAMPLE FOR 45°:
(1° × 45) = (.00389 × 45) = BA FOR 45° = .175

SB OTHER THAN 90°:

REFER TO COLUMN (C) AND MULTIPLY BY THE (K) VALUE OF ANGLE DESIRED FROM CHART (C-1)
EXAMPLE FOR 45°:
FORMULA
(SB × K VALUE)
(.267) × .41421 = SB FOR 45° = .111

MD OTHER THAN 90°:

TABLE 1-continued

METAL WORKER'S MASTER BEND CALCULATOR INSTRUCTIONS
WITH THIS RULER FOLLOW THROUGH THE STEPS BELOW USING (3/16) INSIDE RADIUS & (.080) MATERIAL THICKNESS

EXAMPLE FOR 45°:
FORMULA:
(SB FOR 45° × 2) − (BA FOR 45°)
(.111 × .2) − (/175) − MD FOR 45° = .047

*NOTE: (MD) CAN ALSO BE USED TO DETERMINE THE EXACT POSITION OF A HOLE OR A CUT-OUT LINE BEFORE BENDING. BY SUBSTRACTING ONE (MD) PER BEND FROM THE GIVEN HEIGHT AND LENGTH TO THE HOLE OR CUT-OUT LINE.
*THE EMPIRICAL (BA) FORMULA IS ACCURATELY EQUIVALENT TO:

$$\frac{2\pi\,(R + (.445 \times T)\ \text{NO. DEGREES}}{360}$$

The bend allowance indicating windows provide numerical values corresponding to the inside radii as set forth below in Table 2

TABLE 2

| (INSIDE RADIUS) | |
|---|---|
| (.3312) | 1/32 |
| (.0625) | 1/16 |
| (.0937) | 3/32 |
| (.1250) | ⅛ |
| (.1562) | 5/32 |
| (.1875) | 3/16 |
| (.2187) | 7/32 |
| (.2500) | ¼ |
| (.2812) | 9/32 |
| (.3125) | 5/16 |
| (.3437) | 11/32 |
| (.3750) | ⅜ |
| (.4062) | 13/32 |
| (.4375) | 7/16 |
| (.4687) | 16/32 |
| (.5000) | ½ |
| (.5312) | 17/32 |
| (.5625) | 9/16 |
| (.5937) | 19/32 |
| (.6250) | ⅝ |
| (.6562) | 21/32 |
| (.6875) | 11/16 |
| (.7187) | 23/32 |
| (.7500) | ¾ |

The rear face of the slide rule calculator of the envelope includes a pair of tables, namely a set back table or (K) chart and an aluminum alloy minimum bend radius table.

The set back table for set-backs other than 90°, which are obtained by multiplying the (K) value for the decimal angles is set out below in Table 3

TABLE 3

SET BACK TABLE (K) CHART

| A° | (K) | A° | (K) | A° | (K) | A° | (K) | A° | (K) | A° | (K) |
|---|---|---|---|---|---|---|---|---|---|---|---|
| 1° | .00873 | 31° | .27732 | 61° | .58904 | 91° | 1.0176 | 121° | 1.7675 | 151° | 3.8667 |
| 2° | .01745 | 32° | .28674 | 62° | .60086 | 92° | 1.0355 | 122° | 1.8000 | 152° | 4.0108 |
| 3° | .02618 | 33° | .29621 | 63° | .61280 | 93° | 1.0538 | 123° | 1.8418 | 153° | 4.1653 |
| 4° | .03492 | 34° | .30573 | 64° | .62487 | 94° | 1.0724 | 124° | 1.8817 | 154° | 4.3315 |
| 5° | .04366 | 35° | .31530 | 65° | .63707 | 95° | 1.0913 | 125° | 1.9211 | 155° | 4.5107 |
| 6° | .05141 | 36° | .32492 | 66° | .64941 | 96° | 1.1106 | 126° | 1.9626 | 156° | 4.7046 |
| 7° | .06116 | 37° | .33459 | 67° | .66188 | 97° | 1.1303 | 127° | 2.0057 | 157° | 4.9151 |
| 8° | .06993 | 38° | .34433 | 68° | .67451 | 98° | 1.1504 | 128° | 2.0503 | 158° | 5.1455 |
| 9° | .07870 | 39° | .35412 | 69° | .68728 | 99° | 1.1708 | 129° | 2.0965 | 159° | 5.3995 |
| 10° | .08749 | 40° | .36397 | 70° | .70021 | 100° | 1.1917 | 130° | 2.1445 | 160° | 5.6713 |
| 11° | .09629 | 41° | .37388 | 71° | .71329 | 101° | 1.2131 | 131° | 2.1943 | 161° | 5.9758 |
| 12° | .10510 | 42° | .38386 | 72° | .72654 | 102° | 1.2909 | 132° | 2.2461 | 162° | 6.3137 |
| 13° | .11393 | 43° | .39391 | 73° | .73996 | 103° | 1.2572 | 133° | 2.2998 | 163° | 6.6911 |
| 14° | .12278 | 44° | .40403 | 74° | .75355 | 104° | 1.2799 | 134° | 2.3558 | 164° | 7.1154 |
| 15° | .13165 | 45° | .41421 | 75° | .76733 | 105° | 1.3032 | 135° | 2/4142 | 165° | 7.5957 |
| 16° | .14054 | 46° | .42447 | 76° | .78128 | 106° | 1.3270 | 136° | 2.4751 | 166° | 8.1443 |
| 17° | .14945 | 47° | .43481 | 77° | .79543 | 107° | 1.3514 | 137° | 2.5386 | 167° | 8.7769 |
| 18° | .15838 | 48° | .44523 | 78° | .80978 | 108° | 1.3760 | 138° | 2.6051 | 168° | 9.5144 |

TABLE 3-continued

| SET BACK TABLE (K) CHART | | | | | | | | | | | |
|---|---|---|---|---|---|---|---|---|---|---|---|
| A° | (K) | A° | (K) | A° | (K) | A° | (K) | A° | (K) | A° | (K) |
| 19° | .16734 | 49° | .44573 | 79° | .82434 | 109° | 1.0019 | 139° | 2.6746 | 169° | 10.345 |
| 20° | .17633 | 50° | .46631 | 80° | .83910 | 110° | 1.0281 | 140° | 2.7475 | 170° | 11.430 |
| 21° | .18534 | 51° | .47697 | 81° | .85408 | 111° | 1.4550 | 141° | 2.8239 | 171° | 12.706 |
| 22° | .19438 | 52° | .48773 | 82° | .86929 | 112° | 1.4826 | 142° | 2.9042 | 172° | 14.301 |
| 23° | .20345 | 53° | .49858 | 83° | .88472 | 113° | 1.5108 | 143° | 2.9887 | 173° | 16.350 |
| 24° | .21256 | 54° | .50952 | 84° | .90040 | 114° | 1.5399 | 144° | 3.0777 | 174° | 19.081 |
| 25° | .22169 | 55° | .52057 | 85° | .91633 | 115° | 1.5697 | 145° | 3.1716 | 175° | 22.904 |
| 26° | .23087 | 56° | .53171 | 86° | .93251 | 116° | 1.6003 | 146° | 3.2718 | 176° | 26.636 |
| 27° | .24008 | 57° | .54295 | 87° | .94896 | 117° | 1.6318 | 147° | 3.3759 | 177° | 38.188 |
| 28° | .24933 | 58° | .55431 | 88° | .96569 | 118° | 1.6643 | 148° | 3.4874 | 178° | 57.290 |
| 29° | .25862 | 59° | .56577 | 89° | .98279 | 119° | 1.6977 | 149° | 3.6059 | 179° | 114.59 |
| 30° | .26795 | 60° | .57735 | 90° | 1.000 | 120° | 1.7320 | 150° | 3.7320 | 180° | INFINITE |

The aluminum alloy minimum bend radius table on the rear face of the slide rule type calculator is set out below in Table 4

TABLE 4

| | THICKNESS | | | | | | | | | |
|---|---|---|---|---|---|---|---|---|---|---|
| MATERIAL | .015 | .020 | .025 | .032 | .040 | .050 | .064 | .070 | .090 | .125 |
| 2024-0 | 1/32 | 1/32 | 1/16 | 1/16 | 1/16 | 1/16 | 3/32 | 1/8 | 1/8 | 3/16 |
| 2024-13-14 | 1/16 | 1/16 | 1/16 | 3/32 | 3/32 | 1/8 | 5/32 | 7/32 | 9/32 | 7/16 |
| 5052-0 | 1/32 | 1/32 | 1/32 | 1/16 | 1/16 | 1/16 | 1/16 | 3/32 | 1/8 | 5/32 |
| 5052-H12 | 1/32 | 1/32 | 1/16 | 1/16 | 1/16 | 1/16 | 3/32 | 1/8 | 1/8 | 3/16 |
| 5052-H16 | 1/32 | 1/32 | 1/16 | 1/16 | 1/16 | 3/32 | 3/32 | 1/8 | 3/16 | 1/4 |
| 6061-0 | 1/32 | 1/32 | 1/32 | 1/32 | 1/16 | 1/16 | 1/16 | 3/32 | 3/32 | 5/32 |
| 6161-16 | 1/16 | 1/16 | 1/16 | 1/16 | 3/32 | 3/32 | 1/8 | 1/8 | 3/16 | 9/32 |
| 7075-0 | 1/16 | 1/16 | 1/16 | 1/16 | 1/16 | 3/32 | 3/32 | 5/32 | 1/4 | 11/32 |
| 7075-16 | 1/8 | 1/8 | 1/8 | 1/8 | 3/16 | 1/4 | 5/16 | 3/8 | 1/2 | 3/4 |

The material deduction indicating windows provide numerical values corresponding to the inside radii as set forth below in Table 5

TABLE 5

| (INSIDE RADIUS) | |
|---|---|
| (.031) | 1/32 |
| (.062) | 1/16 |
| (.093) | 3/32 |
| (.125) | 1/8 |
| (.156) | 5/32 |
| (.187) | 3/16 |
| (.218) | 7/32 |
| (.250) | 1/4 |
| (.281) | 9/32 |
| (.312) | 5/16 |
| (.343) | 11/32 |
| (.375) | 3/8 |
| (.406) | 13/32 |
| (.437) | 7/16 |
| (.468) | 15/32 |
| (.500) | 1/2 |
| (.531) | 17/32 |

TABLE 5-continued

| (INSIDE RADIUS) | |
|---|---|
| (.562) | 9/16 |
| (.593) | 19/32 |
| (.625) | 5/8 |
| (.625) | |
| (.656) | 21/32 |
| (.687) | 11/16 |
| (.718) | 23/32 |
| (.750) | 3/4 |

It is noted that the general rule for minimum bend radius of material not shown on the above table 4 is:

1×thickness for the O material

2½×thickness for T4 material

3×thickness for T3 material

More importantly, it includes a horizontal thickness indicating window 929 and vertical windows 930*a* and 903*b* to indicate the set back in column C and the material deduction in column D.

Tables 6, 7, 8, 9, 10 and 11 are Bend Allowance (BA) values for 1° and 90° for different bend radii (vertical) and various thicknesses (T) (horizontal).

TABLE 6

| | | .010 BA | | .015 BA | | .020 BA | | .025 BA | | .030 BA | |
|---|---|---|---|---|---|---|---|---|---|---|---|
| | | 1° | 90° | 1° | 90° | 1° | 90° | 1° | 90° | 1° | 90° |
| 1/32 | .0312 | .00062 | .056 | .00066 | .059 | .00070 | .063 | .00074 | .067 | .00077 | .069 |
| 1/16 | .0625 | .00117 | .105 | .00121 | .109 | .00125 | .113 | .00129 | .116 | .00132 | .119 |
| 3/32 | .0938 | .00171 | .154 | .00175 | .158 | .00179 | .161 | .00183 | .165 | .00186 | .167 |
| 1/8 | .1250 | .00226 | .203 | .00230 | .207 | .00234 | .211 | .00238 | .214 | .00241 | .217 |
| 5/32 | .1562 | .00280 | .252 | .00284 | .256 | .00288 | .259 | .00292 | .263 | .00295 | .266 |
| 3/16 | .1875 | .00335 | .302 | .00339 | .305 | .00343 | .309 | .00347 | .312 | .00350 | .315 |
| 7/32 | .2188 | .00389 | .350 | .00393 | .354 | .00397 | .357 | .00401 | .361 | .00404 | .364 |
| 1/4 | .2500 | .00444 | .400 | .00448 | .403 | .00452 | .407 | .00456 | .410 | .00459 | .413 |
| 9/32 | .2812 | .00498 | .448 | .00502 | .452 | .00506 | .455 | .00510 | .459 | .00513 | .462 |
| 5/16 | .3125 | .00553 | .498 | .00557 | .501 | .00561 | .505 | .00565 | .509 | .00568 | .511 |
| 11/32 | .3438 | .00607 | .546 | .00611 | .550 | .00615 | .554 | .00619 | .557 | .00622 | .560 |
| 3/8 | .3750 | .00662 | .596 | .00666 | .599 | .00670 | .603 | .00674 | .607 | .00677 | .609 |
| 13/32 | .4062 | .00716 | .644 | .00720 | .648 | .00724 | .652 | .00728 | .655 | .00731 | .658 |
| 7/16 | .4375 | .00772 | .694 | .00775 | .698 | .00779 | .701 | .00783 | .705 | .00786 | .707 |
| 15/32 | .4688 | .00825 | .743 | .00829 | .746 | .00833 | .750 | .00837 | .753 | .00840 | .756 |
| 1/2 | .5000 | .00880 | .792 | .00884 | .796 | .00888 | .799 | .00892 | .803 | .00895 | .806 |

TABLE 6-continued

| | | .010 BA | | .015 BA | | .020 BA | | .025 BA | | .030 BA | |
|---|---|---|---|---|---|---|---|---|---|---|---|
| | | 1° | 90° | 1° | 90° | 1° | 90° | 1° | 90° | 1° | 90° |
| 17/32 | .5312 | .00934 | .841 | .00938 | .844 | .00942 | .848 | .00946 | .851 | .00949 | .854 |
| 9/16 | .5625 | .00988 | .889 | .00992 | .893 | .00996 | .896 | .01000 | .900 | .01003 | .903 |
| 19/32 | .5938 | .01043 | .939 | .01047 | .942 | .01051 | .946 | .01055 | .950 | .01058 | .952 |
| 5/8 | .6250 | .01097 | .987 | .01101 | .991 | .01105 | .995 | .01109 | .998 | .01112 | 1.001 |
| 21/32 | .6562 | .01152 | 1.037 | .01156 | 1.040 | .01160 | 1.044 | .01164 | 1.048 | .01167 | 1.050 |
| 11/16 | .6875 | .01206 | 1.085 | .01210 | 1.089 | .01214 | 1.093 | .01218 | 1.096 | .01221 | 1.099 |
| 23/32 | .7188 | .01261 | 1.135 | .01265 | 1.139 | .01269 | 1.142 | .01273 | 1.146 | .01276 | 1.148 |
| 3/4 | .7500 | .01315 | 1.184 | .01319 | 1.187 | .01323 | 1.191 | .01327 | 1.194 | .01330 | 1.197 |
| 13/16 | .8125 | .01424 | 1.282 | .01428 | 1.285 | .01432 | 1.289 | .01436 | 1.292 | .01439 | 1.295 |
| 7/8 | .8750 | .01533 | 1.380 | .01537 | 1.383 | .01541 | 1.387 | .01545 | 1.391 | .01548 | 1.393 |
| 15/16 | .9375 | .01642 | 1.478 | .01646 | 1.481 | .01650 | 1.485 | .01654 | 1.489 | .01657 | 1.491 |
| | 1.000 | .01751 | 1.576 | .01755 | 1.580 | .01759 | 1.583 | .01763 | 1.587 | .01766 | 1.509 |

TABLE 7

| | | .035 BA | | .040 BA | | .045 BA | | .050 BA | | .055 BA | | .060 BA | | .065 BA | |
|---|---|---|---|---|---|---|---|---|---|---|---|---|---|---|---|
| | | 1° | 90° | 1° | 90° | 1° | 90° | 1° | 90° | 1° | 90° | 1° | 90° | 1° | 90° |
| 1/16 | .0625 | .00136 | .122 | .00140 | .126 | .00144 | .130 | .00148 | .133 | .00152 | .137 | .00156 | .140 | | |
| 3/32 | .0938 | .00190 | .171 | .00194 | .175 | .00198 | .178 | .00202 | .162 | .00206 | .185 | .00210 | .189 | .00214 | .193 |
| 1/8 | .1250 | .00245 | .221 | .00249 | .224 | .00253 | .228 | .00257 | .231 | .00261 | .235 | .00265 | .239 | .00269 | .242 |
| 5/32 | .1562 | .00299 | .269 | .00303 | .273 | .00307 | .276 | .00311 | .280 | .00315 | .284 | .00319 | .287 | .00323 | .291 |
| 3/16 | .1875 | .00354 | .319 | .00358 | .322 | .00362 | .326 | .00366 | .329 | .00370 | .333 | .00374 | .337 | .00378 | .340 |
| 7/32 | .2188 | .00408 | .367 | .00412 | .371 | .00416 | .374 | .00420 | .378 | .00424 | .382 | .00428 | .385 | .00432 | .389 |
| 1/4 | .2500 | .00463 | .417 | .00467 | .420 | .00471 | .424 | .00475 | .428 | .00479 | .431 | .00483 | .435 | .00487 | .438 |
| 9/32 | .2812 | .00517 | .465 | .00521 | .469 | .00525 | .473 | .00529 | .476 | .00535 | .480 | .00537 | .483 | .00541 | .487 |
| 5/16 | .3125 | .00572 | .515 | .00576 | .516 | .00580 | .522 | .00584 | .526 | .00588 | .529 | .00592 | .533 | .00596 | .536 |
| 11/32 | .3438 | .00626 | .563 | .00630 | .567 | .00634 | .571 | .00638 | .574 | .00642 | .578 | .00646 | .581 | .00650 | .585 |
| 3/8 | .3750 | .00681 | .613 | .00685 | .617 | .00689 | .620 | .00693 | .624 | .00697 | .627 | .00701 | .631 | .00705 | .635 |
| 13/32 | .4062 | .00735 | .662 | .00739 | .665 | .00743 | .669 | .00747 | .672 | .00751 | .676 | .00755 | .680 | .00759 | .683 |
| 7/16 | .4375 | .00790 | .711 | .00794 | .715 | .00798 | .718 | .00802 | .722 | .00806 | .725 | .00810 | .729 | .00814 | .733 |
| 15/32 | .4688 | .00844 | .760 | .00848 | .763 | .00852 | .767 | .00856 | .770 | .00860 | .774 | .00864 | .778 | .00868 | .781 |
| 1/2 | .5000 | .00899 | .809 | .00903 | .813 | .00907 | .816 | .00911 | .820 | .00915 | .824 | .00919 | .827 | .00923 | .831 |
| 17/32 | .5312 | .00953 | .858 | .00957 | .861 | .00961 | .865 | .00965 | .869 | .00969 | .872 | .00973 | .876 | .00977 | .879 |
| 9/16 | .5625 | .01007 | .906 | .01011 | .910 | .01015 | .914 | .01019 | .917 | .01023 | .921 | .01027 | .924 | .01031 | .928 |
| 19/32 | .5938 | .01062 | .956 | .01066 | .959 | .01070 | .963 | .01074 | .967 | .01078 | .970 | .01082 | .974 | .01086 | .977 |
| 5/8 | .6250 | .01116 | 1.004 | .01120 | 1.008 | .01124 | 1.012 | .01128 | 1.015 | .01132 | 1.019 | .01136 | 1.022 | .01140 | 1.028 |
| 21/32 | .6562 | .01171 | 1.054 | .01175 | 1.058 | .01179 | 1.061 | .01183 | 1.065 | .01187 | 1.068 | .01191 | 1.072 | .01195 | 1.076 |
| 11/16 | .6875 | .01225 | 1.103 | .01229 | 1.106 | .01233 | 1.110 | .01237 | 1.113 | .01241 | 1.117 | .01245 | 1.121 | .01249 | 1.124 |
| 23/32 | .7188 | .01280 | 1.152 | .01284 | 1.156 | .01288 | 1.159 | .01292 | 1.163 | .01296 | 1.166 | .01300 | 1.170 | .01304 | 1.174 |
| 3/4 | .7500 | .01334 | 1.201 | .01338 | 1.204 | .01342 | 1.208 | .01346 | 1.211 | .01350 | 1.215 | .01354 | 1.219 | .01358 | 1.222 |
| 13/16 | .8125 | .01443 | 1.299 | .01447 | 1.302 | .01451 | 1.306 | .01455 | 1.310 | .01459 | 1.313 | .01463 | 1.317 | .01467 | 1.320 |
| 7/8 | .8750 | .01552 | 1.397 | .01556 | 1.400 | .01560 | 1.404 | 0.1564 | 1.408 | .01568 | 1.411 | .01572 | 1.415 | .01576 | 1.418 |
| 15/16 | .9375 | .01661 | 1.495 | .01665 | 1.499 | .01669 | 1.502 | .01673 | 1.508 | .01677 | 1.509 | .01681 | 1.513 | .01685 | 1.517 |
| | 1.000 | .01770 | 1.593 | .01774 | 1.597 | .01778 | 1.600 | .01782 | 1.608 | .01786 | 1.607 | .01790 | 1.611 | .01794 | 1.615 |

TABLE 8

| | | .070 BA | | .075 BA | | .080 BA | | .085 BA | | .090 BA | | .095 BA | | .100 BA | |
|---|---|---|---|---|---|---|---|---|---|---|---|---|---|---|---|
| | | 1° | 90° | 1° | 90° | 1° | 90° | 1° | 90° | 1° | 90° | 1° | 90° | 1° | 90° |
| 3/32 | .0938 | .00218 | .196 | .00222 | .200 | .00225 | .203 | .00229 | .206 | .00233 | .210 | | | | |
| 1/8 | .1250 | .00273 | .246 | .00277 | .249 | .00280 | .252 | .00284 | .256 | .00288 | .259 | .00292 | .263 | .00296 | .266 |
| 5/32 | .1562 | .00327 | .294 | .00331 | .298 | .00334 | .301 | .00338 | .304 | .00342 | .308 | .00346 | .311 | .00350 | .315 |
| 3/16 | .1875 | .00382 | .349 | .00386 | .347 | .00389 | .350 | .00393 | .354 | .00397 | .357 | .00401 | .361 | .00405 | .365 |
| 7/32 | .2188 | .00436 | .392 | .00440 | .396 | .00443 | .399 | .00447 | .402 | .00451 | .406 | .00455 | .410 | .00459 | .413 |
| 1/4 | .2500 | .00491 | .442 | .00495 | .446 | .00498 | .448 | .00502 | .452 | .00506 | .455 | .00510 | .459 | .00514 | .463 |
| 9/32 | .2812 | .00545 | .491 | .00549 | .494 | .00552 | .497 | .00556 | .500 | .00560 | .504 | .00564 | .508 | .00568 | .511 |
| 5/16 | .3125 | .00600 | .540 | .00604 | .544 | .00607 | .545 | .00611 | .550 | .00615 | .554 | .00619 | .557 | .00623 | .561 |
| 11/32 | .3438 | .00654 | .589 | .00658 | .592 | .00661 | .595 | .00665 | .599 | .00669 | .602 | .00673 | .606 | .00677 | .609 |
| 3/8 | .3750 | .00709 | .638 | .00713 | .642 | .00716 | .644 | .00720 | .648 | .00724 | .652 | .00728 | .655 | .00732 | .659 |
| 13/32 | .4062 | .00763 | .687 | .00767 | .690 | .00770 | .693 | .00774 | .697 | .00778 | .700 | .00782 | .704 | .00786 | .707 |
| 7/16 | .4375 | .00818 | .736 | .00822 | .740 | .00825 | .743 | .00829 | .746 | .00833 | .750 | .00837 | .753 | .00841 | .757 |
| 15/32 | .4688 | .00872 | .785 | .00876 | .788 | .00879 | .791 | .00883 | .795 | .00887 | .798 | .00891 | .802 | .00895 | .806 |
| 1/2 | .5000 | .00927 | .834 | .00931 | .838 | .00934 | .841 | .00938 | .844 | .00942 | .848 | .00946 | .851 | .00950 | .855 |
| 17/32 | .5312 | .00981 | .883 | .00985 | .887 | .00988 | .889 | .00992 | .893 | .00996 | .896 | .01000 | .900 | .01004 | .904 |
| 9/16 | .5625 | .01035 | .932 | .01039 | .935 | .01042 | .938 | .01046 | .941 | .01050 | .945 | .01054 | .949 | .01058 | .952 |
| 19/32 | .5938 | .01090 | .981 | .01094 | .985 | .01097 | .987 | .01101 | .991 | .01105 | .995 | .01109 | .998 | .01113 | 1.002 |
| 5/8 | .6250 | .01144 | 1.030 | .01148 | 1.033 | .01151 | 1.036 | .01155 | 1.040 | .01159 | 1.043 | .01163 | 1.047 | .01167 | 1.050 |
| 21/32 | .6562 | .01199 | 1.079 | .01203 | 1.083 | .01206 | 1.085 | .01210 | 1.089 | .01214 | 1.093 | .01218 | 1.096 | .01222 | 1.100 |
| 11/16 | .6875 | .01253 | 1.128 | .01257 | 1.131 | .01260 | 1.134 | .01264 | 1.138 | .01268 | 1.141 | .01272 | 1.145 | .01276 | 1.148 |
| 23/32 | .7188 | .01308 | 1.177 | .01312 | 1.181 | .01315 | 1.184 | .01319 | 1.187 | .01323 | 1.191 | .01327 | 1.194 | .01331 | 1.198 |
| 3/4 | .7500 | .01362 | 1.226 | .01366 | 1.229 | .01369 | 1.232 | .01373 | 1.236 | .01377 | 1.239 | .01381 | 1.243 | .01385 | 1.257 |
| 13/16 | .8125 | .01471 | 1.324 | .01475 | 1.328 | .01478 | 1.330 | .01482 | 1.334 | .01486 | 1.337 | .01490 | 1.341 | .01494 | 1.345 |
| 7/8 | .8750 | .01580 | 1.422 | .01584 | 1.426 | .01587 | 1.428 | .01591 | 1.432 | .01595 | 1.436 | .01599 | 1.439 | .01603 | 1.448 |

TABLE 8-continued

| | | .070 BA | | .075 BA | | .080 BA | | .085 BA | | .090 BA | | .095 BA | | .100 BA | |
|---|---|---|---|---|---|---|---|---|---|---|---|---|---|---|---|
| | | 1° | 90° | 1° | 90° | 1° | 90° | 1° | 90° | 1° | 90° | 1° | 90° | 1° | 90° |
| 15/16 | .9375 | .01689 | 1.520 | .01693 | 1.524 | .01696 | 1.526 | .01700 | 1.530 | .01704 | 1.534 | .01708 | 1.537 | .01712 | 1.541 |
| | 1.000 | .01798 | 1.618 | .01802 | 1.622 | .01805 | 1.625 | .01809 | 1.628 | .01813 | 1.632 | .01817 | 1.635 | .01821 | 1.639 |

TABLE 9

| | | .105 BA | | .110 BA | | .115 BA | | .120 BA | | .125 BA | | .130 BA | |
|---|---|---|---|---|---|---|---|---|---|---|---|---|---|
| | | 1° | 90° | 1° | 90° | 1° | 90° | 1° | 90° | 1° | 90° | 1° | 90° |
| 1/32 | .0312 | .00136 | .122 | .00140 | .126 | .00144 | .130 | .00148 | .133 | .00152 | .137 | .00155 | .140 |
| 1/16 | .0625 | .00191 | .172 | .00195 | .176 | .00199 | .179 | .00203 | .183 | .00207 | .186 | .00210 | .189 |
| 3/32 | .0938 | .00245 | .221 | .00249 | .224 | .00253 | .228 | .00237 | .231 | .00261 | .235 | .00264 | .235 |
| 1/8 | .1250 | .00300 | .270 | .00304 | .274 | .00308 | .277 | .00312 | .281 | .00316 | .284 | .00319 | .289 |
| 5/32 | .1562 | .00354 | .319 | .00358 | .322 | .00362 | .326 | .00366 | .329 | .00370 | .333 | .00375 | .336 |
| 3/16 | .1875 | .00409 | .368 | .00413 | .372 | .00417 | .375 | .00421 | .379 | .00425 | .383 | .00428 | .385 |
| 7/32 | .2188 | .00413 | .417 | .00467 | .420 | .00471 | .424 | .00475 | .428 | .00479 | .431 | .00482 | .434 |
| 1/4 | .2500 | .00518 | .466 | .00522 | .470 | .00526 | .473 | .00530 | .477 | .00534 | .481 | .00537 | .483 |
| 9/32 | .2812 | .00572 | .515 | .00576 | .518 | .00590 | .522 | .00584 | .526 | .00588 | .529 | .00591 | .532 |
| 5/16 | .3125 | .00627 | .564 | .00631 | .568 | .00635 | .572 | .00639 | .575 | .00643 | .579 | .00646 | .581 |
| 11/32 | .3438 | .00681 | .613 | .00685 | .617 | .00689 | .620 | .00693 | .624 | .00697 | .627 | .00700 | .630 |
| 3/8 | .3750 | .00736 | .662 | .00740 | .666 | .00744 | .670 | .00748 | .673 | .00752 | .677 | .00755 | .680 |
| 13/32 | .4062 | .00790 | .711 | .00794 | .715 | .00798 | .718 | .00802 | .722 | .00806 | .725 | .00809 | .728 |
| 7/16 | .4375 | .00845 | .761 | .00849 | .764 | .00853 | .768 | .00857 | .771 | .00861 | .775 | .00864 | .778 |
| 15/32 | .4688 | .00899 | .809 | .00903 | .813 | .00907 | .816 | .00911 | .820 | .00915 | .824 | .00918 | .826 |
| 1/2 | .5000 | .00954 | .859 | .00958 | .862 | .00962 | .866 | .00966 | .869 | .00970 | .873 | .00973 | .876 |
| 17/32 | .5312 | .01008 | .907 | .01012 | .911 | .01016 | .914 | .01020 | .918 | .01024 | .922 | .01027 | .924 |
| 9/16 | .5625 | .01062 | .956 | .01066 | .959 | .01070 | .963 | .01074 | .967 | .01078 | .970 | .01081 | .973 |
| 19/32 | .5938 | .01117 | 1.305 | .01121 | 1.009 | .01125 | 1.013 | .01129 | 1.016 | .01133 | 1.025 | .01136 | 1.022 |
| 5/8 | .6250 | .01171 | 1.154 | .01175 | 1.058 | .01179 | 1.361 | .01183 | 1.065 | .01187 | 1.068 | .01190 | 1.071 |
| 21/32 | .6562 | .01226 | 1.103 | .01230 | 1.107 | .01234 | 1.111 | .01238 | 1.114 | .01242 | 1.118 | .01245 | 1.121 |
| 11/16 | .6875 | .01290 | 1.152 | .01284 | 1.156 | .01288 | 1.159 | .01292 | 1.163 | .01296 | 1.166 | .01299 | 1.169 |
| 23/32 | .7188 | .01335 | 1.202 | .01339 | 1.205 | .01343 | 1.264 | .01347 | 1.212 | .01351 | 1.216 | .01354 | 1.219 |
| 3/4 | .7500 | .01389 | 1.250 | .01393 | 1.254 | .01397 | 1.287 | .01401 | 1.261 | .01405 | 1.265 | .01408 | 1.267 |
| 13/16 | .8125 | .01498 | 1.348 | .01502 | 1.352 | .01506 | 1.355 | .01510 | 1.359 | .01514 | 1.363 | .01517 | 1.365 |
| 7/8 | .8750 | .01607 | 1.446 | .01611 | 1.450 | .01615 | 1.454 | .01619 | 1.457 | .01623 | 1.461 | .01626 | 1.413 |
| 15/16 | .9375 | .01716 | 1.544 | .01720 | 1.545 | .01724 | 1.552 | .01728 | 1.555 | .01732 | 1.559 | .01735 | 1.502 |
| | 1.000 | .01825 | 1.643 | .01829 | 1.646 | .01833 | 1.652 | .01837 | 1.655 | .01841 | 1.457 | .01844 | 1.660 |

TABLE 10

| | | .140 BA | | .150 BA | | .155 BA | | .160 BA | | .170 BA | | .180 BA | | .190 BA | |
|---|---|---|---|---|---|---|---|---|---|---|---|---|---|---|---|
| | | 1° | 90° | 1° | 90° | 1° | 90° | 1° | 90° | 1° | 90° | 1° | 90° | 1° | 90° |
| 1/32 | .0312 | .00163 | .147 | .00171 | .154 | .00175 | .158 | .00179 | .161 | .00187 | .168 | .00194 | .175 | .00202 | .182 |
| 1/16 | .0625 | .00218 | .196 | .00226 | .203 | .00230 | .207 | .00234 | .211 | .00242 | .218 | .00249 | .224 | .00257 | .231 |
| 3/32 | .0938 | .00272 | .245 | .00280 | .252 | .00284 | .256 | .00288 | .259 | .00296 | .266 | .00303 | .273 | .00311 | .280 |
| 1/8 | .1250 | .00327 | .294 | .00335 | .302 | .00339 | .305 | .00343 | .309 | .00351 | .316 | .00358 | .322 | .00366 | .329 |
| 5/32 | .1562 | .00381 | .343 | .00389 | .350 | .00393 | .354 | .00397 | .357 | .00405 | .365 | .00412 | .371 | .00420 | .378 |
| 3/16 | .1875 | .00436 | .392 | .00444 | .400 | .00448 | .403 | .00452 | .407 | .00460 | .414 | .00467 | .420 | .00475 | .428 |
| 7/32 | .2188 | .00490 | .441 | .00498 | .448 | .00502 | .452 | .00506 | .455 | .00514 | .463 | .00521 | .469 | .00529 | .476 |
| 1/4 | .2500 | .00545 | .491 | .00553 | .498 | .00557 | .501 | .00561 | .505 | .00569 | .512 | .00576 | .518 | .00584 | .526 |
| 9/32 | .2812 | .00599 | .539 | .00607 | .546 | .00611 | .550 | .00615 | .554 | .00623 | .561 | .00630 | .567 | .00638 | .574 |
| 5/16 | .3125 | .00654 | .589 | .00662 | .596 | .00666 | .599 | .00670 | .603 | .00678 | .610 | .00685 | .617 | .00693 | .624 |
| 11/32 | .3438 | .00708 | .637 | .00716 | .644 | .00720 | .648 | .00724 | .652 | .00732 | .659 | .00739 | .665 | .00747 | .672 |
| 3/8 | .3750 | .00763 | .687 | .00771 | .694 | .00775 | .698 | .00779 | .701 | .00787 | .708 | .00794 | .715 | .00802 | .722 |
| 13/32 | .4062 | .00817 | .735 | .00825 | .743 | .00829 | .746 | .00833 | .750 | .00841 | .757 | .00848 | .763 | .00856 | .770 |
| 7/16 | .4375 | .00872 | .785 | .00880 | .792 | .00884 | .796 | .00888 | .799 | .00896 | .806 | .00903 | .813 | .00911 | .820 |
| 15/32 | .4688 | .00926 | .833 | .00934 | .841 | .00938 | .844 | .00942 | .848 | .00950 | .855 | .00957 | .861 | .00965 | .869 |
| 1/2 | .5000 | .00981 | .883 | .00989 | .890 | .00993 | .894 | .00997 | .897 | .01005 | .905 | .01012 | .911 | .01020 | .918 |
| 17/32 | .5312 | .01035 | .932 | .01043 | .939 | .01047 | .942 | .01051 | .946 | .01059 | .953 | .01066 | .959 | .01074 | .967 |
| 9/16 | .5625 | .01089 | .980 | .01097 | .987 | .01101 | .991 | .01105 | .995 | .01113 | 1.002 | .01120 | 1.008 | .01128 | 1.015 |
| 19/32 | .5938 | .01144 | 1.030 | .01152 | 1.037 | .01156 | 1.040 | .01160 | 1.044 | .01168 | 1.051 | .01175 | 1.058 | .01183 | 1.065 |
| 5/8 | .6250 | .01198 | 1.078 | .01206 | 1.085 | .01210 | 1.089 | .01214 | 1.093 | .01222 | 1.100 | .01229 | 1.106 | .01237 | 1.113 |
| 21/32 | .6562 | .01253 | 1.128 | .01261 | 1.135 | .01265 | 1.139 | .01269 | 1.142 | .01277 | 1.149 | .01284 | 1.156 | .01292 | 1.163 |
| 11/16 | .6875 | .01307 | 1.176 | .01315 | 1.184 | .01319 | 1.187 | .01323 | 1.191 | .01331 | 1.198 | .01338 | 1.204 | .01346 | 1.211 |
| 23/32 | .7188 | .01362 | 1.226 | .01370 | 1.233 | .01374 | 1.237 | .01378 | 1.240 | .01386 | 1.247 | .01393 | 1.254 | .01401 | 1.261 |
| 3/4 | .7500 | .01416 | 1.274 | .01424 | 1.282 | .01428 | 1.285 | .01432 | 1.289 | .01440 | 1.296 | .01447 | 1.302 | .01455 | 1.310 |
| 13/16 | .8125 | .01525 | 1.373 | .01533 | 1.380 | .01537 | 1.383 | .01541 | 1.387 | .01549 | 1.394 | .01556 | 1.480 | .01564 | 1.408 |
| 7/8 | .8750 | .01634 | 1.471 | .01642 | 1.478 | .01646 | 1.481 | .01650 | 1.485 | .01658 | 1.492 | .01665 | 1.499 | .01673 | 1.506 |
| 15/16 | .9375 | .01743 | 1.569 | .01751 | 1.576 | .01755 | 1.580 | .01759 | 1.583 | .01767 | 1.590 | .01774 | 1.597 | .01782 | 1.604 |
| | 1.000 | .01852 | 1.667 | .01860 | 1.674 | .01864 | 1.678 | .01868 | 1.681 | .01876 | 1.688 | .01883 | 1.695 | .01891 | 1.702 |

TABLE 11

| | | .200 BA | | .210 BA | | .220 BA | | .230 BA | | .240 BA | | .250 BA | |
|---|---|---|---|---|---|---|---|---|---|---|---|---|---|
| | | 1° | 90° | 1° | 90° | 1° | 90° | 1° | 90° | 1° | 90° | 1° | 90° |
| 1/32 | .0312 | .00210 | .189 | .00218 | .196 | .00226 | .203 | .00233 | .210 | .00241 | .217 | .00249 | .224 |
| 1/16 | .0625 | .00265 | .239 | .00273 | .246 | .00281 | .253 | .00288 | .259 | .00296 | .266 | .00304 | .274 |
| 3/32 | .0938 | .00319 | .287 | .00327 | .294 | .00335 | .302 | .00342 | .308 | .00350 | .315 | .00358 | .322 |
| 1/8 | .1250 | .00374 | .337 | .00382 | .344 | .00390 | .351 | .00397 | .357 | .00405 | .365 | .00413 | .372 |
| 5/32 | .1562 | .00428 | .385 | .00436 | .392 | .00444 | .400 | .00451 | .406 | .00459 | .413 | .00467 | .420 |
| 3/16 | .1875 | .00483 | .435 | .00491 | .442 | .00499 | .449 | .00506 | .455 | .00514 | .463 | .00522 | .470 |
| 7/32 | .2188 | .00537 | .483 | .00545 | .491 | .00553 | .498 | .00560 | .504 | .00568 | .511 | .00576 | .518 |
| 1/4 | .2500 | .00592 | .533 | .00600 | .540 | .00608 | .547 | .00615 | .554 | .00623 | .561 | .00631 | .568 |
| 9/32 | .2812 | .00646 | .581 | .00654 | .589 | .00662 | .596 | .00669 | .602 | .00677 | .609 | .00685 | .617 |
| 5/16 | .3125 | .00701 | .631 | .00709 | .638 | .00717 | .645 | .00724 | .652 | .00732 | .659 | .00740 | .666 |
| 11/32 | .3438 | .00755 | .680 | .00763 | .687 | .00771 | .694 | .00778 | .700 | .00786 | .707 | .00794 | .715 |
| 3/8 | .3750 | .00810 | .729 | .00818 | .736 | .00826 | .743 | .00833 | .750 | .00841 | .757 | .00849 | .764 |
| 13/32 | .4062 | .00864 | .778 | .00872 | .785 | .00880 | .792 | .00887 | .798 | .00895 | .806 | .00903 | .813 |
| 7/16 | .4375 | .00919 | .827 | .00927 | .834 | .00935 | .842 | .00942 | .848 | .00950 | .855 | .00958 | .862 |
| 15/32 | .4688 | .00973 | .876 | .00981 | .883 | .00989 | .890 | .00996 | .896 | .01004 | .904 | .01012 | .911 |
| 1/2 | .5000 | .01028 | .925 | .01036 | .932 | .01044 | .940 | .01051 | .946 | .01059 | .953 | .01067 | .960 |
| 17/32 | .5312 | .01082 | .974 | .01090 | .981 | .01098 | .988 | .01105 | .995 | .01113 | 1.002 | .01121 | 1.009 |
| 9/16 | .5625 | .01136 | 1.022 | .01144 | 1.030 | .01152 | 1.037 | .01159 | 1.043 | .01167 | 1.050 | .01175 | 1.058 |
| 19/32 | .5938 | .01191 | 1.072 | .01199 | 1.079 | .01207 | 1.086 | .01214 | 1.093 | .01222 | 1.100 | .01230 | 1.107 |
| 5/8 | .6250 | .01245 | 1.121 | .01253 | 1.128 | .01261 | 1.135 | .01268 | 1.141 | .01276 | 1.148 | .01284 | 1.156 |
| 21/32 | .6562 | .01300 | 1.170 | .01308 | 1.177 | .01316 | 1.184 | .01323 | 1.191 | .01331 | 1.198 | .01339 | 1.205 |
| 11/16 | .6875 | .01354 | 1.219 | .01362 | 1.226 | .01370 | 1.253 | .01377 | 1.239 | .01385 | 1.247 | .01393 | 1.254 |
| 23/32 | .7188 | .01409 | 1.268 | .01417 | 1.275 | .01425 | .1283 | .01432 | 1.289 | .01440 | 1.296 | .01448 | 1.303 |
| 3/4 | .7500 | .01463 | 1.317 | .01471 | 1.324 | .01479 | 1.331 | .01486 | 1.337 | .01494 | 1.345 | .01502 | 1.352 |
| 13/16 | .8125 | .01572 | 1.415 | .01580 | 1.422 | .01588 | 1.424 | .01595 | 1.436 | .01603 | 1.443 | .01611 | 1.450 |
| 7/8 | .8750 | .01681 | 1.513 | .01689 | 1.520 | .01697 | 1.527 | .01704 | 1.534 | .01712 | 1.541 | .01720 | 1.548 |
| 15/16 | .9375 | .01790 | 1.611 | .01798 | 1.618 | .01806 | 1.625 | .01813 | 1.632 | .01821 | 1.639 | .01829 | 1.646 |
| | 1.000 | .01899 | 1.709 | .01907 | 1.716 | .01915 | 1.724 | .01922 | 1.730 | .01930 | 1.737 | .01938 | 1.744 |

Tables 12, 13, 14, 15, 16 and 17 are Set Back (SB) and Material Deduction (MD) values for 90° for different bend radii (vertical) and various thicknesses (T) (horizontal).

TABLE 12

| | | .010 | | .015 | | .020 | | .025 | | .030 | | .035 | |
|---|---|---|---|---|---|---|---|---|---|---|---|---|---|
| | | 90° SB | 90° MD | 90° SB | 90° MD | 90° SB | 90° MD | 90° SB | 90° MD | 90° SB | 90° MD | 90° SB | 90° MD |
| 1/32 | .0312 | .041 | .026 | .046 | .033 | .051 | .039 | .056 | .045 | .061 | .053 | | |
| 1/16 | .0625 | .072 | .039 | .077 | .045 | .082 | .051 | .087 | .058 | .092 | .065 | .097 | .072 |
| 3/32 | .0938 | .103 | .052 | .108 | .058 | .113 | .065 | .118 | .071 | .123 | .079 | .128 | .085 |
| 1/8 | .1250 | .135 | .067 | .140 | .073 | .145 | .079 | .150 | .086 | .155 | .093 | .160 | .099 |
| 5/32 | .1562 | .166 | .080 | .171 | .086 | .176 | .093 | .181 | .099 | .186 | .106 | .191 | .113 |
| 3/16 | .1875 | .197 | .092 | .202 | .099 | .207 | .105 | .212 | .112 | .217 | .119 | .222 | .125 |
| 7/32 | .2188 | .228 | .106 | .233 | .112 | .238 | .119 | .243 | .125 | .248 | .132 | .253 | .139 |
| 1/4 | .2500 | .260 | .120 | .265 | .127 | .270 | .133 | .275 | .140 | .280 | .147 | .285 | .153 |
| 9/32 | .2812 | .291 | .134 | .296 | .140 | .301 | .147 | .306 | .153 | .311 | .160 | .316 | .167 |
| 5/16 | .3125 | .322 | .146 | .327 | .153 | .332 | .159 | .337 | .165 | .342 | .173 | .347 | .179 |
| 11/32 | .3438 | .353 | .160 | .358 | .166 | .363 | .172 | .368 | .179 | .373 | .186 | .378 | .193 |
| 3/8 | .3750 | .385 | .174 | .390 | .181 | .395 | .187 | .400 | .193 | .405 | .201 | .410 | .207 |
| 13/32 | .4062 | .416 | .188 | .421 | .194 | .426 | .200 | .431 | .207 | .436 | .214 | .441 | .220 |
| 7/16 | .4375 | .447 | .200 | .452 | .206 | .457 | .213 | .462 | .219 | .467 | .227 | .472 | .233 |
| 15/32 | .4688 | .478 | .213 | .483 | .220 | .488 | .226 | .493 | .233 | .498 | .240 | .503 | .246 |
| 1/2 | .5000 | .510 | .228 | .515 | .234 | .520 | .241 | .525 | .247 | .530 | .254 | .535 | .261 |
| 17/32 | .5312 | .541 | .241 | .546 | .248 | .551 | .254 | .556 | .261 | .561 | .268 | .566 | .274 |
| 9/16 | .5625 | .572 | .255 | .577 | .261 | .582 | .268 | .587 | .274 | .592 | .281 | .597 | .288 |
| 19/32 | .5938 | .603 | .267 | .608 | .274 | .613 | .280 | .618 | .286 | .623 | .294 | .628 | .300 |
| 5/8 | .6250 | .635 | .283 | .640 | .289 | .645 | .295 | .650 | .302 | .655 | .309 | .660 | .316 |
| 21/32 | .6562 | .666 | .295 | .671 | .302 | .676 | .308 | .681 | .314 | .686 | .322 | .691 | .328 |
| 11/16 | .6875 | .697 | .309 | .702 | .315 | .707 | .321 | .712 | .328 | .717 | .335 | .722 | .341 |
| 23/32 | .7188 | .728 | .321 | .733 | .327 | .738 | .334 | .743 | .340 | .748 | .348 | .753 | .354 |
| 3/4 | .7500 | .760 | .336 | .765 | .343 | .770 | .349 | .775 | .356 | .780 | .363 | .785 | .369 |
| 13/16 | .8125 | .822 | .362 | .827 | .369 | .832 | .375 | .837 | .382 | .842 | .389 | .847 | .395 |
| 7/8 | .8750 | .885 | .390 | .890 | .397 | .895 | .403 | .900 | .409 | .905 | .417 | .910 | .423 |
| 15/16 | .9375 | .947 | .416 | .952 | .423 | .957 | .429 | .962 | .435 | .967 | .443 | .972 | .449 |
| | 1.000 | 1.010 | .444 | 1.015 | .450 | 1.020 | .457 | 1.025 | .463 | 1.030 | .471 | 1.035 | .477 |

TABLE 13

| | | .040 | | .045 | | .050 | | .055 | | .060 | | .065 | | .070 | |
|---|---|---|---|---|---|---|---|---|---|---|---|---|---|---|---|
| | | 90° SB | 90° MD | 90° SB | 90° MD | 90° SB | 90° MD | 90° SB | 90° MD | 90° SB | 90° MD | 90° SB | 90° MD | 90° SB | 90° MD |
| 1/16 | .0625 | .102 | .078 | .107 | .084 | .112 | .091 | .117 | .097 | .122 | .104 | .27 | .10 | | |
| 3/32 | .0938 | .133 | .091 | .138 | .098 | .143 | .104 | .148 | .111 | .153 | .117 | .158 | .123 | .163 | .130 |

TABLE 13-continued

| | | .040 | | .045 | | .050 | | .055 | | .060 | | .065 | | .070 | |
|---|---|---|---|---|---|---|---|---|---|---|---|---|---|---|---|
| | | 90° SB | 90° MD | 90° SB | 90° MD | 90° SB | 90° MD | 90° SB | 90° MD | 90° SB | 90° MD | 90° SB | 90° MD | 90° SB | 90° MD |
| 1/8 | .1250 | .165 | .106 | .170 | .112 | .175 | .119 | .180 | .125 | .185 | .131 | .190 | .138 | .195 | .144 |
| 5/32 | .1562 | .196 | .119 | .201 | .126 | .206 | .132 | .211 | .138 | .216 | .145 | .221 | .151 | .226 | .158 |
| 3/16 | .1875 | .227 | .132 | .232 | .138 | .237 | .145 | .242 | .151 | .247 | .157 | .252 | .164 | .257 | .170 |
| 7/32 | .2188 | .258 | .145 | .263 | .152 | .268 | .158 | .273 | .164 | .278 | .171 | .283 | .177 | .288 | .184 |
| 1/4 | .2500 | .290 | .160 | .295 | .166 | .300 | .172 | .305 | .179 | .310 | .185 | .315 | .192 | .320 | .198 |
| 9/32 | .2812 | .321 | .173 | .326 | .179 | .331 | .186 | .336 | .192 | .341 | .199 | .346 | .205 | .351 | .211 |
| 5/16 | .3125 | .352 | .186 | .357 | .192 | .362 | .198 | .367 | .205 | .372 | .211 | .377 | .218 | .382 | .224 |
| 11/32 | .3438 | .383 | .199 | .388 | .205 | .393 | .212 | .398 | .218 | .403 | .225 | .408 | .231 | .413 | .237 |
| 3/8 | .3750 | .415 | .213 | .420 | .220 | .425 | .226 | .430 | .233 | .435 | .239 | .440 | .245 | .445 | .252 |
| 13/32 | .4062 | .446 | .227 | .451 | .233 | .456 | .240 | .461 | .246 | .466 | .252 | .471 | .259 | .476 | .265 |
| 7/16 | .4375 | .477 | .239 | .482 | .246 | .487 | .252 | .492 | .259 | .497 | .265 | .502 | .271 | .507 | .278 |
| 15/32 | .4688 | .508 | .253 | .513 | .259 | .518 | .266 | .523 | .272 | .528 | .278 | .533 | .285 | .538 | .291 |
| 1/2 | .5000 | .540 | .267 | .545 | .274 | .550 | .280 | .555 | .286 | .560 | .293 | .565 | .299 | .570 | .306 |
| 17/32 | .5312 | .571 | .281 | .576 | .287 | .581 | .293 | .586 | .300 | .591 | .306 | .596 | .313 | .601 | .319 |
| 9/16 | .5625 | .602 | .294 | .607 | .300 | .612 | .307 | .617 | .313 | .622 | .320 | .627 | .326 | .632 | .332 |
| 19/32 | .5938 | .633 | .307 | .638 | .313 | .643 | .319 | .648 | .326 | .653 | .332 | .658 | .339 | .663 | .345 |
| 5/8 | .6250 | .665 | .322 | .670 | .328 | .675 | .335 | .680 | .341 | .685 | .348 | .690 | .354 | .695 | .360 |
| 21/32 | .6562 | .696 | .334 | .701 | .341 | .706 | .347 | .711 | .354 | .716 | .360 | .721 | .366 | .726 | .373 |
| 11/16 | .6875 | .727 | .348 | .732 | .354 | .737 | .361 | .742 | .367 | .747 | .373 | .752 | .380 | .757 | .386 |
| 23/32 | .7188 | .758 | .360 | .763 | .367 | .768 | .373 | .773 | .380 | .778 | .386 | .783 | .392 | .788 | .399 |
| 3/4 | .7500 | .790 | .376 | .795 | .382 | .800 | .389 | .805 | .395 | .810 | .401 | .815 | .408 | .820 | .414 |
| 13/16 | .8125 | .852 | .402 | .857 | .408 | .862 | .414 | .867 | .421 | .872 | .427 | .877 | .434 | .882 | .440 |
| 7/8 | .8750 | .915 | .430 | .920 | .436 | .925 | .442 | .930 | .449 | .935 | .455 | .940 | .462 | .945 | .468 |
| 15/16 | .9375 | .977 | .455 | .982 | .462 | .987 | .468 | .992 | .475 | .997 | .481 | 1.002 | .487 | 1.007 | .494 |
| | 1.000 | 1.040 | .483 | 1.045 | .490 | 1.050 | .496 | 1.055 | .503 | 1.060 | .509 | 1.065 | .515 | 1.070 | .522 |

TABLE 14

| | | .075 | | .080 | | .085 | | .090 | | .095 | | .100 | |
|---|---|---|---|---|---|---|---|---|---|---|---|---|---|
| | | 90° SB | 90° MD | 90° SB | 90° MD | 90° SB | 90° MD | 90° SB | 90° MD | 90° SB | 90° MD | 90° SB | 90° MD |
| 3/32 | .0938 | .168 | .136 | .173 | .143 | .178 | .150 | .183 | .156 | | | | |
| 1/8 | .1250 | .200 | .151 | .205 | .158 | .210 | .164 | .215 | .171 | .220 | .177 | .225 | .184 |
| 5/32 | .1562 | .231 | .164 | .236 | .171 | .241 | .178 | .246 | .184 | .251 | .191 | .256 | .197 |
| 3/16 | .1875 | .262 | .177 | .267 | .184 | .272 | .190 | .277 | .197 | .282 | .203 | .287 | .209 |
| 7/32 | .2188 | .293 | .190 | .298 | .197 | .303 | .204 | .308 | .210 | .313 | .216 | .318 | .223 |
| 1/4 | .2500 | .325 | .204 | .330 | .212 | .335 | .218 | .340 | .225 | .345 | .231 | .350 | .237 |
| 9/32 | .2812 | .356 | .218 | .361 | .225 | .360 | .232 | .371 | .238 | .376 | .244 | .381 | .251 |
| 5/16 | .3125 | .387 | .230 | .392 | .238 | .397 | .244 | .402 | .250 | .407 | .257 | .412 | .263 |
| 11/32 | .3438 | .418 | .244 | .423 | .251 | .428 | .257 | .433 | .264 | .438 | .270 | .443 | .277 |
| 3/8 | .3750 | .450 | .258 | .455 | .266 | .460 | .272 | .465 | .278 | .470 | .285 | .475 | .291 |
| 13/32 | .4062 | .481 | .272 | .486 | .279 | .491 | .285 | .496 | .292 | .501 | .298 | .506 | .305 |
| 7/16 | .4375 | .512 | .284 | .517 | .291 | .522 | .298 | .527 | .304 | .532 | .311 | .537 | .317 |
| 15/32 | .4688 | .543 | .298 | .548 | .305 | .553 | .311 | .558 | .318 | .563 | .324 | .568 | .330 |
| 1/2 | .5000 | .575 | .312 | .580 | .319 | .585 | .326 | .590 | .332 | .595 | .339 | .600 | .345 |
| 17/32 | .5312 | .606 | .325 | .611 | .333 | .616 | .339 | .621 | .346 | .626 | .352 | .631 | .358 |
| 9/16 | .5625 | .637 | .339 | .642 | .346 | .647 | .353 | .652 | .359 | .657 | .365 | .662 | .372 |
| 19/32 | .5938 | .668 | .351 | .673 | .359 | .678 | .365 | .683 | .371 | .688 | .378 | .693 | .384 |
| 5/8 | .6250 | .700 | .367 | .705 | .374 | .710 | .380 | .715 | .387 | .720 | .393 | .725 | .400 |
| 21/32 | .6562 | .731 | .379 | .736 | .387 | .741 | .393 | .746 | .399 | .751 | .406 | .756 | .412 |
| 11/16 | .6875 | .762 | .393 | .767 | .400 | .772 | .406 | .777 | .413 | .782 | .419 | .787 | .426 |
| 23/32 | .7188 | .793 | .405 | .798 | .412 | .803 | .419 | .808 | .425 | .813 | .432 | .818 | .438 |
| 3/4 | .7500 | .825 | .421 | .830 | .428 | .835 | .434 | .840 | .441 | .845 | .447 | .850 | .453 |
| 13/16 | .8125 | .887 | .446 | .892 | .454 | .897 | .460 | .902 | .467 | .907 | .473 | .912 | .479 |
| 7/8 | .8750 | .950 | .474 | .955 | .482 | .960 | .488 | .965 | .494 | .970 | .501 | .975 | .507 |
| 15/16 | .9375 | 1.012 | .500 | 1.017 | .508 | 1.022 | .514 | 1.027 | .520 | 1.032 | .527 | 1.037 | .533 |
| | 1.000 | 1.075 | .528 | 1.080 | .535 | 1.085 | .542 | 1.090 | .548 | 1.095 | .555 | 1.100 | .561 |

TABLE 15

| | | .105 | | .110 | | .115 | | .120 | | .125 | | .130 | |
|---|---|---|---|---|---|---|---|---|---|---|---|---|---|
| | | 90° SB | 90° MD | 90° SB | 90° MD | 90° SB | 90° MD | 90° SB | 90° MD | 90° SB | 90° MD | 90° SB | 90° MD |
| 1/32 | .0312 | .136 | .150 | .141 | .156 | .146 | .162 | .151 | .169 | .156 | .175 | .161 | .182 |
| 1/16 | .0625 | .167 | .162 | .172 | .168 | .177 | .175 | .182 | .181 | .187 | .188 | .192 | .195 |
| 3/32 | .0938 | .198 | .175 | .203 | .182 | .208 | .188 | .213 | .195 | .218 | .201 | .223 | .208 |
| 1/8 | .1250 | .230 | .190 | .235 | .196 | .240 | .203 | .245 | .209 | .250 | .216 | .255 | .223 |
| 5/32 | .1562 | .261 | .203 | .266 | .210 | .271 | .216 | .276 | .223 | .281 | .229 | .286 | .236 |
| 3/16 | .1875 | .292 | .216 | .297 | .222 | .302 | .229 | .307 | .235 | .312 | .241 | .317 | .249 |
| 7/32 | .2188 | .323 | .229 | .328 | .236 | .333 | .242 | .338 | .248 | .343 | .255 | .348 | .262 |
| 1/4 | .2500 | .355 | .244 | .360 | .250 | .365 | .257 | .370 | .263 | .375 | .269 | .380 | .277 |
| 9/32 | .2812 | .386 | .257 | .391 | .264 | .396 | .270 | .401 | .276 | .406 | .283 | .411 | .290 |
| 5/16 | .3125 | .417 | .270 | .422 | .276 | .427 | .282 | .432 | .289 | .437 | .295 | .442 | .303 |
| 11/32 | .3438 | .448 | .283 | .453 | .289 | .458 | .296 | .463 | .302 | .468 | .309 | .473 | .316 |
| 3/8 | .3750 | .480 | .298 | .485 | .304 | .490 | .310 | .495 | .317 | .500 | .323 | .505 | .330 |

TABLE 15-continued

| | | .105 | | .110 | | .115 | | .120 | | .125 | | .130 | |
|---|---|---|---|---|---|---|---|---|---|---|---|---|---|
| | | 90° SB | 90° MD | 90° SB | 90° MD | 90° SB | 90° MD | 90° SB | 90° MD | 90° SB | 90° MD | 90° SB | 90° MD |
| 13/32 | .4062 | .511 | .311 | .516 | .317 | .521 | .324 | .526 | .330 | .531 | .337 | .536 | .344 |
| 7/16 | .4375 | .542 | .323 | .547 | .330 | .552 | .336 | .557 | .343 | .562 | .349 | .567 | .356 |
| 15/32 | .4688 | .573 | .337 | .578 | .343 | .583 | .350 | .588 | .356 | .593 | .362 | .598 | .370 |
| ½ | .5000 | .605 | .351 | .610 | .358 | .615 | .364 | .620 | .371 | .625 | .377 | .630 | .384 |
| 17/32 | .5312 | .636 | .365 | .641 | .371 | .646 | .378 | .651 | .384 | .656 | .390 | .661 | .398 |
| 9/16 | .5625 | .667 | .378 | .672 | .385 | .677 | .391 | .682 | .397 | .687 | .404 | .692 | .411 |
| 19/32 | .5938 | .698 | .391 | .703 | .397 | .708 | .403 | .713 | .410 | .718 | .416 | .723 | .424 |
| ⅝ | .6250 | .730 | .406 | .735 | .412 | .740 | .419 | .745 | .425 | .750 | .432 | .755 | .439 |
| 21/32 | .6562 | .761 | .419 | .766 | .425 | .771 | .431 | .776 | .438 | .781 | .444 | .786 | .451 |
| 11/16 | .6875 | .792 | .432 | .797 | .438 | .802 | .445 | .807 | .451 | .812 | .458 | .817 | .465 |
| 23/32 | .7188 | .823 | .444 | .828 | .451 | .833 | .457 | .838 | .464 | .843 | .470 | .848 | .477 |
| ¾ | .7500 | .855 | .460 | .860 | .466 | .865 | .473 | .870 | .479 | .875 | .485 | .880 | .493 |
| 13/16 | .8125 | .917 | .486 | .922 | .492 | .927 | .499 | .932 | .505 | .937 | .511 | .942 | .519 |
| ⅞ | .8750 | .980 | .514 | .985 | .520 | .990 | .526 | .995 | .533 | 1.000 | .584 | 1.005 | .547 |
| 15/16 | .9375 | 1.042 | .540 | 1.047 | .546 | 1.052 | .552 | 1.057 | .559 | 1.062 | .565 | 1.067 | .572 |
| | 1.000 | 1.105 | .567 | 1.110 | .574 | 1.115 | .580 | 1.120 | .587 | 1.125 | .593 | 1.130 | .600 |

TABLE 16

| | | .140 | | .150 | | .155 | | .160 | | .170 | | .180 | |
|---|---|---|---|---|---|---|---|---|---|---|---|---|---|
| | | 90° SB | 90° MD | 90° SB | 90° MD | 90° SB | 90° MD | 90° SB | 90° MD | 90° SB | 90° MD | 90° SB | 90° MD |
| 1/32 | .0312 | .171 | .195 | .181 | .208 | .186 | .214 | .191 | .221 | .201 | .234 | .211 | .247 |
| 1/16 | .0625 | .202 | .208 | .212 | .221 | .217 | .227 | .222 | .233 | .232 | .246 | .242 | .260 |
| 3/32 | .0938 | .233 | .221 | .243 | .234 | .248 | .240 | .253 | .247 | .263 | .260 | .273 | .273 |
| ⅛ | .1250 | .265 | .236 | .275 | .248 | .280 | .255 | .285 | .261 | .295 | .274 | .305 | .288 |
| 5/32 | .1562 | .296 | .249 | .306 | .262 | .311 | .268 | .316 | .275 | .326 | .287 | .336 | .301 |
| 3/16 | .1875 | .327 | .262 | .337 | .274 | .342 | .281 | .347 | .287 | .357 | .300 | .367 | .314 |
| 7/32 | .2188 | .358 | .275 | .368 | .288 | .373 | .294 | .378 | .301 | .388 | .313 | .398 | .327 |
| ¼ | .2500 | .390 | .289 | .400 | .302 | .405 | .309 | .410 | .315 | .420 | .328 | .430 | .342 |
| 9/32 | .2812 | .421 | .303 | .431 | .316 | .436 | .322 | .441 | .328 | .451 | .341 | .461 | .355 |
| 5/16 | .3125 | .452 | .315 | .462 | .328 | .467 | .335 | .472 | .341 | .482 | .354 | .492 | .367 |
| 11/32 | .3438 | .483 | .329 | .493 | .342 | .498 | .348 | .503 | .354 | .513 | .367 | .523 | .381 |
| ⅜ | .3750 | .515 | .343 | .525 | .356 | .530 | .362 | .535 | .369 | .545 | .382 | .555 | .395 |
| 13/32 | .4062 | .546 | .357 | .556 | .369 | .561 | .376 | .566 | .382 | .576 | .395 | .586 | .409 |
| 7/16 | .4375 | .577 | .369 | .587 | .382 | .592 | .388 | .597 | .395 | .607 | .408 | .617 | .421 |
| 15/32 | .4688 | .608 | .383 | .618 | .395 | .623 | .402 | .628 | .408 | .638 | .421 | .648 | .435 |
| ½ | .5000 | .640 | .397 | .650 | .410 | .655 | .416 | .660 | .423 | .670 | .435 | .680 | .449 |
| 17/32 | .5312 | .671 | .410 | .681 | .423 | .686 | .430 | .691 | .436 | .701 | .449 | .711 | .463 |
| 9/16 | .5625 | .702 | .424 | .712 | .437 | .717 | .443 | .722 | .449 | .732 | .462 | .742 | .476 |
| 19/32 | .5938 | .733 | .436 | .743 | .449 | .748 | .456 | .753 | .462 | .763 | .475 | .773 | .488 |
| ⅝ | .6250 | .765 | .452 | .775 | .465 | .780 | .471 | .785 | .477 | .795 | .490 | .805 | .504 |
| 21/32 | .6562 | .796 | .464 | .806 | .477 | .811 | .483 | .816 | .490 | .826 | .503 | .836 | .516 |
| 11/16 | .6875 | .827 | .478 | .837 | .490 | .842 | .497 | .847 | .503 | .857 | .516 | .867 | .530 |
| 23/32 | .7188 | .858 | .490 | .868 | .503 | .873 | .509 | .878 | .516 | .888 | .529 | .898 | .542 |
| ¾ | .7500 | .890 | .506 | .900 | .518 | .905 | .525 | .910 | .531 | .920 | .544 | .930 | .558 |
| 13/16 | .8125 | .952 | .531 | .962 | .544 | .967 | .551 | .972 | .557 | .982 | .570 | .992 | .584 |
| ⅞ | .8750 | 1.015 | .559 | 1.025 | .572 | 1.030 | .579 | 1.035 | .585 | 1.045 | .598 | 1.055 | .611 |
| 15/16 | .9375 | 1.077 | .585 | 1.087 | .598 | 1.092 | .604 | 1.097 | .611 | 1.107 | .624 | 1.117 | .637 |
| | 1.000 | 1.140 | .613 | 1.150 | .626 | 1.155 | .632 | 1.160 | .632 | 1.170 | .652 | 1.180 | .665 |

TABLE 17

| | | .190 | | .200 | | .210 | | .220 | | .230 | | .240 | | .250 | |
|---|---|---|---|---|---|---|---|---|---|---|---|---|---|---|---|
| | | 90° SB | 90° MD | 90° SB | 90° MD | 90° SB | 90° MD | 90° SB | 90° MD | 90° SB | 90° MD | 90° SB | 90° MD | 90° SB | 90° MD |
| 1/32 | .0312 | .221 | .260 | .231 | .273 | .241 | .286 | .251 | .299 | .261 | .312 | .271 | .325 | .281 | .338 |
| 1/16 | .0625 | .252 | .273 | .262 | .285 | .272 | .298 | .282 | .311 | .292 | .325 | .302 | .338 | .312 | .350 |
| 3/32 | .0938 | .283 | .286 | .293 | .299 | .303 | .312 | .313 | .324 | .323 | .338 | .333 | .351 | .343 | .364 |
| ⅛ | .1250 | .315 | .301 | .325 | .313 | .335 | .326 | .345 | .339 | .355 | .353 | .365 | .365 | .375 | .378 |
| 5/32 | .1562 | .346 | .314 | .356 | .327 | .366 | .340 | .376 | .352 | .386 | .366 | .396 | .379 | .406 | .392 |
| 3/16 | .1875 | .377 | .326 | .387 | .339 | .397 | .352 | .407 | .365 | .417 | .379 | .427 | .391 | .437 | .404 |
| 7/32 | .2188 | .408 | .340 | .418 | .353 | .428 | .365 | .438 | .378 | .448 | .392 | .458 | .405 | .468 | .418 |
| ¼ | .2500 | .440 | .354 | .450 | .367 | .460 | .380 | .470 | .393 | .480 | .406 | .490 | .419 | .500 | .432 |
| 9/32 | .2812 | .471 | .368 | .481 | .381 | .491 | .393 | .501 | .406 | .511 | .420 | .521 | .433 | .531 | .445 |
| 5/16 | .3125 | .502 | .380 | .512 | .393 | .522 | .406 | .532 | .419 | .542 | .432 | .552 | .445 | .562 | .458 |
| 11/32 | .3438 | .533 | .394 | .543 | .406 | .553 | .419 | .563 | .432 | .573 | .446 | .583 | .459 | .593 | .471 |
| ⅜ | .3750 | .565 | .408 | .575 | .421 | .585 | .434 | .595 | .447 | .605 | .460 | .615 | .473 | .625 | .486 |
| 13/32 | .4062 | .596 | .422 | .606 | .434 | .616 | .447 | .626 | .460 | .636 | .474 | .646 | .486 | .656 | .499 |
| 7/16 | .4375 | .627 | .434 | .637 | .447 | .647 | .460 | .657 | .472 | .667 | .486 | .677 | .499 | .687 | .512 |
| 15/32 | .4688 | .658 | .447 | .668 | .460 | .678 | .473 | .688 | .486 | .698 | .500 | .708 | .512 | .718 | .525 |
| ½ | .5000 | .690 | .462 | .700 | .475 | .710 | .488 | .720 | .500 | .730 | .514 | .740 | .527 | .750 | .540 |
| 17/32 | .5312 | .721 | .475 | .731 | .488 | .741 | .501 | .751 | .514 | .761 | .527 | .771 | .540 | .781 | .553 |
| 9/16 | .5625 | .752 | .489 | .762 | .502 | .772 | .514 | .782 | .527 | .792 | .541 | .802 | .554 | .812 | .566 |
| 19/32 | .5938 | .783 | .501 | .793 | .514 | .803 | .527 | .813 | .540 | .823 | .553 | .833 | .566 | .843 | .579 |

TABLE 17-continued

| | | .190 | | .200 | | .210 | | .220 | | .230 | | .240 | | .250 | |
|---|---|---|---|---|---|---|---|---|---|---|---|---|---|---|---|
| | | 90° SB | 90° MD | 90° SB | 90° MD | 90° SB | 90° MD | 90° SB | 90° MD | 90° SB | 90° MD | 90° SB | 90° MD | 90° SB | 90° MD |
| 5/8 | .6250 | .815 | .517 | .825 | .529 | .835 | .542 | .845 | .555 | .855 | .569 | .865 | .582 | .875 | .594 |
| 21/32 | .6562 | .846 | .529 | .856 | .542 | .866 | .555 | .876 | .568 | .886 | .581 | .896 | .594 | .906 | .607 |
| 11/16 | .6875 | .877 | .543 | .887 | .555 | .897 | .568 | .907 | .581 | .917 | .595 | .927 | .607 | .937 | .620 |
| 23/32 | .7188 | .908 | .555 | .918 | .568 | .928 | .581 | .938 | .593 | .948 | .607 | .958 | .620 | .968 | .633 |
| 3/4 | .7500 | .940 | .570 | .950 | .583 | .960 | .596 | .970 | .609 | .980 | .623 | .990 | .635 | 1.000 | .648 |
| 13/16 | .8125 | 1.002 | .596 | 1.012 | .609 | 1.022 | .622 | 1.032 | .635 | 1.042 | .648 | 1.052 | .661 | 1.062 | .674 |
| 7/8 | .8750 | 1.065 | .624 | 1.075 | .637 | 1.085 | .650 | 1.095 | .663 | 1.105 | .676 | 1.115 | .689 | 1.125 | .702 |
| 15/16 | .9375 | 1.127 | .650 | 1.137 | .663 | 1.147 | .676 | 1.157 | .689 | 1.167 | .702 | 1.177 | .715 | 1.187 | .728 |
| | 1.000 | 1.190 | .678 | 1.200 | .691 | 1.210 | .704 | 1.220 | .716 | 1.230 | .730 | 1.240 | .743 | 1.250 | .756 |

The use of the slide rule-type calculators described above when fitted with the internal slides bearing the numerical data in Tables 2–17 will be described in detail in respect of FIGS. 8–10.

(viii) Description of FIGS. 8a–8f

Figure 8A:
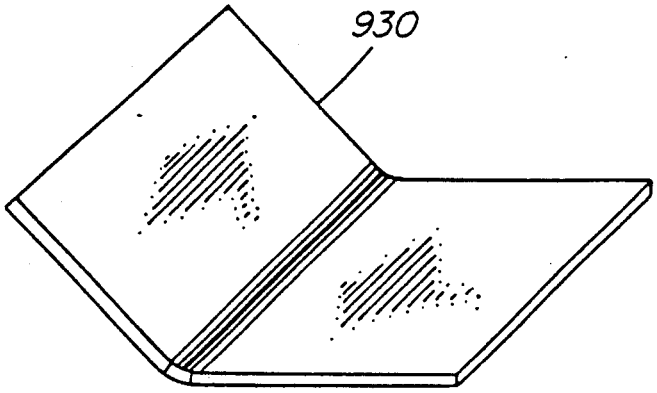

FIG. 8a shows the final 45° angle bend, and FIGS. 8b–8f show the steps used in the marking off of a 9/32" radius, 45° angle bend [R(53)=9/32"] in a 0.080" thickness (T) of sheet metal, with a given height (19) of 1⅜" and a given length (20) of 1 9/16". The finished piece of sheet metal is shown in FIG. 8a.

It is necessary to determine the SB, BA and MD, using the calculators of FIGS. 92a and 92b.

For 45°, these values, calculated from empirical formulae are:

$$SB = (R + T)K = 0.361 \times 0.41421 = 0.150''$$

$$BA = (1^\circ\ BA \times 45) = 0.00552 \times 45 = 0.248''$$

$$MD = (45^\circ\ SB \times 2) - (45^\circ\ BA) = (0.150 \times 2) - (45^\circ\ BA) = 0.300 - 0.248 = 0.052''$$

Figure 8B:
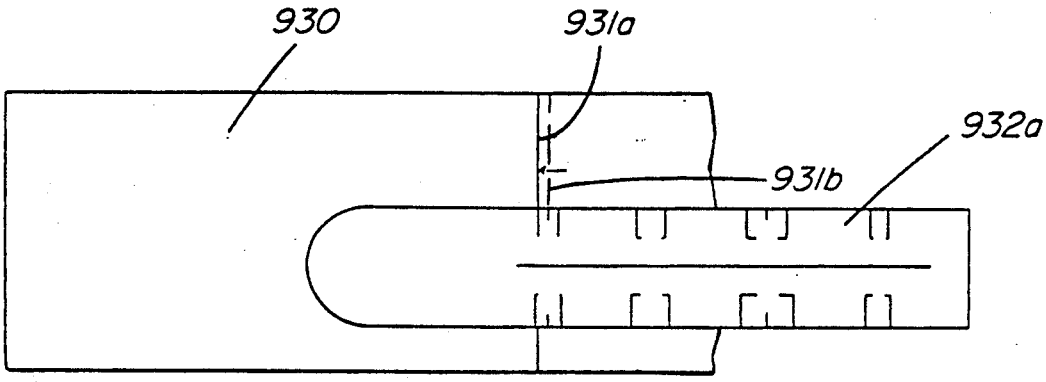
FIGS. 8*b*–8*f* are plan view showing steps in the laying out of the lines to provide the 45° bend in the piece of sheet metal shown in FIG. 8*b*, using the layout rulers of another embodiment of the present invention.

The calculators described above are then scanned to locate and select 90° bend layout rulers of embodiments of this invention which contains identical or nearly identical numerical spacing values thereon. Such selected 90° bend layout rulers are then used for the purpose of providing that particular numerical spacing value. The steps in the laying-out are:

(1) The shear cut size 931a is determined by subtracting one 45° MD (as calculated above), 0.052", from the total length 931b, i.e. 1⅜"+1 9/16"+2 15/16". This is determined, as shown in FIG. 8b, using the MD of a 90° bend layout ruler 932a of this invention designed for a thickness of 0.010" and a radius of 3/32", having a spacing value of 0.052".

Figure 8C:
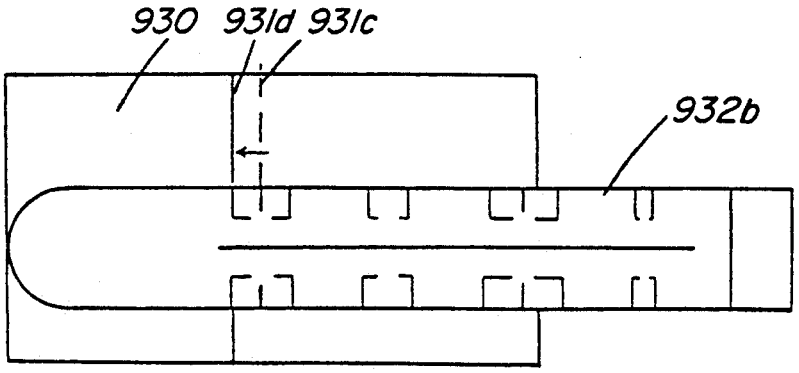

(2) The first bend tangent line 931d is determined by subtracting one 45° SB (as calculated above), 0.150", from the given height (19) of 1⅜", i.e. 1⅜−0.150". This is determined as shown in FIG. 8c, using the MDS of a 90° bend layout ruler 932b, designed for a thickness of 0.085" and a radius of 3/32", having a spacing value of 0.150".

Figure 8D:
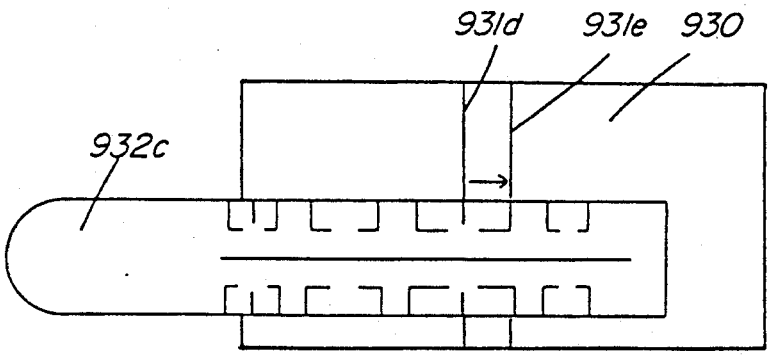

(3) The second bend tangent line 931e is determined by adding one 45° BA (as calculated above), 0.248", to the first bend tangent line 931d. This is determined as shown in FIG. 8d, using the SB of a 90° end layout ruler 932c designed for a thickness of 0.030" and a radius of 7/32", having a spacing value of 0.248".

Figure 8E:
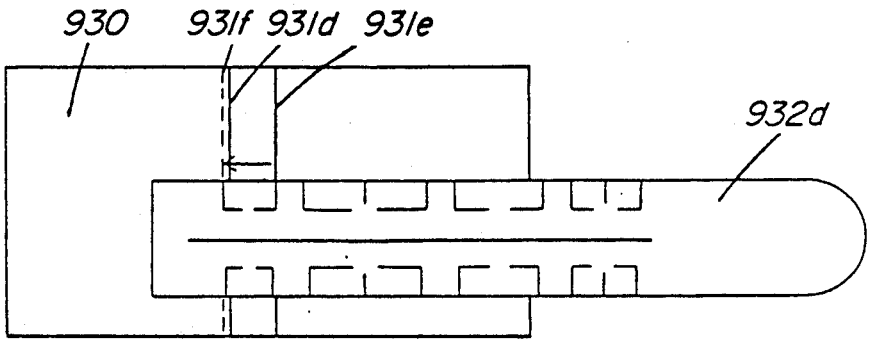

(4) The brake or sight line 931f is then drawn in. The brake or sight line 931f is located one 9/32" bend radius back from the second bend tangent line 931e. The marking of the brake or sight line is shown in FIG. 8e, using the R of a 90° bend layout ruler 932d designed for a thickness of 0.050" and a radius of 9/32". It is noted that this brake or sight line 931f is moved considerably forward. That is because, for a 45° bend, most of the bent area stays deep under the nose or radius finger of the brake. It is also to be observed that a 9/32" R is quite a large radius.

Figure 8F:
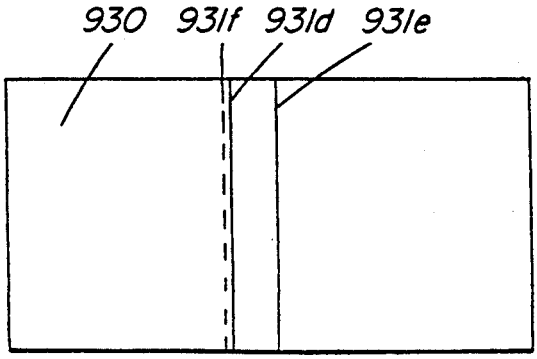

(5) The left hand side of the sheet metal 930 is then bent, using the drawn-in brake or sight line 931f as a guide. This is shown in FIG. 8f, and follows the procedure described for FIG. 4g. FIG. 4g shows the location of the brake or sight line in relation to the nose 886 of the brake 887. When bending, the brake or sight line is disposed so that it is even with the nose 886 of the brake 887.

(ix) Description of FIGS. 9a–9f

Figure 9A:
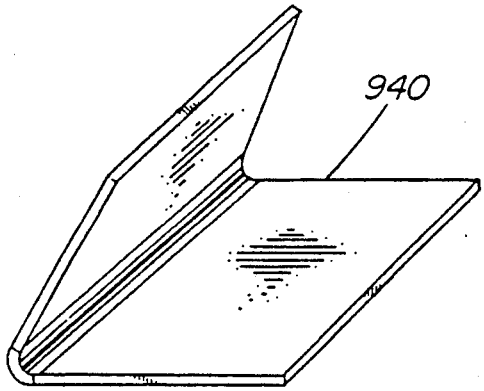

FIG. 9a shows the final 120° angle bend, and FIGS. 9a–9f show the steps used in the marking-off of a 5/32" radius, 120° angle bend [R(53)=5/32"] in a 0.040" thickness (T) sheet metal, with a given height (19) of 1 5/16" and a given length (20) of 1⅝". The finished piece of sheet metal is shown in FIG. 9a.

It is necessary to determine the SB, BA and MD, using the slide rule-type calculators described above as shown in Tables 2–17. For 120°, these values, calculated from empirical formulae, are:

$$SB = (R + T)K = 0.196 \times 1.7320 = 0.339''$$

$$BA = (1^\circ\ BA \times 120) = 0.00303 \times 120 = 0.364''$$

$$MD = (120^\circ\ SB \times 2) - (120^\circ\ BA) = (0.339 \times 2) - (120^\circ\ BA) = 0.678 - 0.364 = 0.314''$$

Figure 9B:
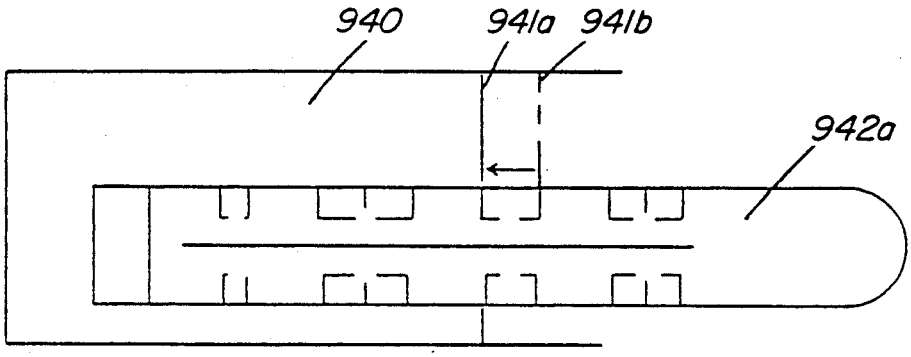
FIGS. 9*b*–9*f* are plan views showing steps in the laying out of the lines to provide the 120° bend in the piece of sheet metal shown in FIG. 9*a*, using the layout ruler of an embodiment of the present invention.
Figure 9C:
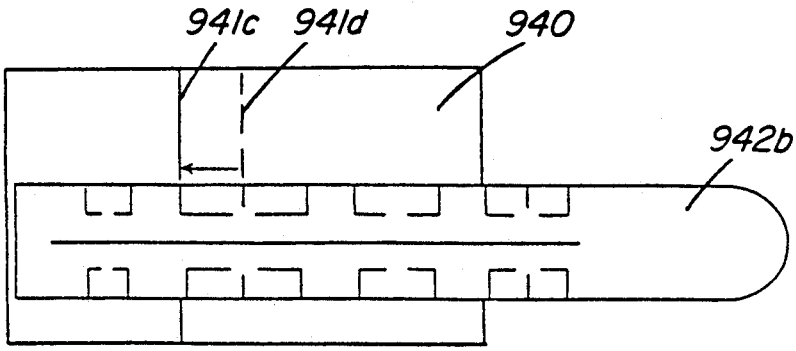
Figure 9D:
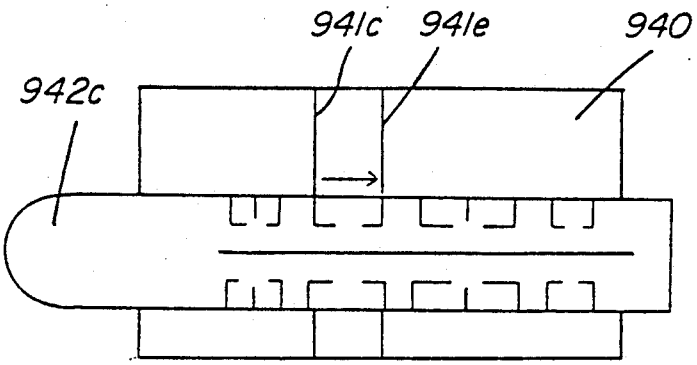
Figure 9E:
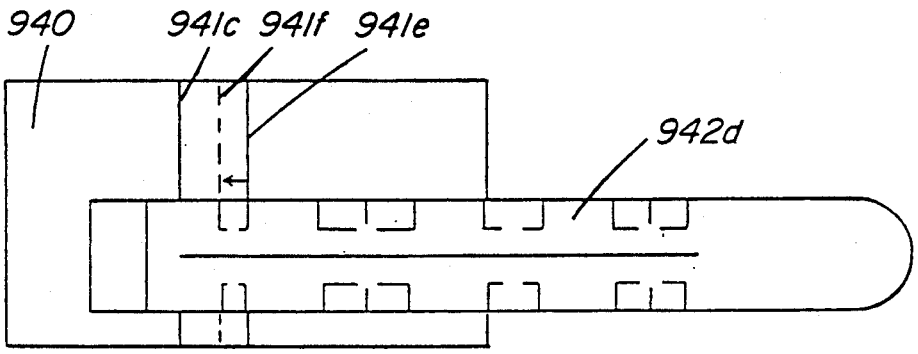
Figure 9F:
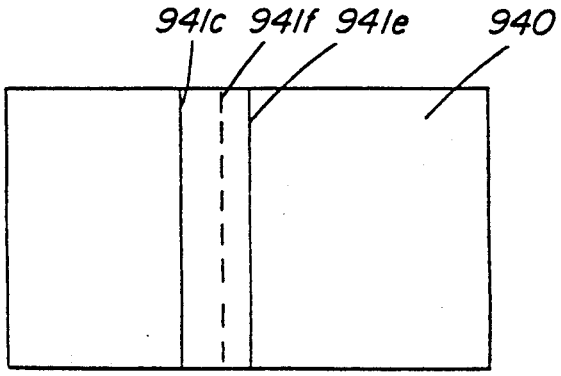

The calculators shown described above as shown in Tables 2–17 are then scanned to locate and select 90° bend layout rulers which contain identical or nearly identical numerical spacing values thereon. Such identical 90° bend layout rulers are then used for the purpose of providing that particular numerical spacing value. The steps for the laying out are as follows:

(1) The shear cut size 941a is determined by subtracting one 120° MD (as calculated above), 0.314", from the total length 941b, i.e. 1 5/16"+1⅝"=2 15/16"−0.314". This is determined, as shown in FIG. 9b, using the BA of a 90° bend layout ruler 942a of this invention designed for a thickness of 0.100" and a radius of 5/32", having a spacing value of approximately 0.314", i.e. 0.315".

(2) The first bend tangent line 941c is determined by subtracting one 120° SB (as calculated above) from the given length (19) of 1 5/16", i.e. 1 5/16"−0.339". This is determined, as shown in FIG. 94c, using the SB of a 90° bend layout ruler 942b, designed for a thickness of 0.090" and a radius of ¼", having a spacing value of approximately 0.339", i.e. 0.340".

(3) The second bend tangent line 941e is determined by adding one 120° BA (as calculated above), 0.364", to the first bend tangent line 941c. This is determined, as shown in FIG. 94d, using the BA of a 90° bend layout ruler 942c designed for a thickness of 0.030" and a radius of 7/32", having a spacing value of 0.364".

(4) The brake or sight line 941f is then drawn in. The brake or sight line 941f is located one 5/32" bend radius back from the second bend tangent line 941e. The marking of the brake or sight line is shown in FIG. 94e, using the R of a 90° bend layout ruler 942d designed for a thickness of 0.100" and a radius of 5/32".

(5) The left hand side of the sheet metal is then bent upwardly, using the drawn-in brake or sight line 941f as a guide. This is shown in FIG. 94f, and follows the procedure described for FIG. 88g. FIG. 88g shows the location of the brake or sight line in relation to the nose 886 of the brake 887. When bending, the brake or sight line is disposed so that it is even with the nose 886 of the brake 887.

(x) Description of FIGS. 10a–10k

Figure 10A:
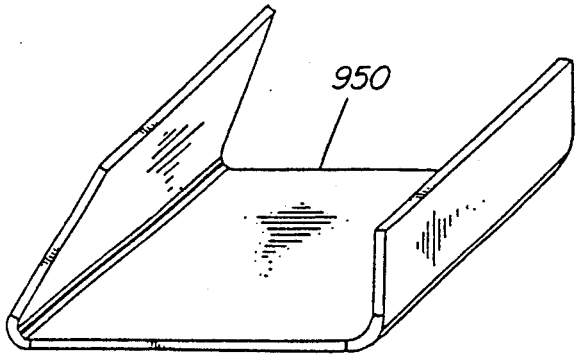

FIG. 10a shows a combination of a 120° bend and a 90° bend in a piece of sheet metal; while FIGS. 10b–10k show steps in the laying out of the lines to provide the combination of the 120° bend and the 90° bend in the piece of sheet metal shon in FIG. 10a, using the layout ruler of an embodiment of the present invention.

FIG. 10a shows the final product of a 120° bend at one end and a 90° bend at the other end, and FIGS. 10b–10k show the steps used in the marking off of a 5/32" radius, 120° angle bend [R(53)=5/32"] in a 0.040" thickness (T) sheet metal, with a given height (19) of 1 5/16" and a given length (20) of 2⅜" at one end, and a 5/16" radius 90° angle bend (R(53)=5/16"), with a given height (19) of ¾". The finished piece of sheet metal is shown in FIG. 10a.

It is necessary to determine the SB, BA and MD, using the calculators of FIGS. 92a and 92b. For 120°, these values, calculated from empirical formulae, are:

$$SB = (R + T)K = 0.196 \times 1.7320 = 0.339''$$

$$BA = (1^\circ BA \times 120) = 0.00303 \times 120 = 0.364''$$

$$MD = (120^\circ SB \times 2) - (120^\circ BA) = (.339 \times 2) - (120^\circ BA) = 0.678 - 0.364 = 0.314''$$

Figure 10B:
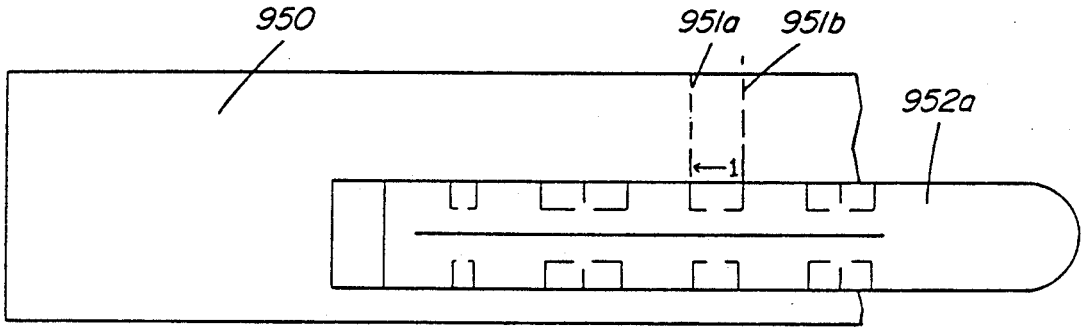
FIGS. 10*b*–10*k* are plan views showing steps in the laying out of the lines to provide the combination of the 120° bend and the 90° bend in the piece of sheet metal shown in FIG. 10*a*, using the layout ruler of an embodiment of the present invention.

The calculators shown in FIGS. 92a and 92b are then scanned to locate and select 90° bend layout rulers which contain identical or nearly identical numerical spacing values thereon. Such selected 90° bend layout rulers are then used for the purpose of providing that particular numerical spacing value. For the 120° bend, a 90° bend layout ruler blade designed for a thickness (T) of 0.040" and a radius of 5/16" is used. The steps in the laying out are:

(1) The shear cut size 951a for the 120° bend is determined by subtracting one 120° bend MD (as calculated above), 0.314", from the total length 951b, i.e. 1 5/16"+2⅜"+¾"=4 7/16". This is determined, as shown in FIG. 10b, using the BA of a 90° bend layout ruler 952a of this invention designed for a thickness of 0.100" and a radius of 5/32", having a spacing value of approximately 0.314" i.e. 0.315".

Figure 10C:
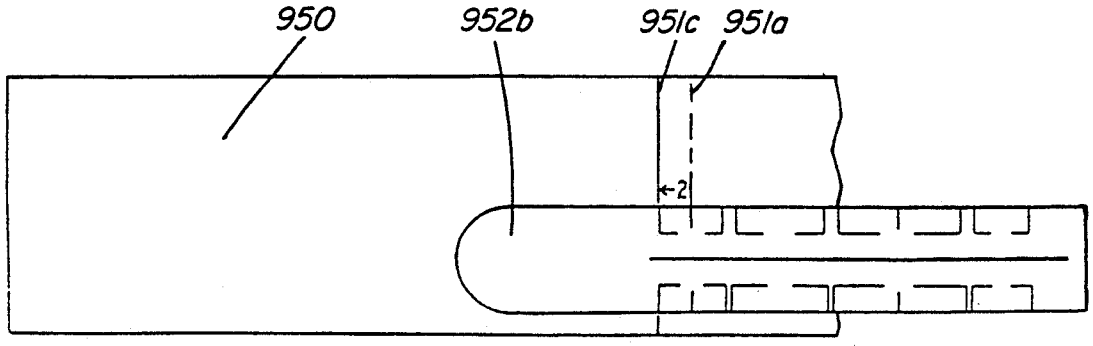

(2) To this dimension is added shear cut size 951c which is determined by subtracting one 90° bend MD (23) from the first shear cut dimension above 951a. This is determined, as shown in FIG. 10c, using a 90° bend layout ruler 952b of this invention designed for a thickness of 0.040" and a radius of 5/16".

Figure 10D:
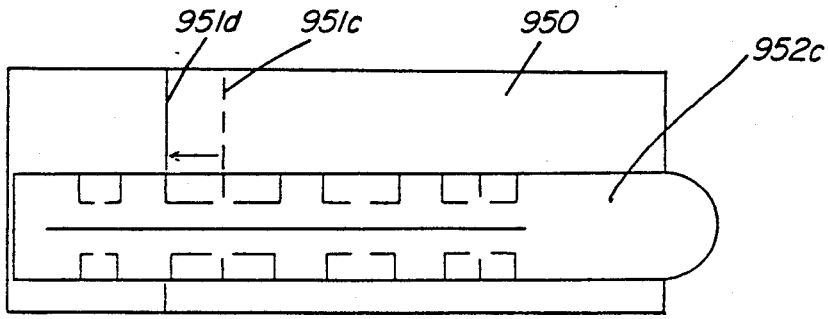

(3) The first bend tangent line 951d of the 120° bend is determined by subtracting one 120° SB (as calculated above), 0.339", from the given length (19) of 1 5/16", i.e., 1 5/16–0.339". This is determined as shown in FIG. 10d, using the SB of a 90° bend layout ruler 952c designed for a thickness of 0.090" and a radius of ¼", having a spacing value of approximately 0.339", i.e. 0.340".

Figure 10E:
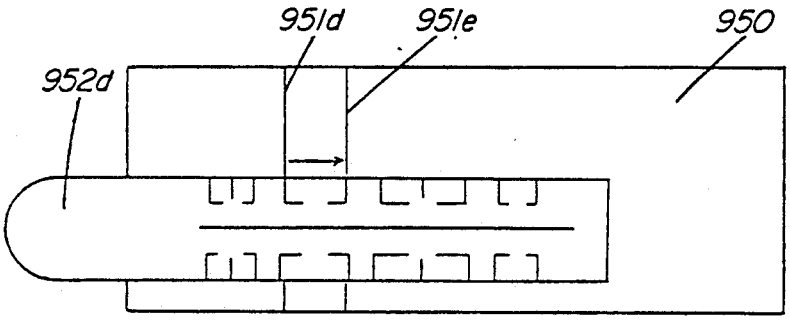

(4) The second bend tangent line 951e of the 120° bend is determined by adding one 120° BA (as calculated above), 0.364", to the first bend tangent line 951d. This is determined as shown in FIG. 10e, using the BA of a 90° bend layout ruler 952d designed for a thickness of 0.030" and a radius of 7/32" having a spacing value of 0.364".

Figure 10F:
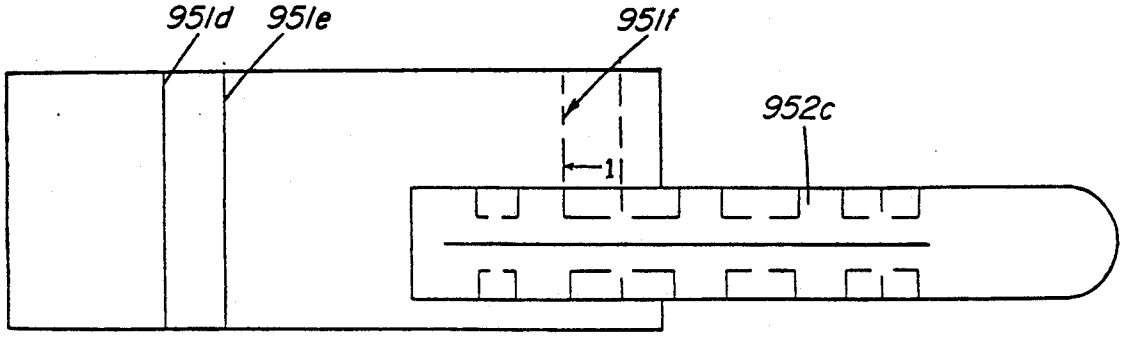

(5) The first bend tangent line for the 90° bend is determined by adding one given length (2⅜") to the second bend tangent line 951e and then subtracting two SB, i.e. one for the 120° bend and one for the 190° bend, i.e. 0.339". This is determined as shown in FIG. 10f, using the SB of a 90° bend layout ruler 952c designed for a thickness of 0.090" and a radius of ¼" having a spacing of approximately 0.339", i.e. 0.340".

Figure 10G:
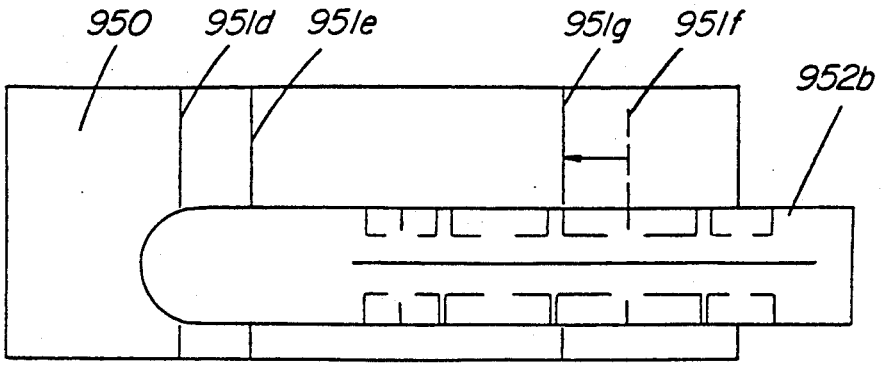

(6) The first bend tangent line 951g of the 90° bend finally is determined by subtracting one SB(21) from the first 120° MD liner 951f. This is determined, as shown in FIG. 10g, using the SB of a 90° bend layout ruler 952b designed for a thickness of 0.040" and a radius of 5/16" previously used.

Figure 10H:
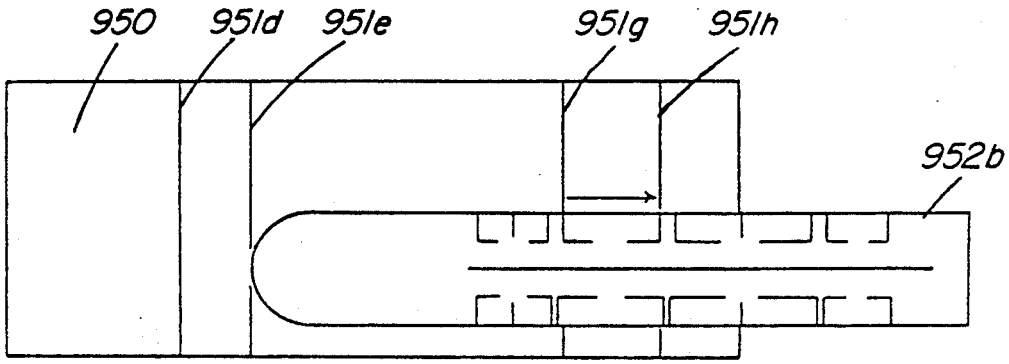

(7) The second bend tangent line 951h of the 90° end is determined by adding one BA (22) to the first bend tangent line 951g of the 90° bend. This is a determined as shown in FIG. 10h, using the same 90° bend layout ruler 952b designed from a thickness of 0.040" and a radius of 5/16" previously used.

Figure 10I:
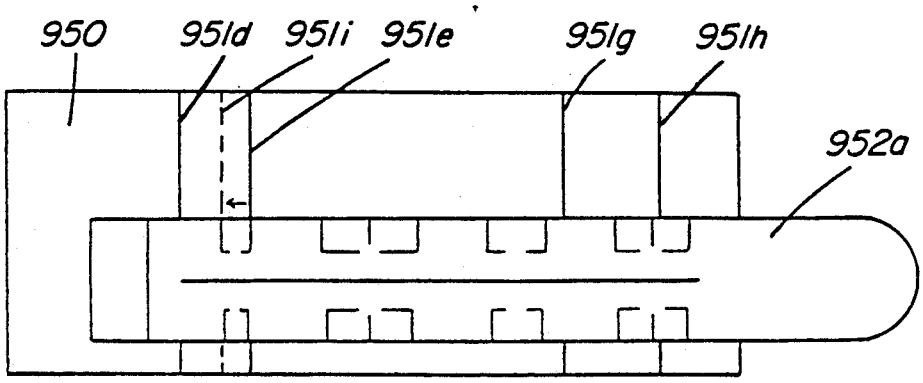
Figure 10J:
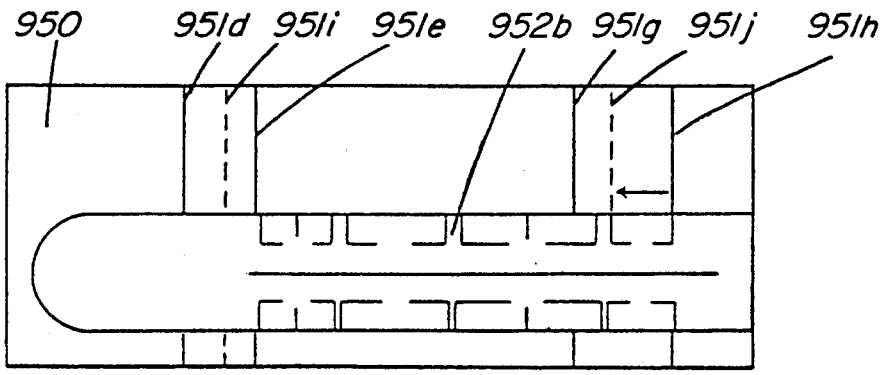

(8) The brake or sight line 951i from the 120° bend is then drawn-in. The brake or sight line 951i is located one 5/32" bend radius back from the second bend tangent line 951e. The marking-off of this brake or sight line is shown in FIG. 10i, using the R of a 90° bend layout ruler 952a designed for a thickness of 0.100" and a radius of 5/32". The brake or sight line 951j of the 90° bend is then drawn in. The brake or slight line 951j is located one 5/16" bend radius R (18) back from the second bend tangent line 951h. The marking-off of this brake or sight line is shown in FIG. 10j, using the R of the same 90° bend layout ruler 952b designed for a thickness of 0.040" and a radius of 5/16".

Figure 10K:
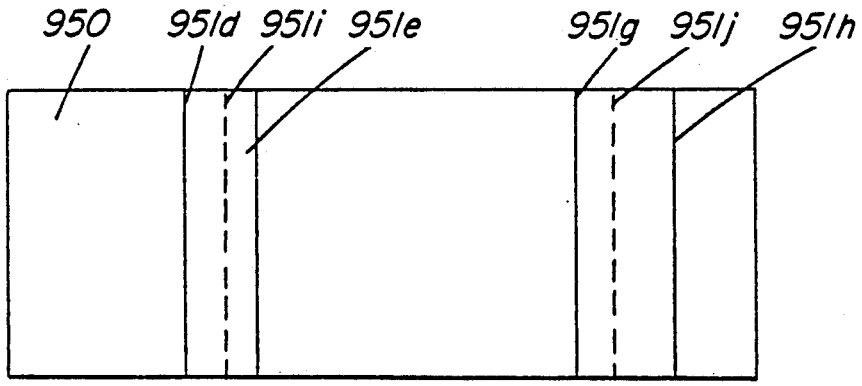
Figure 6A:
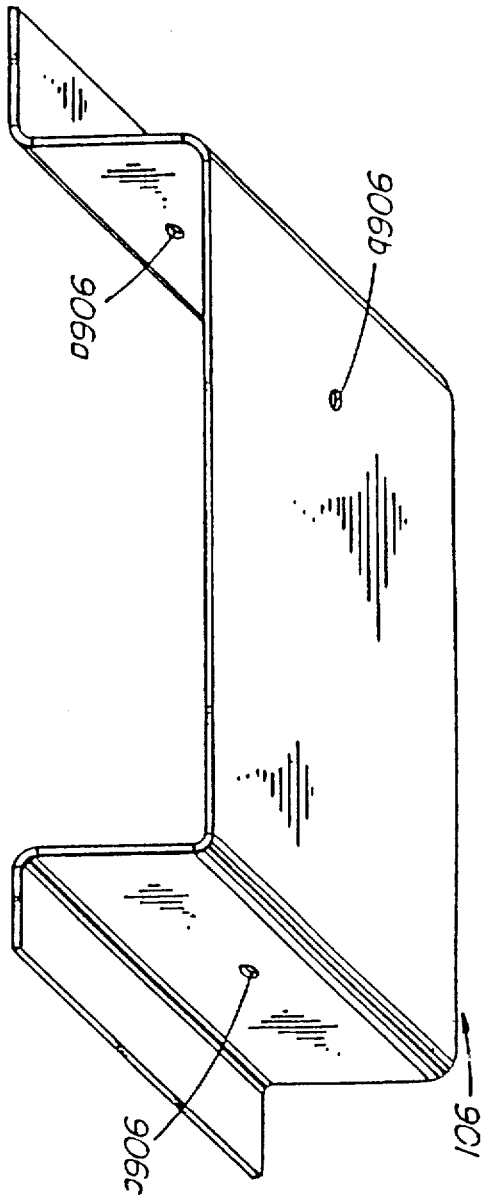
Figure 6B:
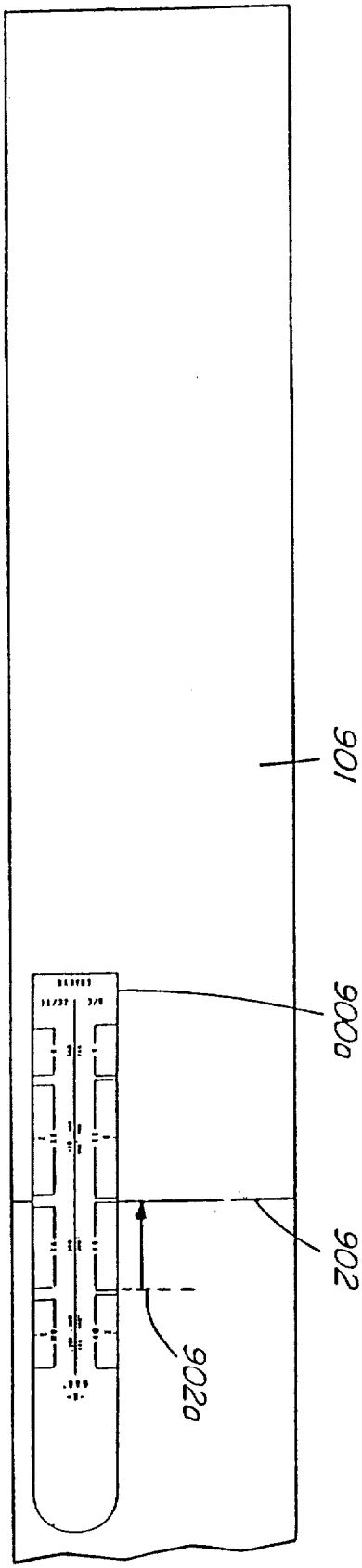

(9) The left hand side of the sheet metal is then bent 120°, a 5/32" radius nose and using the drawn-in brake or sight line 951i as a guide. Then the right hand side of the sheet metal is bent 90° using a 5/16" radius nose and using the drawn-in brake or sight line 951j as a guide. This is shown in FIG. 10k, following the teachings of FIG. 4g.

FIG. 4g shows the location of the brake or sight line in relation to the nose 886 of the brake 887. When bending the brake or sight line it is designed so that it is even with the nose 886 of the brake 887.

(7) Conclusion

From the foregoing description, one skilled in the art can easily ascertain the essential characteristics of this invention, and without departing from the spirit and scope thereof, can make various changes and modifications of the invention to adapt to it various usages and conditions. Consequently, such changes and modifications are properly, equitably, and "intended" to be within the full range of equivalence of the following claims.

What I claim is:

1. A layout ruler to perform flat layout patterns directly on sheet metal stock, and to mark the total length, or the shear cut size of the sheet metal stock and to mark the sight line for bending on the sheet metal stock comprising:

(a) a body member bearing a scale component along its central longitudinal axis; and (b) a scale blade component provided with a plurality of spaced-apart transverse lines extending from at least one side edge of said body member, said scale blade component bearing:

(i) one pair of spaced-apart lines representative of the inside bend radius (R);

(ii) at least one pair of spaced-apart lines representative of the set back (SB);

(iii) one pair of spaced-apart lines representative of the bend allowance (BA); and (iv) at least one pair of spaced-apart lines representative of the material deduction (MD);

whereby, upon use of said layout ruler, the total length or the shear cut size of the sheet metal stock can be determined, and the sight line or lines can be marked directly thereon.

2. The layout ruler of claim 1 wherein a plurality of said spaced-apart, transverse lines extend from each side edge of said body member, each said scale blade component being designed to produce different R, SB, BA and MD for a selected radius of 90° bend.

3. The layout ruler of claim 2 wherein each such scale blade component is designed for a selected metal thickness (T).

4. The layout ruler of claims 2 or 3 wherein said spaced-apart lines provided are representative, sequentially, of one R, two SB, one BA and two MD.

5. The layout ruler of claims 2 or 3 wherein said spaced-apart lines provided are representative, sequentially, of one R, one SB, two SB, one BA, one MD and two MD.

6. A packet of layout rulers to perform flat layout patterns directly on sheet metal stock, and to mark the total length or the shear cut size of the sheet metal stock and to mark the sight line for bending on the sheet metal stock: comprising a plurality of layout rulers, each having a round end all secured together at a pivot point at said round end of each such ruler, each said ruler comprising:

(a) a body member bearing a scale component along its central longitudinal axis; and (b) a scale blade component provided with a plurality of spaced-apart transverse lines extending from at least one side edge of said body member, said scale blade component bearing:

(i) one pair of spaced-apart lines representative of the inside bend radius (R);

(ii) at least one pair of spaced-apart lines representative of the set back (SB);

(iii) one pair of spaced-apart lines representative of the bend allowance (BA); and (iv) at least one pair of spaced-apart lines representative of the material deduction (MD);

whereby, upon use of said layout ruler, the total length or the shear cut size of the sheet metal stock can be determined, and the sight line or lines can be marked directly thereon.

7. The packet as claimed in claim 6 wherein, a plurality of said spaced-apart, transverse lines extend from each side edge of said body member, each of said scale blade component being designed to produce different R, SB, BA and MD for a selected radius of 90° bend.

8. The packet as claimed in claim 6 wherein for each said ruler each such scale blade component is designed for a selected metal thickness (T).

9. The packet as claimed in claim 7 or 8 wherein for each said ruler, said spaced-apart lines provided are representative, sequentially, of one R, two SB, one BA and two MD.

10. The packet as claimed in claim 7 or 8 wherein, for each said ruler, said spaced-apart lines provided are representative, sequentially, of one R, one SB, two SB, one BA, the MD and two MD.

* * * * *

UNITED STATES PATENT AND TRADEMARK OFFICE

CERTIFICATE OF CORRECTION

PATENT NO. : 5,014,438

DATED : May 14, 1991

INVENTOR(S) : Jean-Pierre Gravel

It is certified that error appears in the above-identified patent and that said Letters Patent is hereby corrected as shown below:

IN THE ABSTRACT:

Line 6, change "ocmponent" to --component--

Line 9, change "lesat" to --least--

IN THE DRAWINGS:

Fig. 6b should read as shown on the attached sheet

Signed and Sealed this

Twenty-fourth Day of November, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,014,438

DATED : May 14, 1991

INVENTOR(S) : Jean-Pierre Gravel

It is certified that error appears in the above-identified patent and that said Letters Patent is hereby corrected as shown below:

Column 9, line 42, change "88b-88f" to -- 4b-4f --

Column 10, line 23, change "89b" to --5b--

Column 11, line 15, change "90a" to --6a--

Column 11, line 46, change "90e" to --6e--

Column 11, line 68, change "90g" to --6g--

Column 13, line 44, change "7b" to --911b--

Column 13, line 45, change "91b" to --7b--

Column 13, line 60, change "901f" to --911f--

Column 14, line 22, change "913a" to --913--

Column 14, line 38, change "901p" to --911p--

Column 15, line 4, (both occurrences), change "7g" to --4g--

Table 4, line 2, change "2024-13-14" to --2024-T3-T4--

Table 4, line 7, change "6161-16" to --6061-T6--

Table 4, line 9, change "7075-16" to --7075-T6--

UNITED STATES PATENT AND TRADEMARK OFFICE

CERTIFICATE OF CORRECTION

PATENT NO. : 5,014,438

DATED : May 14, 1991

INVENTOR(S) : Jean-Pierre Gravel

It is certified that error appears in the above-identified patent and that said Letters Patent is hereby corrected as shown below:

Column 29, line 26, change "of Figs. 92a and 92b" to --described above and as shown in Tables 2-17 inclusive--

Column 31, line 4, change "94c" to --9c--

Column 31, line 11, change "94d" to --9d--

Column 31, line 17, change "94e" to --9e--

Column 31, line 22, change "94f" to --9f--

Column 31, line 45, change "of Figs. 92a and 92b" to --described above and as shown in Tables 2-17 inclusive--

Column 31, line 57, change "shown in Figs. 92a and 92b" to --described above and as shown in Tables 2-17 inclusive--

Signed and Sealed this

Second Day of February, 1993

*Attest:*

STEPHEN G. KUNIN

*Attesting Officer*

*Acting Commissioner of Patents and Trademarks*

UNITED STATES PATENT AND TRADEMARK OFFICE

CERTIFICATE OF CORRECTION

PATENT NO. : 5,014,438

DATED : May 14, 1991

INVENTOR(S) : Jean-Pierre Gravel

It is certified that error appears in the above-identified patent and that said Letters Patent is hereby corrected as shown below:

Column 14, line 10, change "9ld" to --7d--.

Signed and Sealed this

Thirtieth Day of March, 1993

*Attest:*

STEPHEN G. KUNIN

*Attesting Officer*

*Acting Commissioner of Patents and Trademarks*